US008823260B1

(12) United States Patent
Strbik, III et al.

(10) Patent No.: US 8,823,260 B1
(45) Date of Patent: Sep. 2, 2014

(54) PLASMA-DISC PDP

(75) Inventors: Oliver M. Strbik, III, Holland, OH (US); Daniel K. Wedding, Toledo, OH (US); Carol Ann Wedding, Toledo, OH (US)

(73) Assignee: Imaging Systems Technology, Toledo, OH (US)

( * ) Notice: Subject to any disclaimer, the term of this patent is extended or adjusted under 35 U.S.C. 154(b) by 1965 days.

(21) Appl. No.: 11/656,417

(22) Filed: Jan. 23, 2007

Related U.S. Application Data

(60) Provisional application No. 60/762,189, filed on Jan. 26, 2006.

(51) Int. Cl.
*H01J 17/49* (2012.01)

(52) U.S. Cl.
USPC ..... 313/582

(58) Field of Classification Search
USPC ..... 313/582
See application file for complete search history.

(56) References Cited

U.S. PATENT DOCUMENTS

| | | | |
|---|---|---|---|
| 2,187,432 | A | 1/1940 | Powers |
| 2,644,113 | A | 6/1953 | Etzkorn |
| 3,050,654 | A | 8/1962 | Toulon |
| 3,177,161 | A | 4/1965 | Smith-Johannsen |
| 3,264,073 | A | 8/1966 | Schmitt et al. |
| 3,365,315 | A | 1/1968 | Beck et al. |
| 3,423,489 | A | 1/1969 | Arens |
| 3,528,809 | A | 9/1970 | Farnand |
| 3,602,754 | A | 8/1971 | Pfaender et al. |
| 3,607,169 | A | 9/1971 | Cox |
| 3,646,384 | A | 2/1972 | Lay |
| 3,652,891 | A | 3/1972 | Janning |
| 3,654,680 | A | 4/1972 | Bode et al. |
| 3,666,981 | A | 5/1972 | Lay |
| 3,674,461 | A | 7/1972 | Farnand et al. |
| 3,699,050 | A | 10/1972 | Henderson |
| 3,755,027 | A | 8/1973 | Gilsing |
| 3,769,543 | A | 10/1973 | Pennebaker |
| 3,792,136 | A | 2/1974 | Schmitt |
| 3,793,041 | A | 2/1974 | Sowman |
| 3,811,061 | A | 5/1974 | Nakayama et al. |
| 3,836,810 | A | 9/1974 | Johanns et al. |
| 3,838,307 | A | 9/1974 | Masi |
| 3,838,998 | A | 10/1974 | Matthews et al. |
| 3,848,248 | A | 11/1974 | MacIntyre |
| 3,855,951 | A | 12/1974 | Giles |
| 3,860,846 | A | 1/1975 | Mayer |
| 3,873,870 | A | 3/1975 | Fukushima et al. |
| 3,885,195 | A | 5/1975 | Amano |
| 3,886,395 | A | 5/1975 | Eukushima et al. |
| 3,916,584 | A | 11/1975 | Howard et al. |
| 3,927,342 | A | 12/1975 | Bode et al. |

(Continued)

*Primary Examiner* — Nimeshkumar Patel
*Assistant Examiner* — Steven Horikoshi
(74) *Attorney, Agent, or Firm* — Donald K. Wedding

(57) ABSTRACT

Electrode configurations for an AC or DC gas discharge plasma display panel (PDP) device having one or more substrates and a multiplicity of pixels or sub-pixels that are defined by a hollow plasma-shell filled with an ionizable gas. Plasma-shell includes plasma-disc, plasma-dome, and plasma-sphere. The invention is described with reference to a plasma-disc. The plasma-disc has at least two opposing flat sides such as a flat top and flat bottom. Two or more addressing electrodes are in electrical contact with each plasma-disc. At least one electrode is in electrical contact with a side of the plasma-disc that is not flat.

20 Claims, 48 Drawing Sheets

(56) References Cited

U.S. PATENT DOCUMENTS 3,933,679 A 1/1976 Weitzel et al.
3,935,494 A 1/1976 Dick et al.
3,939,822 A 2/1976 Markowitz
3,954,678 A 5/1976 Marquisee
3,964,050 A 6/1976 Mayer
3,969,718 A 7/1976 Strom
3,975,194 A 8/1976 Farnand et al.
3,990,068 A 11/1976 Mayer et al.
3,998,618 A 12/1976 Kreick et al.
4,027,188 A 5/1977 Bergman
4,027,191 A 5/1977 Schaufele et al.
4,035,690 A 7/1977 Roeber
4,038,577 A 7/1977 Bode et al.
4,048,533 A 9/1977 Hinson et al.
4,059,423 A 11/1977 De Vos et al.
4,060,749 A 11/1977 Shinada et al.
4,075,025 A 2/1978 Rostoker
4,106,009 A 8/1978 Dick
4,111,713 A 9/1978 Beck
4,119,422 A 10/1978 Rostoker
4,126,807 A 11/1978 Wedding et al.
4,126,809 A 11/1978 Wedding et al.
4,133,854 A 1/1979 Hendricks
4,163,637 A 8/1979 Hendricks
4,164,678 A 8/1979 Biazzo et al.
4,166,147 A 8/1979 Lange et al.
4,257,798 A 3/1981 Hendricks et al.
4,279,632 A 7/1981 Frosch et al.
4,290,847 A 9/1981 Johnson et al.
4,303,061 A 12/1981 Torobin
4,303,431 A 12/1981 Torobin
4,303,432 A 12/1981 Torobin
4,303,433 A 12/1981 Torobin
4,303,603 A 12/1981 Torobin
4,303,729 A 12/1981 Torobin
4,303,730 A 12/1981 Torobin
4,303,731 A 12/1981 Torobin
4,303,732 A 12/1981 Torobin
4,303,736 A 12/1981 Torobin
4,307,051 A 12/1981 Sargeant et al.
4,314,827 A 2/1982 Leitheiser et al.
4,320,418 A * 3/1982 Pavliscak ..... 348/797
4,322,378 A 3/1982 Hendricks
4,344,787 A 8/1982 Beggs et al.
4,349,456 A 9/1982 Sowman
4,356,429 A 10/1982 Tang
4,363,646 A 12/1982 Torobin
4,391,646 A 7/1983 Howell
4,392,988 A 7/1983 Dobson et al.
4,415,512 A 11/1983 Torobin
4,459,145 A 7/1984 Elsholz
4,494,038 A 1/1985 Wedding et al.
4,525,314 A 6/1985 Torobin
4,542,066 A 9/1985 Delzant
4,547,233 A 10/1985 Delzant
4,548,196 A 10/1985 Torobin
4,548,767 A 10/1985 Hendricks
4,568,389 A 2/1986 Torobin
4,582,534 A 4/1986 Torobin
4,596,681 A 6/1986 Grossman et al.
4,618,525 A 10/1986 Chamberlain et al.
4,637,990 A 1/1987 Torobin
4,638,218 A 1/1987 Shinoda et al.
4,671,909 A 6/1987 Torobin
4,713,300 A 12/1987 Sowman et al.
4,737,687 A 4/1988 Shinoda et al.
4,743,511 A 5/1988 Sowman et al.
4,743,545 A 5/1988 Torobin
4,744,831 A 5/1988 Beck
4,757,036 A 7/1988 Kaar et al.
4,777,154 A 10/1988 Torobin
4,778,502 A 10/1988 Garnier et al.
4,793,980 A 12/1988 Torobin
4,797,378 A 1/1989 Sowman
4,800,180 A 1/1989 McAllister et al.
4,853,590 A 8/1989 Andreadakis
4,865,875 A 9/1989 Kellerman
4,879,321 A 11/1989 Laroche
4,883,779 A 11/1989 McAllister et al.
4,960,351 A 10/1990 Kendall et al.
4,963,792 A 10/1990 Parker
5,017,316 A 5/1991 Sowman
5,053,436 A 10/1991 Delgado
5,055,240 A 10/1991 Lee et al.
5,069,702 A 12/1991 Block et al.
5,077,241 A 12/1991 Moh et al.
5,176,732 A 1/1993 Block et al.
5,185,299 A 2/1993 Wood et al.
5,212,143 A 5/1993 Torobin
5,225,123 A 7/1993 Torobin
5,260,002 A 11/1993 Wang
5,326,298 A 7/1994 Hotomi
5,397,759 A 3/1995 Torobin
5,487,390 A 1/1996 Cohen et al.
5,534,348 A 7/1996 Miller et al.
5,625,256 A 4/1997 Tiedt et al.
5,661,500 A * 8/1997 Shinoda et al. ..... 345/60
5,793,158 A 8/1998 Wedding
5,932,968 A 8/1999 Ghosh et al.
5,939,826 A 8/1999 Ohsawa et al.
5,984,747 A 11/1999 Bhagavatula et al.
6,149,072 A 11/2000 Tseng
6,176,584 B1 1/2001 Best et al.
6,184,848 B1 2/2001 Weber
6,208,791 B1 3/2001 Bischel et al.
6,255,777 B1 7/2001 Kim et al.
6,368,708 B1 4/2002 Brown et al.
6,376,995 B1 4/2002 Kato et al.
6,377,387 B1 4/2002 Duthaler et al.
6,402,985 B1 6/2002 Hsu et al.
6,528,952 B2 3/2003 Kato et al.
6,545,422 B1 4/2003 George et al.
6,570,335 B1 5/2003 George et al.
6,612,889 B1 9/2003 Green et al.
6,620,012 B1 9/2003 Johnson et al.
6,633,117 B2 10/2003 Shinoda et al.
6,646,388 B2 11/2003 George et al.
6,650,055 B2 11/2003 Ishimoto et al.
6,677,704 B2 1/2004 Ishimoto et al.
6,693,389 B2 2/2004 Marcotte et al.
6,762,566 B1 7/2004 George et al.
6,764,367 B2 7/2004 Green et al.
6,768,478 B1 7/2004 Wani et al.
6,791,264 B2 9/2004 Green et al.
6,794,812 B2 9/2004 Yamada et al.
6,796,867 B2 9/2004 George et al.
6,801,001 B2 10/2004 Drobot et al.
6,822,626 B2 11/2004 George et al.
6,836,063 B2 12/2004 Ishimoto et al.
6,836,064 B2 12/2004 Yamada et al.
6,841,929 B2 1/2005 Ishimoto et al.
6,853,144 B2 2/2005 Marcotte
6,857,923 B2 2/2005 Yamada et al.
6,864,631 B1 3/2005 Wedding
6,893,677 B2 5/2005 Yamada et al.
6,902,456 B2 6/2005 George et al.
6,914,382 B2 7/2005 Ishimoto et al.
6,930,442 B2 8/2005 Awamoto et al.
6,932,664 B2 8/2005 Yamada et al.
6,935,913 B2 8/2005 Wyeth et al.
6,969,292 B2 11/2005 Tokai et al.
6,975,068 B2 12/2005 Green et al.
7,005,793 B2 2/2006 George et al.
7,025,648 B2 4/2006 Green et al.
7,049,748 B2 5/2006 Tokai et al.
7,083,681 B2 8/2006 Yamada et al.
7,122,961 B1 10/2006 Wedding
7,125,305 B2 10/2006 Green et al.
7,135,767 B2 11/2006 Wong et al.
7,137,857 B2 11/2006 George et al.
7,140,941 B2 11/2006 Green et al.
7,157,854 B1 1/2007 Wedding
7,176,628 B1 2/2007 Wedding
7,247,989 B1 7/2007 Wedding

(56) References Cited

U.S. PATENT DOCUMENTS

| | | | | |
|---|---|---|---|---|
| 7,288,014 | B1 | 10/2007 | George et al. | |
| 7,307,602 | B1 | 12/2007 | Wedding et al. | |
| 7,375,342 | B1 | 5/2008 | Wedding | |
| 7,405,516 | B1 | 7/2008 | Wedding | |
| 7,456,571 | B1 | 11/2008 | Wedding | |
| 2001/0028216 | A1 | 10/2001 | Tokai et al. | |
| 2002/0004111 | A1 | 1/2002 | Matsubara | |
| 2002/0030437 | A1 | 3/2002 | Shimizu et al. | |
| 2002/0041156 | A1 | 4/2002 | Juestel et al. | |
| 2002/0101151 | A1 | 8/2002 | Choi et al. | |
| 2002/0106501 | A1 | 8/2002 | Debe | |
| 2003/0049990 | A1* | 3/2003 | Yamada et al. | 445/24 |
| 2003/0122485 | A1 | 7/2003 | Tokai et al. | |
| 2003/0164684 | A1 | 9/2003 | Green et al. | |
| 2003/0182967 | A1 | 10/2003 | Tokai et al. | |
| 2003/0184212 | A1 | 10/2003 | Ishimoto et al. | |
| 2003/0214243 | A1 | 11/2003 | Drobot et al. | |
| 2004/0033319 | A1 | 2/2004 | Yamada et al. | |
| 2004/0063373 | A1 | 4/2004 | Johnson et al. | |
| 2004/0149943 | A1 | 8/2004 | Field | |
| 2004/0175854 | A1 | 9/2004 | George et al. | |
| 2004/0234902 | A1 | 11/2004 | Toyoda et al. | |
| 2005/0022905 | A1 | 2/2005 | Wong et al. | |
| 2005/0095944 | A1 | 5/2005 | George et al. | |
| 2006/0097620 | A1 | 5/2006 | George et al. | |
| 2006/0158112 | A1 | 7/2006 | Hur et al. | |
| 2006/0202309 | A1 | 9/2006 | Wong et al. | |
| 2007/0015431 | A1 | 1/2007 | Green et al. | |

* cited by examiner

Section B-B View

Top View - substrate and electrodes

Two Electrodes
Top View

Section A-A View

Section B-B View

Top View - substrate and electrodes

Two Electrodes
Top View

Section A-A View

Section B-B View

Top View - substrate and electrodes

Three Electrodes
Top View

Section A-A View

Section B-B View

Top View - substrate and electrodes

Three Electrodes
Top View

Section A-A View

Section B-B View

Top View - substrate and electrodes

Three Electrodes
Top View

Section A-A View

Section B-B View

Top View - substrate and electrodes

Three Electrodes
Top View

Section A-A View

Two Electrodes
Top View

Section B-B View

Top View - substrate and electrodes

Section A-A View

Two Electrodes
Top View

Section B-B View

Top View - substrate and electrodes

Section A-A View

Section B-B View

Top View - substrate and electrodes

Two Electrodes
Top View

Section A-A View

Section B-B View

Substrate Top View

Section A-A View

Section B-B View

Substrate Top View

Section A-A View

Section B-B View

Top View - substrate and electrodes

Two Electrodes
Top View

Section A-A View

Section B-B View

Top View - substrate and electrodes

Two Electrodes
Top View

Section A-A View

Section B-B View

Top View - substrate and electrodes

Two Electrodes
Top View

Section A-A View

Section B-B View

Top View - substrate and electrodes

Two Electrodes
Top View

Section A-A View

Section B-B View

Top View - substrate and electrodes

Two Electrodes
Top View

Section A-A View

Section B-B View

Top View - substrate and electrodes

Two Electrodes
Top View

Section A-A View

Section B-B View

Top View - substrate and electrodes

Two Electrodes
Top View

Section A-A View

PLASMA-DISC PDP

RELATED APPLICATIONS

Priority is claimed under 35 USC 119(e) for Provisional Patent Application Ser. No. 60/762,189 filed Jan. 26, 2006.

FIELD OF THE INVENTION

This invention relates to electrode configurations for an AC or DC plasma display panel (PDP) comprised of plasma-shell pixels. As used herein, plasma-shell includes plasma-disc, plasma-dome, and plasma-sphere. The hollow plasma-shells are filled with an ionizable gas and are used as pixels or sub-pixels in a gas discharge plasma display panel (PDP) device having one or more substrates.

This invention particularly relates to electrode configurations for electrically connecting a plasma-disc to electrical conductors such as electrodes in a PDP. A plasma-disc has at least two opposing flat sides such as a flattened top and bottom. Other sides or ends of the plasma-disc may also be flat. A flat base side of each plasma-disc is in contact with the surface of a PDP substrate. The PDP substrate may be rigid, flexible, or partially flexible, with a flat, curved, or irregular surface.

The PDP may contain a luminescent substance or material that produces light when excited by photons from the gas discharge inside a plasma-shell. The luminescent substance may be located inside and/or outside the plasma-disc and/or incorporated as part of the plasma-shell material. The luminescent substance may be inorganic, organic, or a combination of inorganic and organic materials. Up-conversion (Stokes) and down-conversion (Anti-Stokes) luminescent substances may be used.

The electrode configurations and the inventions herein are described with reference to a plasma-disc. However, it is contemplated that such may be used for plasma-shells of other geometric configurations including plasma-domes and plasma-spheres.

BACKGROUND OF INVENTION

PDP Structures and Operation

A gas discharge plasma display panel (PDP) comprises a multiplicity of single addressable picture elements, each element referred to as a pixel or cell. The electrodes are generally grouped in a matrix configuration to allow for selective addressing of each pixel or cell. In a multicolor PDP, two or more pixels or cells may be addressed as sub-pixels or sub-cells to form a single pixel or cell. As used herein, pixel or cell means sub-pixel or sub-cell. The pixel or cell element is defined by two or more electrodes positioned in such a way so as to provide a voltage potential across a gap containing an ionizable gas. When sufficient voltage is applied across the gap, the gas ionizes to produce light. In an AC gas discharge plasma display, the electrodes at a pixel site are insulated from the gas with a dielectric. In a DC gas discharge one or more of the electrodes is in contact with the gas.

Several types of voltage pulses may be applied across a plasma display cell gap to form a display image. These pulses include a write pulse, a sustain pulse, and an erase pulse. The write pulse is of a sufficient voltage potential to ionize the gas at the pixel site and is selectively applied across selected pixel sites. The ionized gas will produce visible light and/or invisible light such as UV, which excites a phosphor to glow. In an AC gas discharge, sustain pulses are a series of pulses that produce a voltage potential across pixels to maintain ionization of pixels previously ionized. An erase pulse is used to selectively extinguish ionized pixels.

The voltage at which a pixel will ionize, sustain, and erase depends on a number of factors including the distance between the electrodes, the composition of the ionizing gas, and the pressure of the ionizing gas. Also of importance is the dielectric composition and thickness. To maintain uniform electrical characteristics throughout the display, it is desired that the various physical parameters adhere to required tolerances. Maintaining the required tolerance depends on display structure, cell geometry, fabrication methods and the materials used. The prior art discloses a variety of plasma display structures, cell geometries, methods of construction, and materials.

AC PDP

AC gas discharge devices include both monochrome (single color) AC plasma displays and multi-color (two or more colors) AC plasma displays. Examples of monochrome AC gas discharge (plasma) displays are well known in the prior art and include those disclosed in U.S. Pat. No. 3,559,190 (Bitzer et al.), U.S. Pat. No. 3,499,167 (Baker et al.), U.S. Pat. No. 3,860,846 (Mayer), U.S. Pat. No. 3,964,050 (Mayer), U.S. Pat. No. 4,080,597 (Mayer), U.S. Pat. No. 3,646,384 (Lay), and U.S. Pat. No. 4,126,807 (Wedding), all incorporated herein by reference. Examples of multicolor AC plasma displays are well known in the prior art and include those disclosed in U.S. Pat. No. 4,233,623 (Pavliscak), U.S. Pat. No. 4,320,418 (Pavliscak), U.S. Pat. No. 4,827,186 (Knauer, et al.), U.S. Pat. No. 5,661,500 (Shinoda et al.), U.S. Pat. No. 5,674,553 (Shinoda, et al.), U.S. Pat. No. 5,107,182 (Sano et al.), U.S. Pat. No. 5,182,489 (Sano), U.S. Pat. No. 5,075,597 (Salavin et al.), U.S. Pat. No. 5,742,122 (Amemiya, et al.), U.S. Pat. No. 5,640,068 (Amemiya et al.), U.S. Pat. No. 5,736,815 (Amemiya), U.S. Pat. No. 5,541,479 (Nagakubi), U.S. Pat. No. 5,745,086 (Weber), and U.S. Pat. No. 5,793,158 (Wedding), all incorporated herein by reference.

This invention described herein refers to an AC plasma display. The PDP industry has used two different AC plasma display panel (PDP) structures, the two-electrode AC columnar discharge structure and the three-electrode AC surface discharge structure. Columnar discharge is also called co-planar discharge.

Columnar AC PDP

The two-electrode columnar or co-planar discharge plasma display structure is disclosed in U.S. Pat. No. 3,499,167 (Baker et al.) and U.S. Pat. No. 3,559,190 (Bitzer et al.). The two-electrode columnar discharge structure is also referred to as opposing electrode discharge, twin substrate discharge, or co-planar discharge. In the two-electrode columnar discharge AC plasma display structure, the sustaining voltage is applied between an electrode on a rear or bottom substrate and an opposite electrode on the front or top viewing substrate. The gas discharge takes place between the two opposing electrodes in between the top viewing substrate and the bottom substrate.

The columnar discharge PDP structure has been widely used in monochrome AC plasma displays that emit orange or red light from a neon gas discharge. Phosphors may be used in a monochrome structure to obtain a color other than neon orange.

In a multi-color columnar discharge PDP structure as disclosed in U.S. Pat. No. 5,793,158 (Wedding), phosphor stripes or layers are deposited along the barrier walls and/or on the bottom substrate adjacent to and extending in the same direction as the bottom electrode. The discharge between the two opposite electrodes generates electrons and ions that bombard and deteriorate the phosphor thereby shortening the life of the phosphor and the PDP.

In a two electrode columnar discharge PDP as disclosed by Wedding ('158), each light emitting pixel is defined by a gas discharge between a bottom or rear electrode x and a top or front opposite electrode y, each cross-over of the two opposing arrays of bottom electrodes x and top electrodes y defining a pixel or cell.

Surface Discharge AC PDP

The three-electrode multi-color surface discharge AC plasma display panel structure is widely disclosed in the prior art including U.S. Pat. No. 5,661,500 (Shinoda et al.) and U.S. Pat. No. 5,674,553 (Shinoda et al.); U.S. Pat. No. 5,745,086 (Weber); and U.S. Pat. No. 5,736,815 (Amemiya), all incorporated herein by reference.

In a surface discharge PDP, each light emitting pixel or cell is defined by the gas discharge between two electrodes on the top substrate. In a multi-color RGB display, the pixels may be called sub-pixels or sub-cells. Photons from the discharge of an ionizable gas at each pixel or sub-pixel excite a photoluminescent phosphor that emits red, blue, or green light.

In a three-electrode surface discharge AC plasma display, a sustaining voltage is applied between a pair of adjacent parallel electrodes that are on the front or top viewing substrate. These parallel electrodes are called the bulk sustain electrode and the row scan electrode. The row scan electrode is also referred to as a row sustain electrode because it functions to address and sustain. The opposing electrode on the rear or bottom substrate is a column data electrode and is used to periodically address a row scan electrode on the top substrate. The sustaining voltage is applied to the bulk sustain and row scan electrodes on the top substrate. The gas discharge takes place between the row scan and bulk sustain electrodes on the top viewing substrate.

In a three-electrode surface discharge AC plasma display panel, the sustaining voltage and resulting gas discharge occurs between the electrode pairs on the top or front viewing substrate above and secluded from the phosphor on the bottom substrate. This separation of the discharge from the phosphor minimizes electron bombardment and deterioration of the phosphor deposited on the walls of the barriers or in the grooves (or channels) on the bottom substrate adjacent to and/or over the third (data) electrode.

DC PDP

This invention may be practiced in a DC gas discharge (plasma) display which is well known in the prior art, for example as disclosed in U.S. Pat. No. 3,788,722 (Milgram), U.S. Pat. No. 3,886,390 (Maloney et al.), U.S. Pat. No. 3,886,404 (Kurahashi et al.), U.S. Pat. No. 4,035,689 (Ogle et al.), U.S. Pat. No. 4,279,613 (Aboelfotoh), U.S. Pat. No. 4,329,626 (Hillenbrand et al.), U.S. Pat. No. 4,340,840 (Aboelfotoh et al.), U.S. Pat. No. 4,532,505 (Holz et al.), U.S. Pat. No. 5,233,272 (Whang et al.), U.S. Pat. No. 6,069,450 (Sakai et al.), U.S. Pat. No. 6,160,348 (Choi), and U.S. Pat. No. 6,428,377 (Choi), all incorporated herein by reference.

Single Substrate PDP

There may be used an AC or DC PDP structure having a so-called single substrate or monolithic plasma display panel structure having one substrate with or without a top or front viewing envelope or dome. Single-substrate or monolithic plasma display panel structures are well known in the prior art and are disclosed by U.S. Pat. No. 3,646,384 (Lay), U.S. Pat. No. 3,652,891 (Janning), U.S. Pat. No. 3,666,981 (Lay), U.S. Pat. No. 3,811,061 (Nakayama et al.), U.S. Pat. No. 3,860,846 (Mayer), U.S. Pat. No. 3,885,195 (Amano), U.S. Pat. No. 3,935,494 (Dick et al.), U.S. Pat. No. 3,964,050 (Mayer), U.S. Pat. No. 4,106,009 (Dick), U.S. Pat. No. 4,164,678 (Biazzo et al.), and U.S. Pat. No. 4,638,218 (Shinoda), all incorporated herein by reference.

RELATED PRIOR ART

Spheres, Beads, Ampoules, Capsules

The construction of a PDP out of gas filled hollow microspheres is known in the prior art. Such microspheres are referred to as spheres, beads, ampoules, capsules, bubbles, shells, and so forth. The following prior art relates to the use of microspheres in a PDP and are incorporated herein by reference.

U.S. Pat. No. 2,644,113 (Etzkorn) discloses ampoules or hollow glass beads containing luminescent gases that emit a colored light. In one embodiment, the ampoules are used to radiate ultra violet light onto a phosphor external to the ampoule itself.

U.S. Pat. No. 3,848,248 (MacIntyre) discloses the embedding of gas filled beads in a transparent dielectric. The beads are filled with a gas using a capillary. The external shell of the beads may contain phosphor.

U.S. Pat. No. 3,998,618 (Kreick et al.) discloses the manufacture of gas filled beads by the cutting of tubing. The tubing is cut into ampoules (shown as domes in FIG. 2) and heated to form shells. The gas is a rare gas mixture, 95% neon and 5% argon at a pressure of 300 Torr.

U.S. Pat. No. 4,035,690 (Roeber) discloses a plasma panel display with a plasma forming gas encapsulated in clear glass shells. Roeber used commercially available glass shells containing gases such as air, $SO_2$ or $CO_2$ at pressures of 0.2 to 0.3 atmosphere. Roeber discloses the removal of these residual gases by heating the glass shells at an elevated temperature to drive out the gases through the heated walls of the glass shell. Roeber obtains different colors from the glass shells by filling each shell with a gas mixture, which emits a color upon discharge, and/or by using a glass shell made from colored glass.

U.S. Pat. No. 4,963,792 (Parker) discloses a gas discharge chamber including a transparent dome portion.

U.S. Pat. No. 5,326,298 (Hotomi) discloses a light emitter for giving plasma light emission. The light emitter comprises a resin including fine bubbles in which a gas is trapped. The gas is selected from rare gases, hydrocarbons, and nitrogen.

Japanese Patent 11238469A, published Aug. 31, 1999, by Tsuruoka Yoshiaki of Dainippon discloses a plasma display panel containing a gas capsule. The gas capsule is provided with a rupturable part, which ruptures when it absorbs a laser beam.

U.S. Pat. No. 6,545,422 (George et al.) discloses a light-emitting panel with a plurality of sockets with spherical or other shape micro-components in each socket sandwiched between two substrates. The micro-component includes a shell filled with a plasma-forming gas or other material. The light-emitting panel may be a plasma display, electroluminescent display, or other display device. Other patents by George et al. and various joint inventors include U.S. Pat. No. 6,570,335 (George et al.), U.S. Pat. No. 6,612,889 (Green et al.), U.S. Pat. No. 6,620,012 (Johnson et al.), U.S. Pat. No. 6,646,388 (George et al.), U.S. Pat. No. 6,762,566 (George et al.), U.S. Pat. No. 6,764,367 (Green et al.), U.S. Pat. No. 6,791,264 (Green et al.), U.S. Pat. No. 6,796,867 (George et al.), U.S. Pat. No. 6,801,001 (Drobot et al.), U.S. Pat. No. 6,822,626 (George et al.), U.S. Pat. No. 6,902,456 (George et al.), U.S. Pat. No. 6,935,913 (Wyeth et al.), U.S. Pat. No. 6,975,068 (Green et al.), U.S. Pat. No. 7,005,793 (George et al.), U.S. Pat. No. 7,025,648 (Green et al.), U.S. Pat. No. 7,125,305 (Green et al.), U.S. Pat. No. 7,137,857 (George et al.), and U.S. Pat. No. 7,140,941 (Green et al.), all incorporated herein by reference.

U.S. Patent Application Publications filed by the various joint inventors of George et al. include 2004/0063373 (Johnson et al.), 2005/0095944 (George et al.), and U.S. 2006/0097620 (George et al.), all incorporated herein by reference.

Also incorporated herein is U.S. Pat. No. 6,864,631 (Wedding), which discloses a PDP, comprised of microspheres filled with ionizable gas.

RELATED PRIOR ART

Methods of Producing Microspheres

In the practice of this invention, any suitable method or process may be used to produce the plasma-shells such as plasma-spheres, plasma-discs, and plasma-domes. Numerous methods and processes to produce hollow shells or microspheres are well known in the prior art. Microspheres have been formed from glass, ceramic, metal, plastic and other inorganic and organic materials. Varying methods and processes for producing shells and microspheres have been disclosed and practiced in the prior art. Some of the prior art methods for producing plasma-discs are disclosed hereafter.

Some methods used to produce hollow glass microspheres incorporate a so-called blowing gas into the lattice of a glass while in frit form. The frit is heated and glass bubbles are formed by the in-permeation of the blowing gas. Microspheres formed by this method have diameters ranging from about 5 μm to approximately 5,000 μm. This method may produce shells with a residual blowing gas enclosed in the shell. The blowing gases typically include $SO_2$, $CO_2$, and/or $H_2O$. These residual gases may quench a plasma discharge. Because of these residual gases, microspheres produced with this method are not acceptable for producing plasma-spheres for use in a PDP.

Methods of manufacturing glass frit for forming hollow microspheres are disclosed by U.S. Pat. No. 4,017,290 (Budrick et al.) and U.S. Pat. No. 4,021,253 (Budrick et al.). Budrick et al. ('290) discloses a process whereby occluded material gasifies to form the hollow microsphere. Hollow microspheres are disclosed in U.S. Pat. No. 5,500,287 (Henderson) and U.S. Pat. No. 5,501,871 (Henderson). According to Henderson ('287), the hollow microspheres are formed by dissolving a permeant gas (or gases) into glass frit particles. The gas permeated frit particles are then heated at a high temperature sufficient to blow the frit particles into hollow microspheres containing the permeant gases. The gases may be subsequently out-permeated and evacuated from the hollow shell as described in step D in column 3 of Henderson ('287). Henderson ('287) and ('871) are limited to gases of small molecular size. The molecules of some gases such as xenon, argon, and krypton used in plasma displays may be too large to be permeated through the frit material or wall of the microsphere. Helium, which has a small molecular size, may leak through the microsphere wall or shell.

U.S. Pat. No. 4,257,798 (Hendricks et al.) discloses a method for manufacturing small hollow glass spheres filled with a gas introduced during the formation of the spheres, and is incorporated herein by reference. The gases disclosed include argon, krypton, xenon, bromine, DT, hydrogen, deuterium, helium, hydrogen, neon and carbon dioxide. Other Hendricks patents for the manufacture of glass spheres include U.S. Pat. Nos. 4,133,854 and 4,186,637, both incorporated herein by reference.

Microspheres are also produced as disclosed in U.S. Pat. No. 4,415,512 (Torobin), incorporated herein by reference. This method by Torobin comprises forming a film of molten glass across a blowing nozzle and applying a blowing gas at a positive pressure on the inner surface of the film to blow the film and form an elongated cylinder shaped liquid film of molten glass. An inert entraining fluid is directed over and around the blowing nozzle at an angle to the axis of the blowing nozzle so that the entraining fluid dynamically induces a pulsating or fluctuating pressure at the opposite side of the blowing nozzle in the wake of the blowing nozzle. The continued movement of the entraining fluid produces asymmetric fluid drag forces on a molten glass cylinder, which close and detach the elongated cylinder from the coaxial blowing nozzle. Surface tension forces acting on the detached cylinder form the latter into a spherical shape, which is rapidly cooled and solidified by cooling means to form a glass microsphere. In one embodiment of the above method for producing the microspheres, the ambient pressure external to the blowing nozzle is maintained at a super atmospheric pressure. The ambient pressure external to the blowing nozzle is such that it substantially balances, but is slightly less than the blowing gas pressure. Such a method is disclosed by U.S. Pat. No. 4,303,432 (Torobin) and WO 8000438A1 (Torobin), both incorporated herein by reference. The microspheres may also be produced using a centrifuge apparatus and method as disclosed by U.S. Pat. No. 4,303,433 (Torobin) and WO8000695A1 (Torobin), both incorporated herein by reference. Other methods for forming microspheres of glass, ceramic, metal, plastic, and other materials are disclosed in other Torobin patents including U.S. Pat. Nos. 5,397,759; 5,225,123; 5,212,143; 4,793,980; 4,777,154; 4,743,545; 4,671,909; 4,637,990; 4,582,534; 4,568,389; 4,548,196; 4,525,314; 4,363,646; 4,303,736; 4,303,732; 4,303,731; 4,303,603; 4,303,431; 4,303,730; 4,303,729; and 4,303,061, all incorporated herein by reference. U.S. Pat. No. 3,607,169 (Coxe) and U.S. Pat. No. 4,303,732 (Torobin) disclose an extrusion method in which a gas is blown into molten glass and individual shells are formed. As the shells leave the chamber, they cool and some of the gas is trapped inside. Because the shells cool and drop at the same time, the shells do not form uniformly. It is also difficult to control the amount and composition of gas that remains in the shell. U.S. Pat. No. 4,349,456 (Sowman), incorporated herein by reference, discloses a process for making ceramic metal oxide microspheres by blowing a slurry of ceramic and highly volatile organic fluid through a coaxial nozzle. As the liquid dehydrates, gelled microcapsules are formed. These microcapsules are recovered by filtration, dried, and fired to convert them into microspheres. Prior to firing, the microcapsules are sufficiently porous that, if placed in a vacuum during the firing process, the gases can be removed and the resulting microspheres will generally be impermeable to ambient gases. The shells formed with this method may be filled with a variety of gases and pressurized from near vacuums to above atmosphere. This is a suitable method for producing microspheres. However, shell uniformity may be difficult to control.

U.S. Patent Application Publication 2002/0004111 (Matsubara et al.), incorporated herein by reference discloses a method of preparing hollow glass microspheres by adding a combustible liquid (kerosene) to a material containing a foaming agent. Methods for forming microspheres are also disclosed in U.S. Pat. No. 3,848,248 (MacIntyre), U.S. Pat. No. 3,998,618 (Kreick et al.), and U.S. Pat. No. 4,035,690 (Roeber), discussed above and incorporated herein by reference. Methods of manufacturing hollow microspheres are disclosed in U.S. Pat. No. 3,794,503 (Netting), U.S. Pat. No. 3,796,777 (Netting), U.S. Pat. No. 3,888,957 (Netting), and U.S. Pat. No. 4,340,642 (Netting et al.), all incorporated herein by reference. Other prior art methods for forming microspheres are disclosed in the prior art including U.S. Pat. Nos. U.S. Pat. No. 3,528,809 (Farnand et al.), U.S. Pat. No. 3,957,194 (Farnand et al.), U.S. Pat. No. 4,025,689 (Kobayashi et al.), U.S. Pat. No. 4,211,738 (Genis), U.S. Pat. No. 4,307,051 (Sargeant et al.), U.S. Pat. No. 4,569,821 (Duperray et al.), U.S. Pat. No. 4,775,598 (Jaeckel), and U.S. Pat. No. 4,917,857 (Jaeckel et al.), all of which are incorporated herein by reference. These references disclose a number of methods which comprise an organic core such as naphthalene or a polymeric core such as foamed polystyrene which is coated with an inorganic material such as aluminum oxide, magnesium, refractory, carbon powder, or the like. The core is removed such as by pyrolysis, sublimation, or decomposition and the inorganic coating sintered at an elevated temperature to form a sphere or microsphere. Farnand et al. ('809) discloses the production of hollow metal spheres by coating a core material such as naphthalene or anthracene with metal flakes such as aluminum or magnesium. The organic core is sublimed at room temperature over 24 to 48 hours. The aluminum or magnesium is then heated to an elevated temperature in oxygen to form aluminum or magnesium oxide. The core may also be coated with a metal oxide such as aluminum oxide and reduced to metal. The resulting hollow spheres are used for thermal insulation, plastic filler, and bulking of liquids such as hydrocarbons.

Farnand ('194) discloses a similar process comprising polymers dissolved in naphthalene including polyethylene and polystyrene. The core is sublimed or evaporated to form hollow spheres or microballoons. Kobayashi et al. ('689) discloses the coating of a core of polystyrene with carbon powder. The core is heated and decomposed and the carbon powder heated in argon at 3000° C. to obtain hollow porous graphitized spheres. Genis ('738) discloses the making of lightweight aggregate using a nucleus of expanded polystyrene pellet with outer layers of sand and cement. Sargeant et al. ('051) discloses the making of light weight-refractories by wet spraying core particles of polystyrene with an aqueous refractory coating such as clay with alumina, magnesia, and/or other oxides. The core particles are subject to a tumbling action during the wet spraying and fired at 1730° C. to form porous refractory. Duperray et al. ('821) discloses the making of a porous metal body by suspending metal powder in an organic foam which is heated to pyrolyze the organic and sinter the metal. Jaeckel ('598) and Jaeckel et al. ('857) disclose the coating of a polymer core particle such as foamed polystyrene with metals or inorganic materials followed by pyrolysis on the polymer and sintering of the inorganic materials to form the sphere. Both disclose the formation of metal spheres such as copper or nickel spheres which may be coated with an oxide such as aluminum oxide. Jaeckel et al. ('857) further discloses a fluid bed process to coat the core.

SUMMARY OF INVENTION

This invention relates to the locating of one or more plasma-shells such as a plasma-disc on a substrate and electrically connecting each plasma-shell to at least two electrical conductors such as electrodes. The plasma-shell may be located on the surface of the substrate or within the substrate. In accordance with one embodiment of this invention, insulating bathers are provided to prevent contact between the connecting electrodes. The plasma-shell may be of any suitable geometric shape such as a plasma-sphere, plasma-disc, or plasma-dome for use in a gas discharge plasma display panel (PDP) device. As used herein, plasma-shell includes plasma-sphere, plasma-disc and/or plasma-dome. As disclosed herein, this invention is directed to plasma-discs alone or in combination with other plasma-shells. As used herein, the locating of the plasma-shell on the substrate and/or electrodes includes positioning attaching, mounting, or like contact.

A plasma-sphere is a hollow microsphere or sphere with relatively uniform shell thickness. A PDP microsphere is disclosed in U.S. Pat. No. 6,864,631 (Wedding), incorporated herein by reference. The shell is typically composed of a dielectric material and is filled with an ionizable gas at a desired mixture and pressure. The gas is selected to produce visible, ultraviolet (UV), and/or infrared (IR) photons during gas discharge when a voltage is applied. The shell material is selected to optimize dielectric properties and optical transmissivity. Additional beneficial materials may be added to the inner or outer surface of the sphere shell including luminescent and/or secondary electron emission materials. Luminescent substances and secondary electron emission materials may be added to the shell. The luminescent substances may be any suitable inorganic and/or organic substances that emit photons when excited by photons from the gas discharge. The organic and/or inorganic luminescent substances, secondary electron emission materials, and/or other materials may be added directly to the shell material or composition during or after shell formation.

A plasma-disc is the same as a plasma-sphere in material composition and the ionizable gas selection. It differs from the plasma-sphere in that it is flat on two opposing sides such as the top and bottom. As used herein, a flat side is defined as a side having a flat surface. The other sides or ends of the plasma-disc may be round or flat. The plasma-disc may have other flat sides in addition to the opposing flat sides. The plasma-disc does not have to be round or circular. It may have any geometric shape with opposing flat sides. Some of these geometric shapes are illustrated and discussed herein.

A plasma-dome is the same as a plasma-sphere and plasma-disc in material composition and the ionizable gas selection. It differs in that one side is rounded or domed and the opposing side is flat.

BRIEF DESCRIPTION OF THE DRAWINGS

FIGS. 23A to 34A show plasma-discs of various geometric shapes.

FIGS. 23B to 34B are section A-A views of FIGS. 23A to 35A.

DETAILED DESCRIPTION OF DRAWINGS AND EMBODIMENTS OF INVENTION

In accordance with this invention, at least two conductors or electrodes are electrically connected to a plasma-disc located on a substrate. In one embodiment, the electrodes are connected to the plasma-disc by means of an electrically conductive bonding substance applied to each plasma-disc and/or to the electrode and/or to both the plasma-disc and the electrode. In another embodiment, each electrically conductive connection to each plasma-disc is separated from each other electrically conductive connection to the plasma-disc by an insulating barrier to prevent electrical shorting between connections. This also prevents the conductive bonding substance from freely flowing and forming one electrical connection, and/or shorting out other electrical connections.

DETAILED DESCRIPTION OF THE DRAWINGS

Figure 1B:
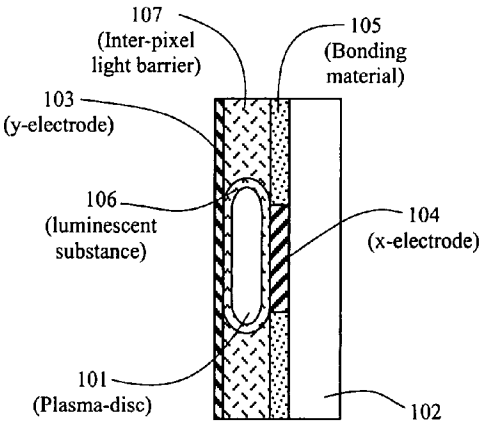
FIG. 1B is a Section View B-B of FIG. 1.
Figure 1C:
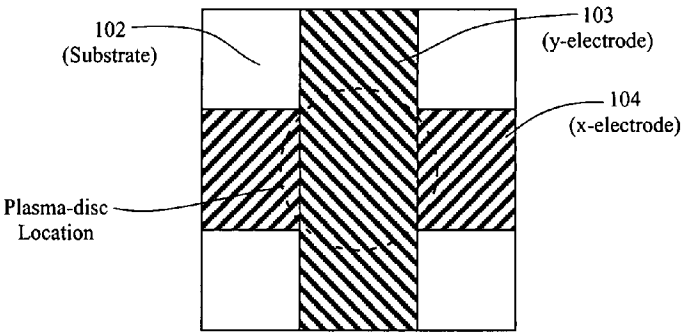
FIG. 1C is a top view of the FIG. 1 substrate showing the x-electrode and y-electrode configuration with the plasma-disc location shown with broken lines.
Figure 1:
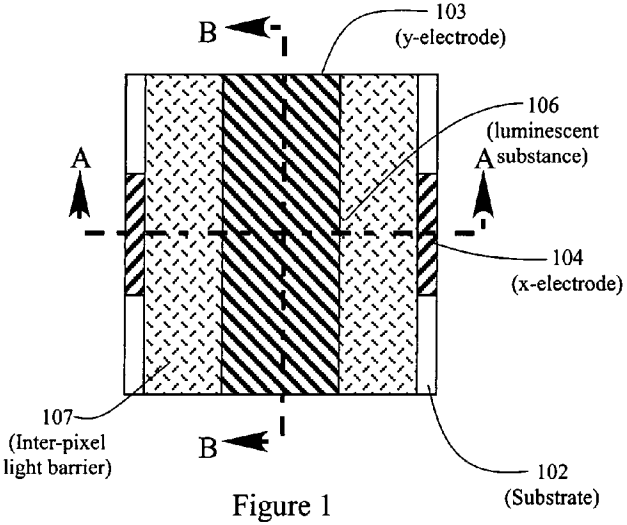
FIG. 1 is a top view of a plasma-disc located on a substrate with x-electrode and y-electrode.

FIG. 1 shows substrate 102 with transparent y-electrode 103, luminescent substance 106, x-electrode 104, and inter-pixel light barrier 107. The y-electrode 103 and x-electrode 104 are crosshatched for identification purposes. The y-electrode 103 is transparent because it is shown covering much of the plasma-disc 101 not shown in FIG. 1.

Figure 1A:
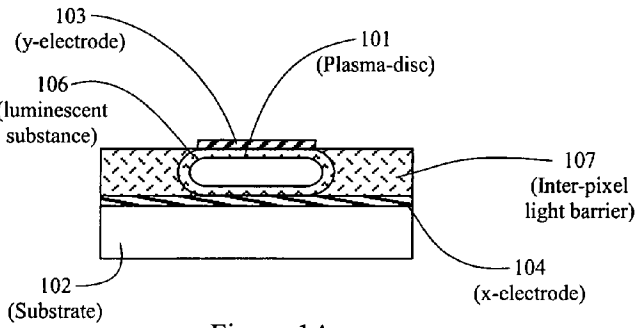
FIG. 1A is a Section View A-A of FIG. 1.

FIG. 1A is a Section View A-A of FIG. 1 and FIG. 1B is a Section View B-B of FIG. 1, each Section View showing the plasma-disc 101 located on the bottom x-electrode 104 which is attached to the surface of substrate 102 with top y-electrode 103 covering the top of the plasma-disc 101, and inter-pixel light barrier 107 surrounding the plasma-disc 101. The plasma-disc 101 is attached to the bottom x-electrode 104 with bonding material 105. Luminescent substance 106 is located on the top surface of plasma-disc 101. In one embodiment, the plasma-disc 101 is partially or completely coated with the luminescent substance 106.

As illustrated in FIGS. 1A and 1B plasma-disc 101 is sandwiched between a y-electrode 103 and x-electrode 104. Inter-pixel light barrier 107 is of substantially the same thickness or height as plasma-disc 101. The light barrier may extend and bridge between adjacent pixels. This allows the transparent y-electrode 103, to be applied to a substantially flat surface. The light barrier 107 is made of an opaque or non-transparent material to prevent optical cross-talk between adjacent plasma-discs.

The plasma-disc 101 is attached to the substrate 102 with bonding material 105. As practiced in this invention, bonding material 105 is liberally applied to the entire substrate 102 before the plasma-disc 101 is attached. Bonding material 105 may coat some or all of the x-electrode 104. Bonding material 105 provides a dielectric interface between the electrode and the plasma-disc 101.

The bonding material 105 can be of any suitable adhesive substance. In one embodiment hereof, there is used a so-called Z-Axis electrically conductive tape such as manufactured by 3M.

FIG. 1C shows the electrodes 103 and 104 on the substrate 102 with the location of the plasma-disc 101 (not shown) indicated with broken lines.

Figure 2B:
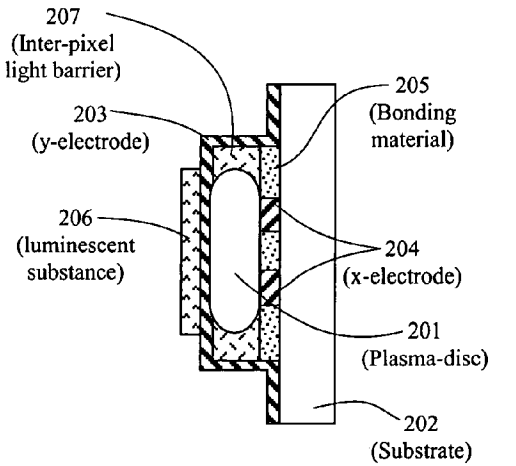
FIG. 2B is a Section View B-B of FIG. 2.
Figure 2C:
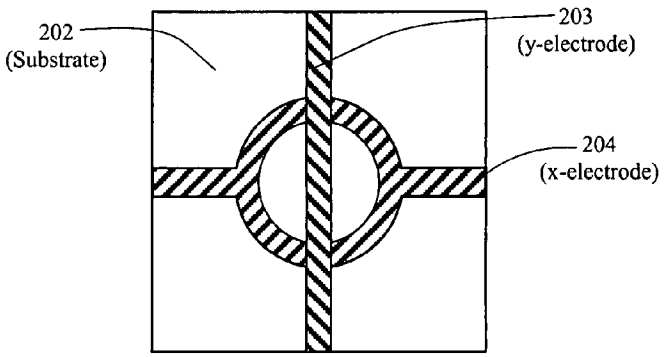
FIG. 2C is a top view of the FIG. 2 substrate showing the x-electrode and y-electrode in a ring and cross configuration without the plasma-disc shown.
Figure 2:
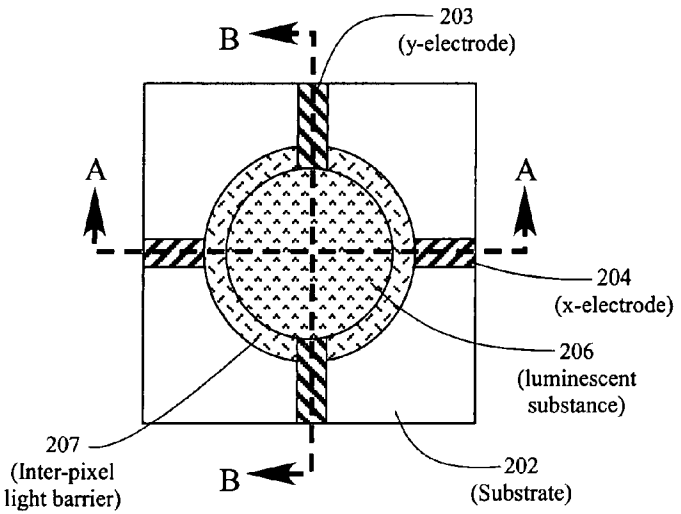
FIG. 2 is a top view of a plasma-disc located on a substrate with x-electrode and y-electrode.

FIG. 2 shows substrate 202 with y-electrode 203, luminescent substance 206, x-electrode 204, and inter-pixel light barrier 207. The y-electrode 203 and x-electrode 204 are crosshatched for identification purposes. The y-electrode 203 may be transparent or not depending upon its width and obscurity of the plasma-disc 201 not shown in FIG. 2. In this embodiment, the inter-pixel light barrier 207 does not extend and form a bridge between adjacent pixels.

Figure 2A:
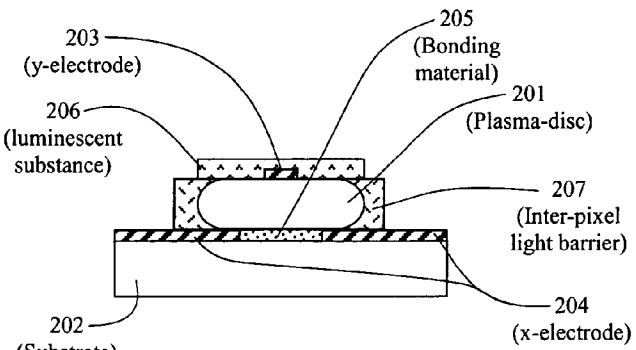
FIG. 2A is a Section View A-A of FIG. 2.

FIG. 2A is a Section View A-A of FIG. 2 and FIG. 2B is a Section View B-B of FIG. 2, each Section View showing the plasma-disc 201 located on the bottom x-electrode 204 which is attached to the surface of substrate 202 with top y-electrode 203 and inter-pixel light barrier 207. The plasma-disc 201 is attached to the substrate 202 with bonding material 205. The luminescent substance 206 is located on the top surface of the plasma-disc 201.

FIG. 2C shows the y-electrode 203 and x-electrode 204 on the substrate 202, the x-electrode 204 being in a ring and cross configuration where the plasma-disc 201 (not shown) is to be positioned.

In this FIG. 2 embodiment the discharge between the x- and y-electrodes will first occur at the intersection of electrodes 203 and 204 and spread around the donut shape of 204. This spreading of the discharge from a small gap to a wide gap increases efficiency. Other electrode configurations are also contemplated.

Figure 3B:
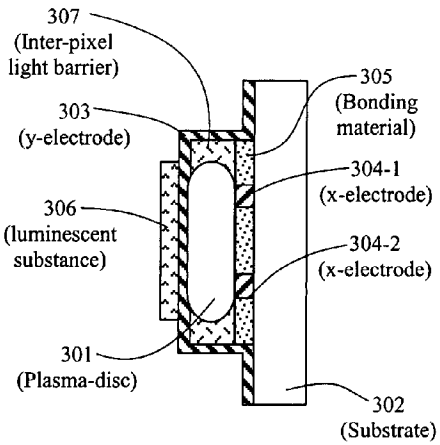
FIG. 3B is a Section View B-B of FIG. 3.
Figure 3C:
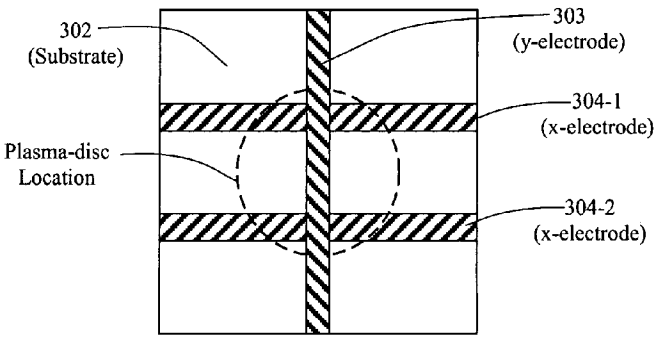
FIG. 3C is a top view of the FIG. 3 substrate showing the two x-electrodes and y-electrode configuration with the plasma-disc location shown with broken lines.
Figure 3:
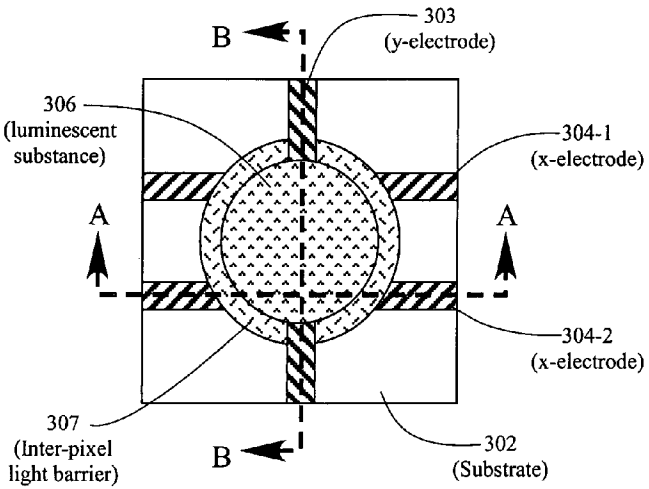
FIG. 3 is a top view of a plasma-disc located on a substrate with two x-electrodes and one y-electrode.

FIGS. 3, 3A, 3B, and 3C are several views of a three-electrode configuration and embodiment employing positive column discharge. FIG. 3 shows substrate 302 with top y-electrode 303, dual bottom x-electrodes 304-1, 304-2, luminescent substance 306, and inter-pixel light barrier 307. The y-electrode 303 and x-electrodes 304-1, 304-2 are cross-hatched for identification purposes.

Figure 3A:
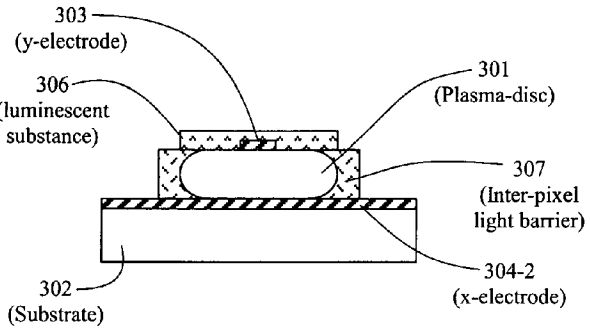
FIG. 3A is a Section View of A-A of FIG. 3.

FIG. 3A is a Section View A-A of FIG. 3 and FIG. 3B is a Section View B-B of FIG. 3, each Section View showing the plasma-disc 301 located on the surface of the substrate 302 with top y-electrode 303 and dual bottom x-electrodes 304-1 and 304-2, inter-pixel light barrier material 307, and luminescent substance 306. The plasma-disc 301 is attached to the substrate 302 with bonding material 305. The luminescent substance 306 is on top of the plasma-disc 301 and y-electrode 303.

FIG. 3C shows the electrodes 303, 304-1, and 304-2 on the substrate 302 with the location of the plasma-disc 301 (not shown) indicated with broken lines.

This embodiment is similar to the FIG. 2 embodiment except that the donut shaped x-electrode 204 is replaced with two independent x-electrodes 304-1 and 304-2. After a discharge is initiated at the intersection of electrode 303 and 304-1 or 304-2, it is maintained by a longer positive column discharge between 304-1 and 304-2.

FIGS. 4, 4A, 4B, and 4C are several views of a three-electrode configuration and embodiment in which the plasma-disc 401 is embedded in a trench or groove 408.

Figure 4B:
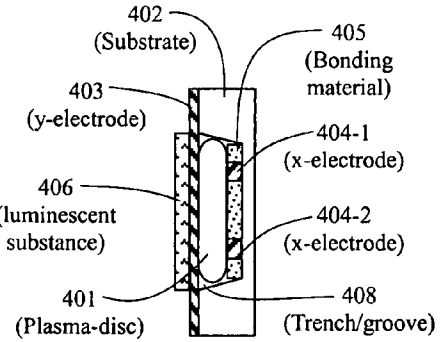
FIG. 4B is a Section View of B-B of FIG. 4.
Figure 4C:
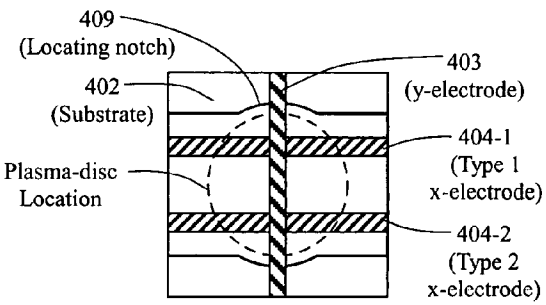
FIG. 4C is a top view of the substrate and electrodes in FIG. 4 with the plasma-disc location shown in broken lines.
Figure 4:
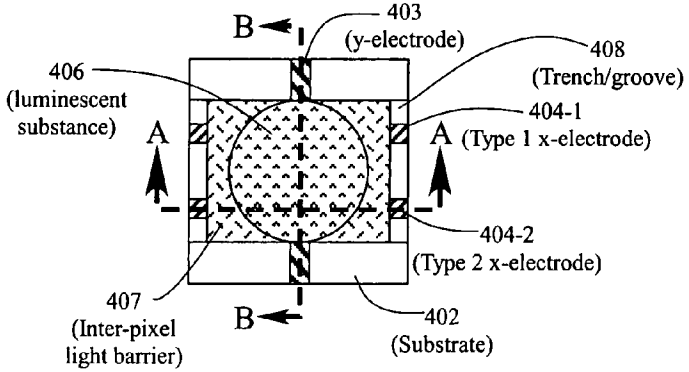
FIG. 4 is a top view of a plasma-disc located on a substrate with two x-electrodes and one y-electrode.

FIG. 4 shows substrate 402 with top y-electrode 403, dual bottom x-electrodes 404-1, 404-2, luminescent substance 406, inter-pixel light barrier 407 and trench or groove 408. The y-electrode 403 and x-electrodes 404-1, 404-2 are cross-hatched for identification purposes.

Figure 4A:
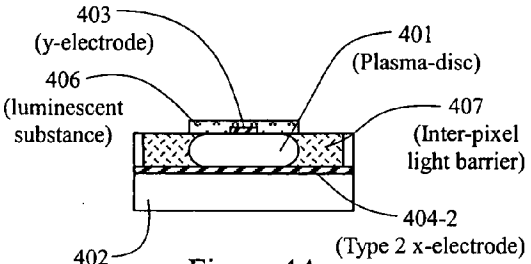
FIG. 4A is a Section View A-A of FIG. 4.

FIG. 4A is a Section View A-A of FIG. 4 and FIG. 4B is a Section View B-B of FIG. 4, each Section View showing the plasma-disc 401 located in the trench or groove 408 on the surface of the substrate 402 with top y-electrode 403 and dual bottom x-electrodes 404-1 and 404-2, inter-pixel light barrier material 407, and luminescent substance 406. The plasma-disc 401 is positioned within the trench or groove 408 and attached to the substrate 402 with bonding material 405.

FIG. 4C shows the electrodes 403, 404-1, and 404-2 on the substrate 402 with the location of the plasma-disc 401 (not shown) indicated with broken lines.

This FIG. 4 embodiment is a three-electrode structure with similar characteristics to the FIG. 2 embodiment. However x-electrodes 404-1 and 404-2 extend down the middle of trench 408 formed in substrate 402. The plasma-disc 401 is attached with bonding material to the inside of the trench. Optional light barrier material 407 may be applied around the plasma-disc. Y-electrode 403 is applied across the top of the substrate and optional luminescent substance 406 may be applied over the top of the plasma-disc. FIG. 4C shows optional locating notch 409 to help position the disc.

Figure 5B:
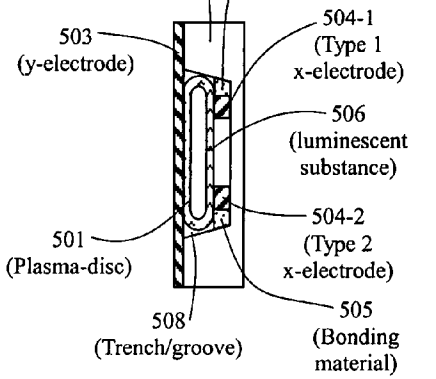
FIG. 5B is a Section View of B-B of FIG. 5.
Figure 5C:
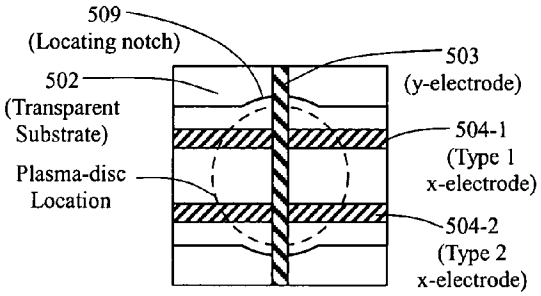
FIG. 5C is a top view of the substrate and electrodes in FIG. 5 with the plasma-disc location shown in broken lines.
Figure 5:
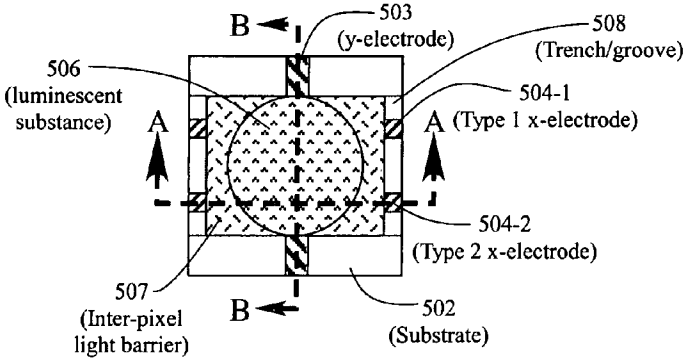
FIG. 5 is a top view of a plasma-disc located on a substrate with two x-electrodes and one y-electrode.

FIGS. 5, 5A, 5B, and 5C are several views of a three-electrode configuration and embodiment in which the plasma-disc 501 is embedded in a trench or groove 508. FIG. 5 shows transparent substrate 502 with top y-electrode 503, dual bottom x-electrodes 504-1, 504-2, luminescent substance 506, inter-pixel light barrier 507, and trench or groove 508. The y-electrode 503 and x-electrodes 504-1, 504-2 are crosshatched for identification purposes.

Figure 5A:
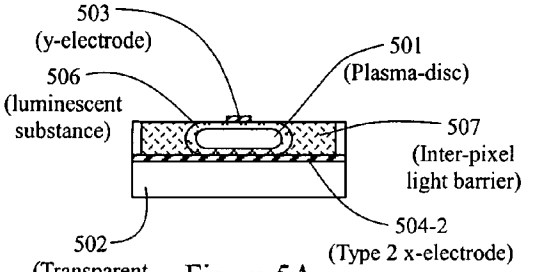
FIG. 5A is a Section View A-A of FIG. 5.

FIG. 5A is a Section View A-A of FIG. 5 and FIG. 5B is a Section View B-B of FIG. 5, each Section View showing the plasma-disc 501 located in the trench or groove 508 on the surface of the substrate 502 with top y-electrode 503 and dual bottom x-electrodes 504-1 and 504-2, inter-pixel light barrier 507, and luminescent substance 506. The plasma-disc 501 is bonded within the trench or groove 508 and attached to the substrate 502 with bonding material 505. As shown in FIG. 5B, the luminescent substance 506 covers the surface of the plasma-disc 501.

FIG. 5C shows the electrodes 503, 504-1, and 504-2 on the substrate 502 with the location of the plasma-disc 501 (not shown) indicated with broken lines. A locating notch 509 is shown. FIGS. 6, 6A, 6B, and 6C are several views of a three-electrode configuration and embodiment in which the plasma-disc 601 is embedded in a trench or groove 608.

Figure 6B:
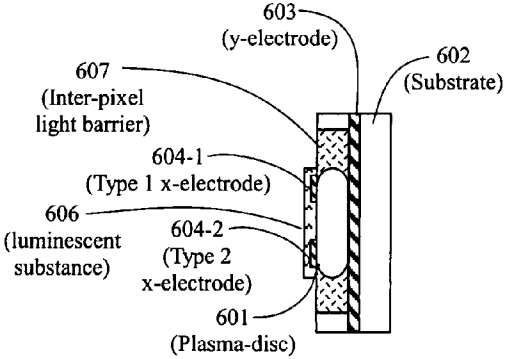
FIG. 6B is a Section View of B-B of FIG. 6.
Figure 6C:
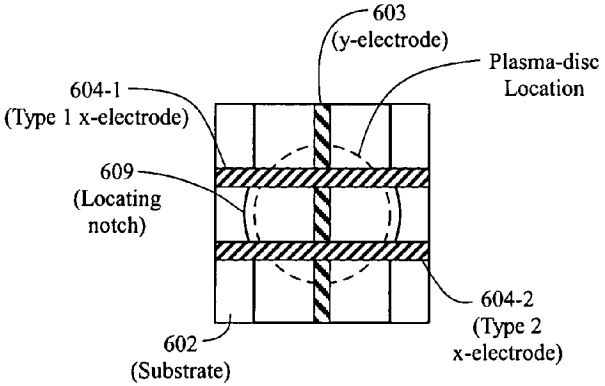
FIG. 6C is a top view of the substrate and electrodes in FIG. 6 with the plasma-disc location shown in broken lines.
Figure 6:
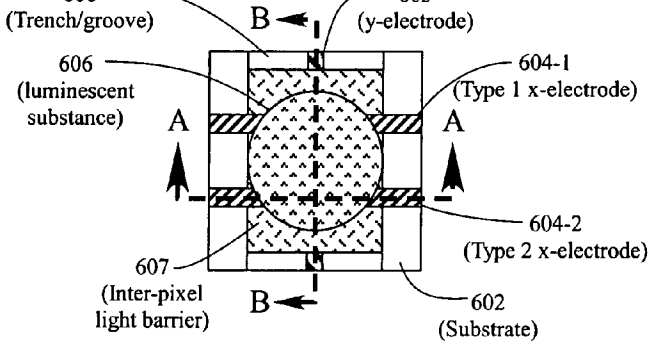
FIG. 6 is a top view of a plasma-disc located on a substrate with two x-electrodes and one y-electrode.

FIG. 6 shows substrate 602 with dual top x-electrodes 604-1, 604-2, bottom y-electrode 603, luminescent substance 606, inter-pixel light barrier 607, and trench or groove 608. The x-electrodes 604-1, 604-2 and bottom y-electrodes 603 are crosshatched for identification purposes.

Figure 6A:
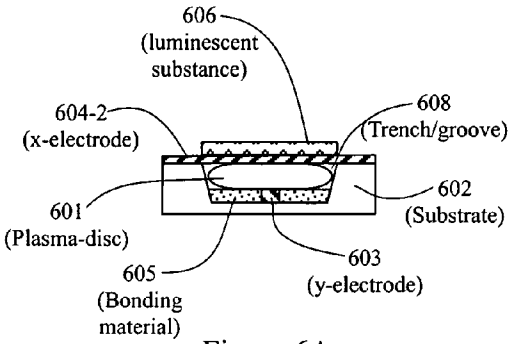
FIG. 6A is a Section View A-A of FIG. 6.

FIG. 6A is a Section View A-A of FIG. 6 and FIG. 6B is a Section View B-B of FIG. 6, each Section View showing the plasma-disc 601 located within trench or groove 608 on the surface of the substrate 602 with bottom y-electrode 603 and dual top x-electrodes 604-1 and 604-2, inter-pixel light barrier 607, and luminescent substance 606. The plasma-disc 601 is within the trench or groove 608 and attached to the substrate 602 with bonding material 605.

FIG. 6C shows the electrodes 603, 604-1, and 604-2 on the substrate 602 with the location of the plasma-disc 601 (not shown) indicated with broken lines. A plasma-disc locating notch 609 is shown.

The FIG. 6 embodiment differs from the FIG. 4 embodiment in that a single y-electrode 603 extends through the parallel center of the trench 608 and x-electrodes 604-1 and 604-2 are perpendicular or orthogonal to the trench and run along the top surface.

Figure 7:
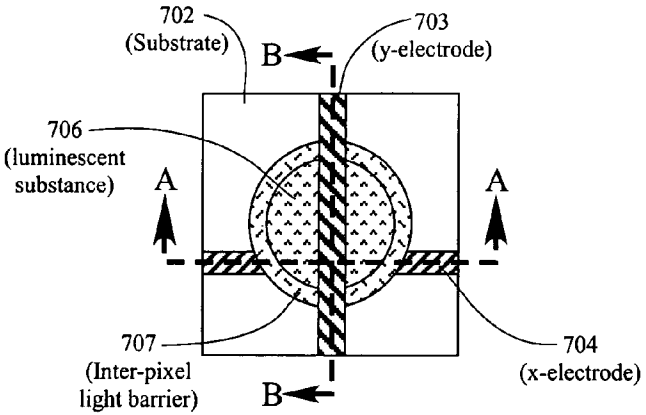
FIG. 7 is a top view of a plasma-disc located on a substrate with one x-electrode and one y-electrode.

FIGS. 7, 7A, 7B, and 7C are several views of a two-electrode embodiment with a two-electrode configuration and pattern that employs positive column discharge. FIG. 7 shows substrate 702 with top y-electrode 703, bottom x-electrodes 704, luminescent substance 706, and inter-pixel light barrier 707. The y-electrode 703 and x-electrode 704 are crosshatched for identification purposes.

Figure 7B:
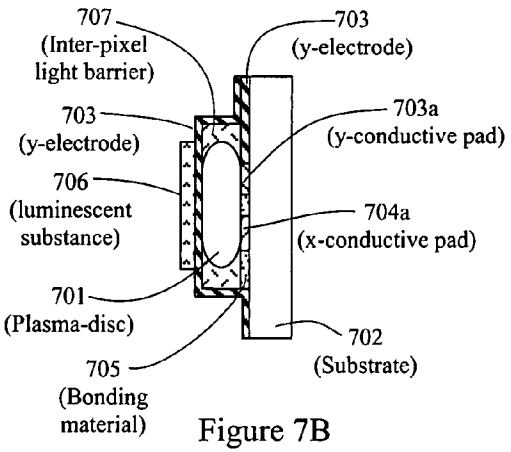
FIG. 7B is a Section View of B-B of FIG. 7.
Figure 7C:
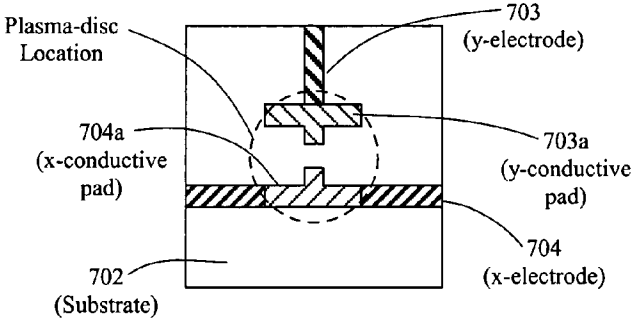
FIG. 7C is a top view of the substrate, electrodes of FIG. 7, and conductive pads, each conductive pad in a T configuration with the plasma-disc location shown in broken lines.
Figure 7A:
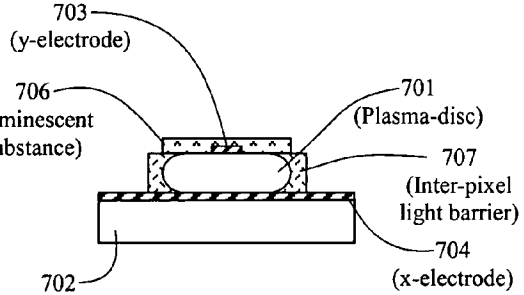
FIG. 7A is a Section View A-A of FIG. 7.

FIG. 7A is a Section View A-A of FIG. 7 and FIG. 7B is a Section View B-B of FIG. 7, each Section View showing the plasma-disc 701 located on the surface of substrate 702 with top y-electrode 703 and bottom x-electrode 704, inter-pixel light barrier 707, and luminescent substance 706. The plasma-disc 701 is attached to the substrate 702 with bonding material 705. There is also shown in FIG. 7B y-electrode or conductive pad 703*a* and x-electrode or conductive pad 704*a*.

FIG. 7C shows the electrodes 703 and 704 on the substrate 702 with the location of the plasma-disc 701 (not shown) indicated with broken lines. There is also shown y-conductive pad 703*a* and x-conductive pad 704*a* in a T shape for contact with plasma-disc 701.

As in FIG. 2, FIG. 7 shows a two-electrode configuration and embodiment, which employs positive column discharge. The top y-electrode 703 is applied over the plasma-disc 701 and light barrier 707. Additionally, the electrode 703 runs under plasma-disc 701 and forms a T shaped conductive pad 703*a*. In this configuration, the discharge is initiated at the closest point between the two electrodes 703*a* and 704*a* under the plasma-disc and spread to the wider gap electrode regions, including electrode 703, which runs over the top of the plasma-disc. It will be obvious to one skilled in the art that there are conductive pad shapes and configurations other than the T configuration that perform essentially the same function.

Figure 8:
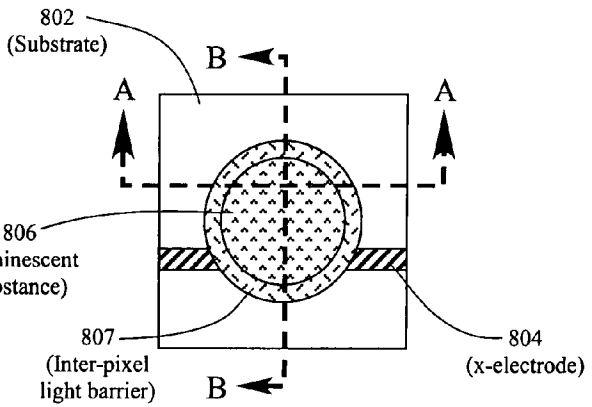
FIG. 8 is a top view of a plasma-disc located on a substrate with one x-electrode.

FIGS. 8, 8A, 8B, and 8C are several views of a two-electrode configuration and embodiment in which neither the x- nor the y-electrode runs over the plasma-disc 801. FIG. 8 shows substrate 802 with x-electrode 804, luminescent substance 806, and inter-pixel light barrier 807. The x-electrode 804 is crosshatched for identification purposes.

Figure 8B:
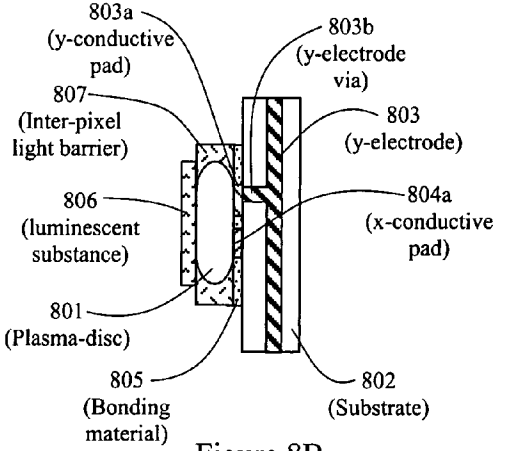
FIG. 8B is a Section View of B-B of FIG. 8.
Figure 8C:
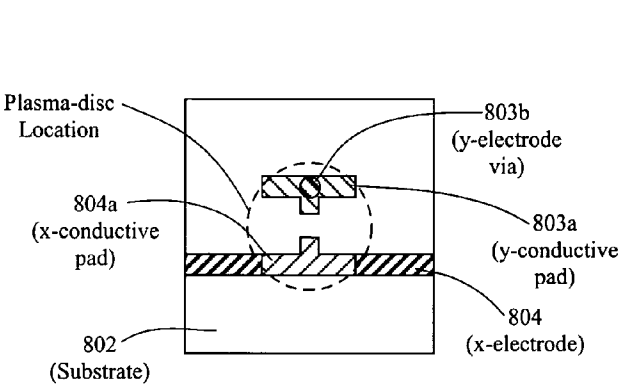
FIG. 8C is a top view of the substrate, electrodes of FIG. 8, and conductive pads, each conductive pad in a T configuration with the plasma-disc location shown in broken lines.
Figure 8A:
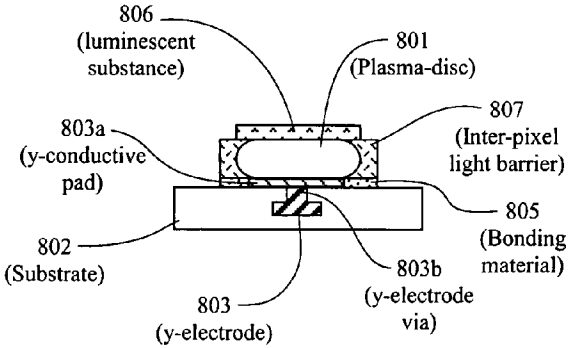
FIG. 8A is a Section View A-A of FIG. 8.

FIG. 8A is a Section View A-A of FIG. 8 and FIG. 8B is a Section View B-B of FIG. 8, each Section View showing the plasma-disc 801 located on the surface of substrate 802 with bottom y-electrode 803, top x-conductive pad 804*a*, inter-pixel light barrier 807, and a top layer of luminescent substance 806. The plasma-disc 801 is attached to the substrate 802 with bonding material 805. Also shown is y-conductive pad 803*a* and y-electrode via 803*b* forming a connection to y-electrode 803. The pads 803*a* and 804*a* are in contact with the plasma-disc 801.

FIG. 8C shows x-electrode 804 with pad 804*a* and y-conductive pad 803*a* in a T configuration with y-electrode via 803*b* on the substrate 802 with the location of the plasma-disc 801 indicated with broken lines.

In this configuration x-electrode 804 extends along the surface of substrate 802 and y-electrode 803 extends along an inner layer of substrate 802. The y-electrode 803 is orthogonal to x-electrode 804. Contact with plasma-disc 801 is made with T shaped conductive pads 804*a* and 803*a*. The T shaped conductive pad is beneficial to promote positive column discharge. Conductive pad 803*a* is connected to electrode 803 by via 803*b*. Although y-electrode 803 is shown internal to substrate 802, it may also extend along the exterior surface of 802, opposite to the side that the plasma-disc is located.

FIGS. 9, 9A, 9B and 9C are several views of an alternative two-electrode configuration and embodiment in which neither x-electrode nor y-electrode extends over the plasma-disc 901.

Figure 9B:
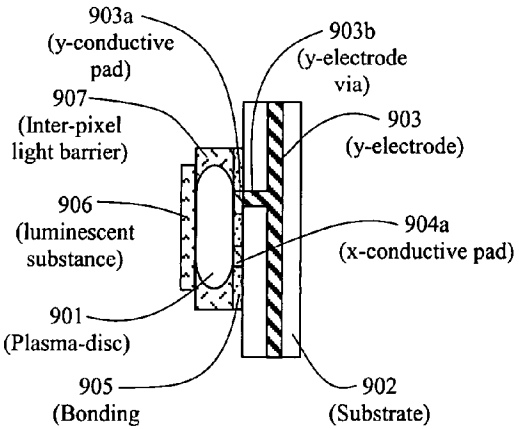
FIG. 9B is a Section View of B-B of FIG. 9.
Figure 9C:
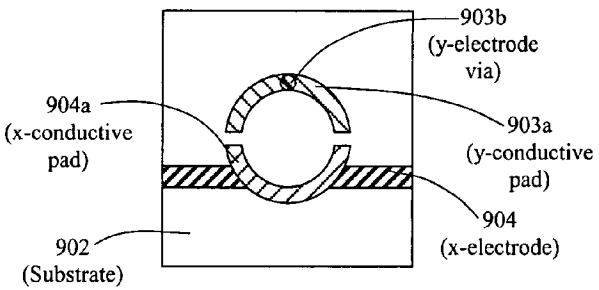
FIG. 9C is a top view of the substrate, electrodes in FIG. 9, and arc shaped conductive pads without the plasma-disc.
Figure 9:
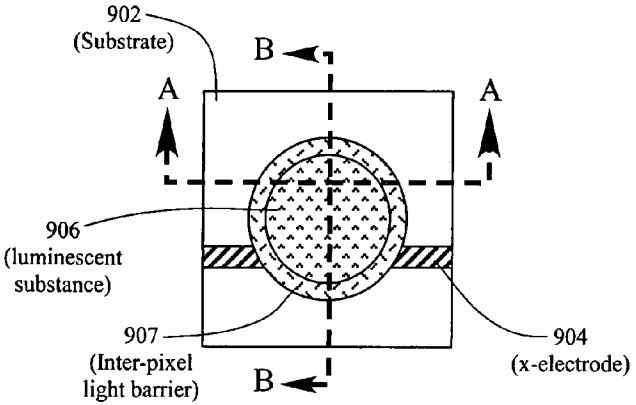
FIG. 9 is a top view of a plasma-disc located on a substrate with one x-electrode.

FIG. 9 shows substrate 902 with x-electrode 904, luminescent substance 906, and inter-pixel light barrier 907. The x-electrode 904 is crosshatched for identification purposes.

Figure 9A:
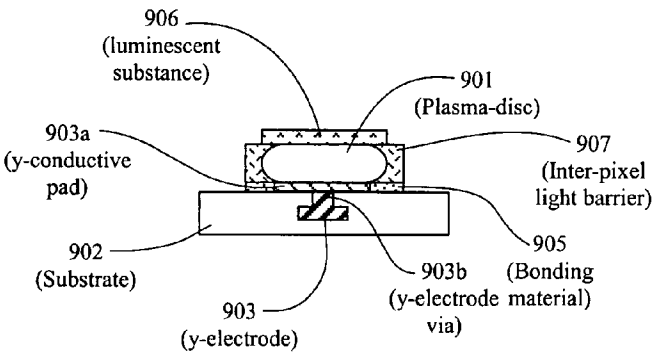
FIG. 9A is a Section View A-A of FIG. 9.

FIG. 9A is a Section View A-A of FIG. 9 and FIG. 9B is a Section View B-B of FIG. 9, each Section View showing the plasma-disc 901 located on the surface of substrate 902 with bottom y-electrode 903 and bottom x-conductive pad 904*a*, inter-pixel light barrier 907, and luminescent substance 906. The plasma-disc 901 is attached to the substrate 902 with bonding material 905. Also shown is y-conductive pad 903*a* and y-electrode via 903*b* connected to y-electrode 903. Also shown is x-conductive pad 904*a*. The pads 903*a* and 904*a* are in contact with the plasma-disc 901.

FIG. 9C shows x-electrode 904 with x-conductive pad 904*a* and y-conductive pad 903*a* with y-electrode via 903*b* on the substrate 902 with conductive pads 903*a*, 904*a* forming an arc configuration for contact with the plasma-disc 901 (not shown in FIG. 9C) to be positioned on the substrate 902.

Figure 10B:
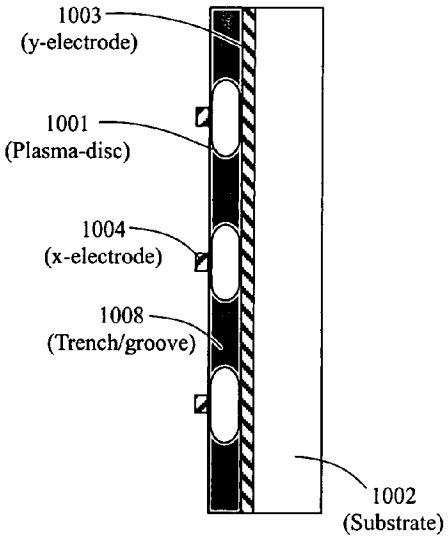
FIG. 10B is a Section View of B-B of FIG. 10.
Figure 10:
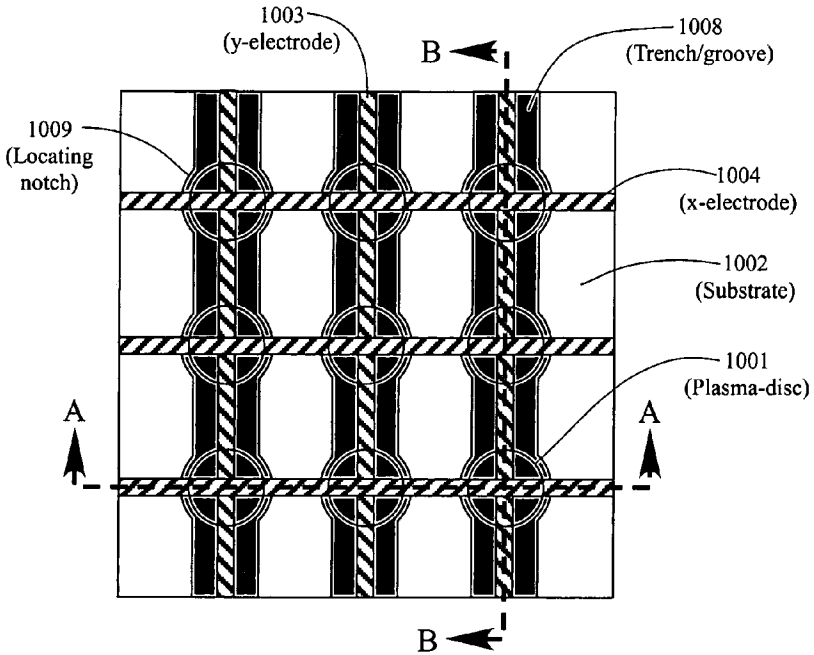
FIG. 10 is a top view of a substrate with multiple x-electrodes, multiple y-electrodes, and trenches or grooves for receiving plasma-discs.

FIG. 10 shows substrate 1002 with y-electrodes 1003 positioned in trenches or grooves 1008, x-electrodes 1004, and plasma-disc locating notches 1009. The plasma-discs 1001 are located within the trenches or grooves 1008 at the positions of the locating notches 1009 as shown. The y-electrodes 1003 and x-electrodes 1004 are crosshatched for identification purposes.

Figure 10A:
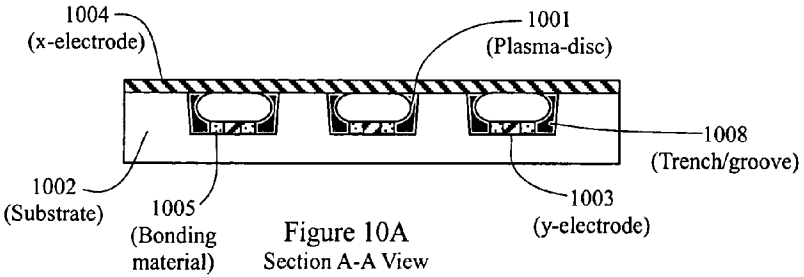
FIG. 10A is a Section View A-A of FIG. 10.

FIG. 10A is a Section View A-A of FIG. 10 and FIG. 10B is a Section View B-B of FIG. 10, each Section View showing each plasma-disc 1001 located within a trench or groove 1008 and attached to the substrate 1002 with bonding material 1005. Each plasma-disc 1001 is in contact with a top x-electrode 1004 and a bottom y-electrode 1003. Luminescent substance is not shown, but may be provided near or on each plasma-disc 1001. Inter-pixel light barriers are not shown, but may be provided.

Figure 11B:
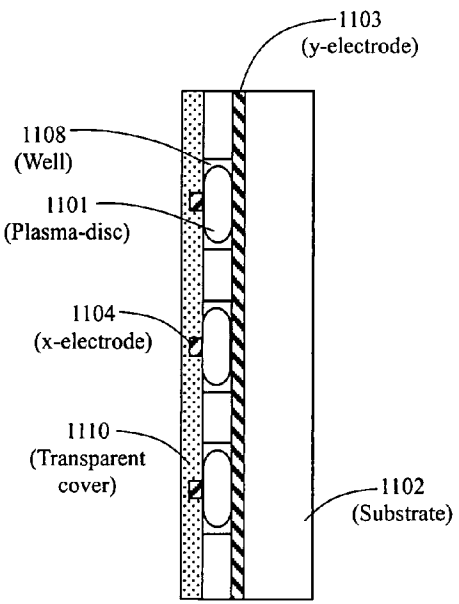
FIG. 11B is a Section View of B-B of FIG. 11.
Figure 11:
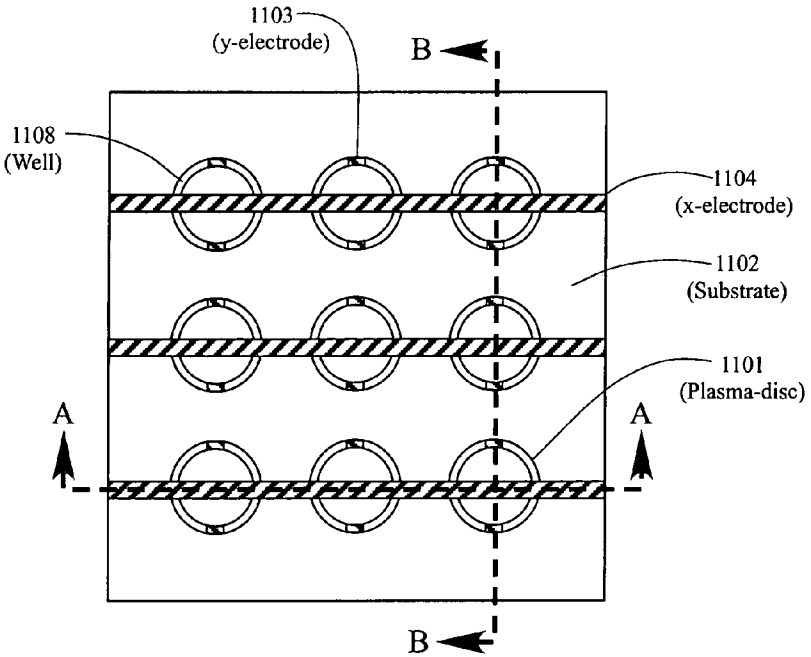
FIG. 11 is a top view of a substrate with multiple x-electrodes, multiple y-electrodes, and multiple wells or cavities for receiving plasma-discs.

FIG. 11 shows substrate 1102 with y-electrodes 1103, x-electrodes 1104, and plasma-disc wells 1108. The plasma-discs 1101 are located within wells 1108 as shown. The y-electrodes 1103 and x-electrodes 1104 are crosshatched for identification purposes.

Figure 11A:
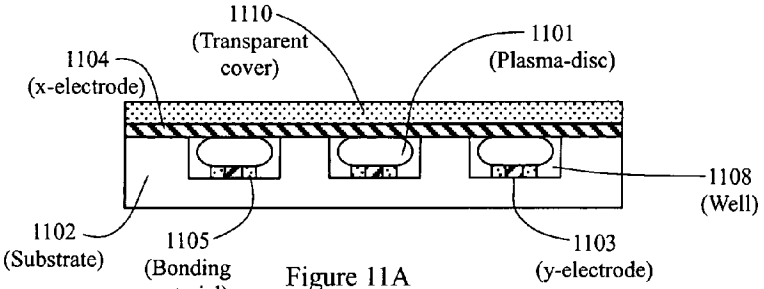
FIG. 11A is a Section View A-A of FIG. 11.

FIG. 11A is a Section View A-A of FIG. 11 and FIG. 11B is a Section View B-B of FIG. 11, each Section View showing each plasma-disc 1101 located within a well 1108 to substrate 1102 with bonding material 1105. Each plasma-disc 1101 is in contact with a top x-electrode 1104 and a bottom y-electrode 1103. Luminescent substance is not shown, but may be provided near or on each plasma-disc. Inter-pixel light barriers are not shown, but may be provided. The x-electrodes 1104 are positioned under a transparent cover 1110 and may be integrated into the cover.

FIGS. 12, 12A, 12B, and 12C are several views of an alternate two-electrode configuration or embodiment in which neither the x-electrode nor the y-electrode extends over the plasma-disc 1201.

Figure 12B:
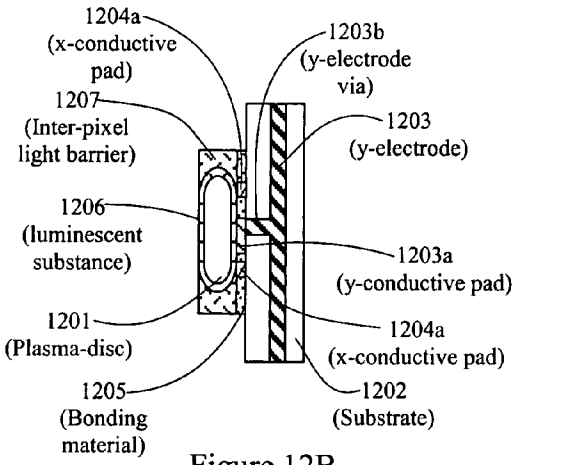
FIG. 12B is a Section View of B-B of FIG. 12.
Figure 12C:
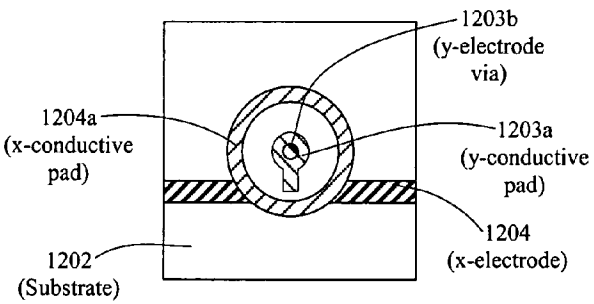
FIG. 12C is a top view of the substrate, electrodes of FIG. 12, and conductive pads being shown in a keyhole and ring configuration, without the plasma-disc.
Figure 12:
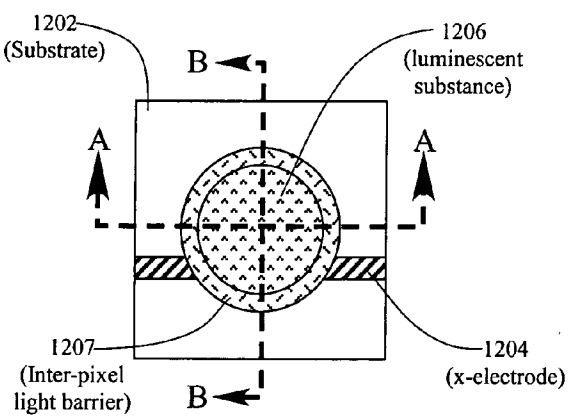
FIG. 12 is a top view of a plasma-disc located on a substrate with one x-electrode.

FIG. 12 shows substrate 1202 with x-electrode 1204, luminescent substance 1206, and inter-pixel light barrier 1207. The x-electrode 1204 is crosshatched for identification purposes.

Figure 12A:
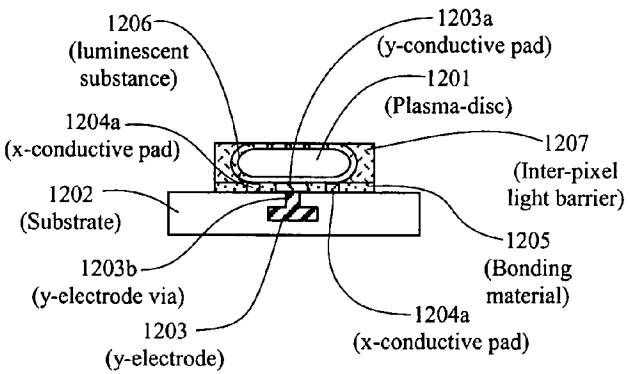
FIG. 12A is a Section View A-A of FIG. 12.

FIG. 12A is a Section View A-A of FIG. 12 and FIG. 12B is a Section View B-B of FIG. 12, each Section View showing the plasma-disc 1201 located on the surface of substrate 1202 with bottom y-electrode 1203 and bottom x-conductive pad 1204*a*, inter-pixel light barrier 1207, and luminescent substance 1206. The plasma-disc 1201 is bonded to the substrate 1202 with bonding material 1205. Also shown is y-conductive pad 1203*a* and via 1203*b* connected to y-electrode 1203. The pads 1203*a* and 1204*a* are in contact with the plasma-disc 1201.

FIG. 12C shows x-electrode 1204 with x-conductive pad 1204*a* and y-conductive pad 1203*a* with y-electrode via 1203*b* on the surface 1202. The x-conductive pad 1204*a* forms a ring configuration for contact with the plasma-disc 1201 (not shown) to be positioned on the substrate 1202. The y-conductive pad 1203*a* is shown as a keyhole configuration within the ring configuration and centered within x-conductive pad 1204*a*.

FIGS. 13, 13A, 13B, and 13C are several views of an alternate two-electrode configuration and embodiment in which neither the x-electrode nor the y-electrode extends over the plasma-disc 1301. These figures illustrate charge or capacitive coupling.

Figure 13B:
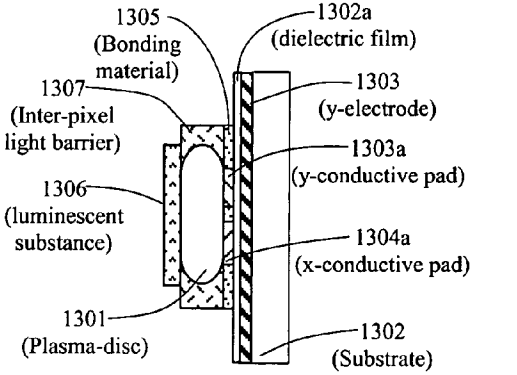
FIG. 13B is a Section View of B-B of FIG. 13.
Figure 13C:
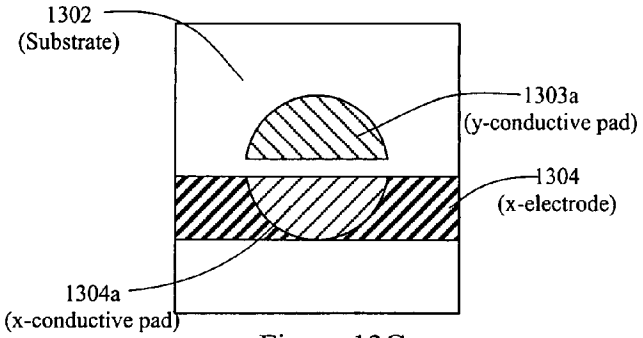
FIG. 13C is a top view of the substrate, electrodes in FIG. 13, and conductive pads in a half moon configuration, without the plasma-disc.
Figure 13:
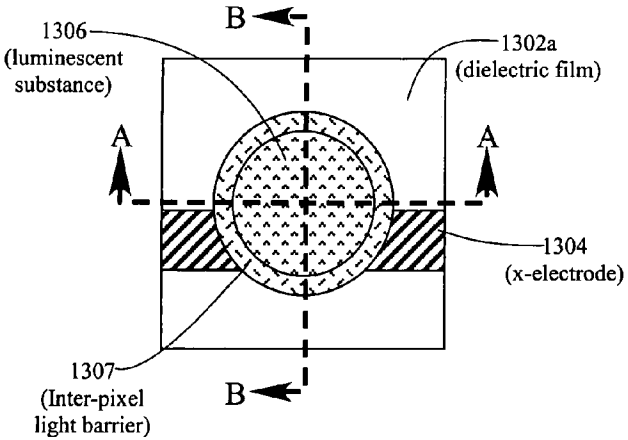
FIG. 13 is a top view of a plasma-disc located on a substrate with one x-electrode.

FIG. 13 shows dielectric film or layer 1302*a* on top surface of substrate 1302 (not shown) with x-electrode 1304, luminescent substance 1306, and inter-pixel light barrier 1307. The x-electrode 1304 is crosshatched for identification purposes.

Figure 13A:
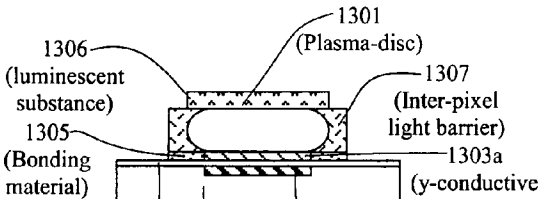
FIG. 13A is a Section View A-A of FIG. 13.

FIG. 13A is a Section View A-A of FIG. 13 and FIG. 13B is a Section View B-B of FIG. 13, each Section View showing the plasma-disc 1301 located on the dielectric film or layer 1302*a* with y-electrode 1303 and x-conductive pad 1304*a*, inter-pixel light barrier 1307, and luminescent substance 1306. The plasma-disc 1301 is bonded to the dielectric film 1302*a* with bonding material 1305. Also is substrate 1302 and y-conductive pad 1303*a*, which is capacitively coupled through dielectric film 1302*a* to the y-electrode 1303.

FIG. 13C shows the x-electrode 1304, half moon shaped x-conductive pad 1304*a*, and half moon shaped y-conductive pad 1303*a* on the substrate 1302 with the location of the plasma-disc 1301 (not shown) indicated by the semi-circular pads 1303*a* and 1304*a*.

In this configuration and embodiment, x-electrode 1304 is on the top of the substrate 1302 and y-electrode 1303 is embedded in substrate 1302. Also in this embodiment, substrate 1302 is formed from a material with a dielectric constant sufficient to allow charge coupling from 1303 to 1303*a*. Also to promote good capacitive coupling, pad 1303*a* is large and the gap between 1303*a* and 1303 is small. Conductive pads 1303*a* and 1304*a* may be selected from a reflective metal such as copper or silver or coated with a reflective material. This will help direct light out of the plasma-disc and increase efficiency. Reflective conductive pads may be used in any configuration in which the electrodes are attached to the plasma-disc from the back of the substrate. The larger the area of the conductive pad, the greater the advantage achieved by reflection.

FIGS. 14, 14A, 14B, and 14C are several views of an alternate two-electrode configuration and embodiment.

Figure 14B:
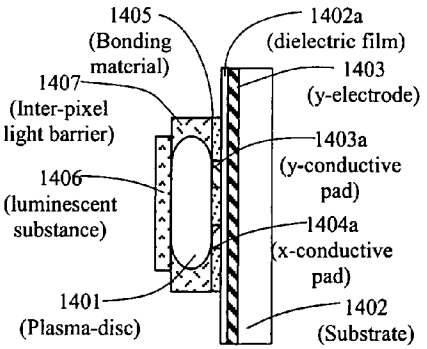
FIG. 14B is a Section View of B-B of FIG. 14.
Figure 14C:
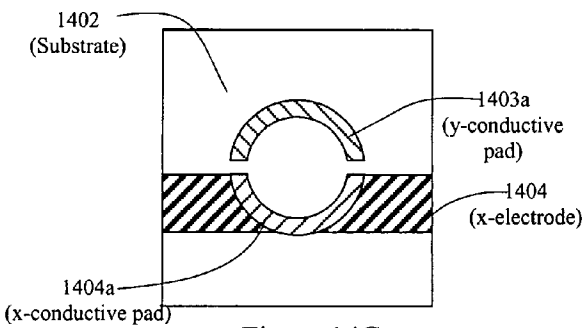
FIG. 14C is a top view of the substrate, electrodes in FIG. 14, and arc shaped conductive pads, without the plasma-disc.
Figure 14:
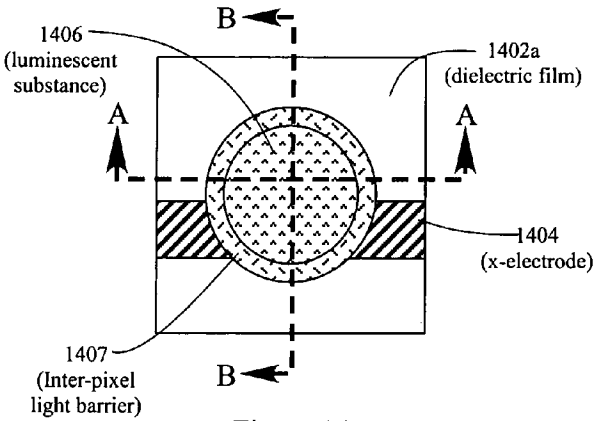
FIG. 14 is a top view of a plasma-disc located on a substrate with one x-electrode.

FIG. 14 shows dielectric film or layer 1402*a* on the top surface of substrate 1402 (not shown) with x-electrode 1404, luminescent substance 1406, and inter-pixel light barrier 1407. The x-electrode 1404 is crosshatched for identification purposes.

Figure 14A:
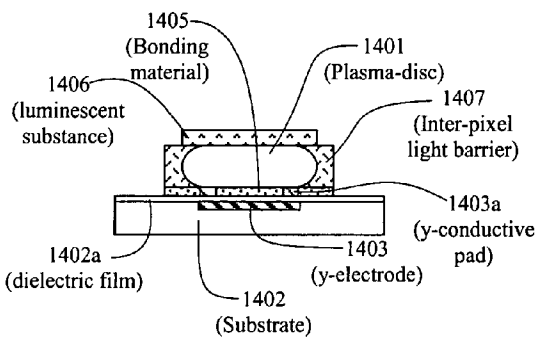
FIG. 14A is a Section View A-A of FIG. 14.

FIG. 14A is a Section View A-A of FIG. 14 and FIG. 14B is a Section View B-B of FIG. 14, each Section View showing the plasma-disc 1401 located on the surface of dielectric film 1402*a* with bottom y-electrode 1403, bottom x-conductive pad 1404*a*, inter-pixel light barrier 1407, and luminescent substance 1406. The plasma-disc 1401 is bonded to the dielectric film 1402*a* with bonding material 1405. Also shown are substrate 1402 and y-conductive pad 1403*a*, which is capacitively coupled through the dielectric film 1402*a* to the y-electrode 1403.

FIG. 14C shows x-electrode 1404 and conductive pads 1403*a* and 1404*a* on the substrate 1402. The conductive pads 1403*a* and 1404*a* form an arc configuration for contact with the plasma-disc 1401 (not shown in FIG. 14C).

FIG. 14 differs from FIG. 13 in the shape of the conductive pads. This can be seen in FIG. 14C. Y-conductive pad 1403*a* is shaped like a C and x-conductive pad 1404 is also formed as a C shape. This configuration promotes a positive column discharge.

FIGS. 15, 15A, 15B, and 15C are several views of an alternate two-electrode configuration and embodiment. These figures illustrate charge or capacitive coupling.

Figure 15B:
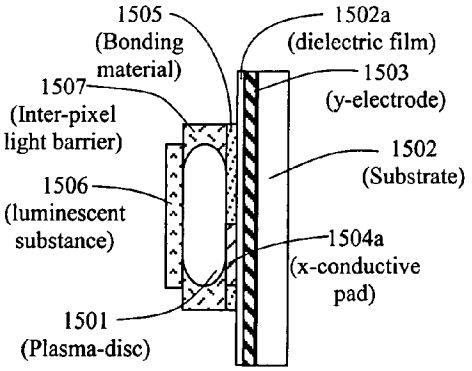
FIG. 15B is a Section View of B-B of FIG. 15.
Figure 15C:
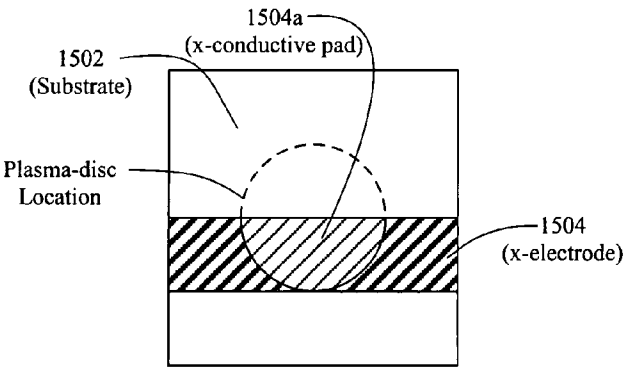
FIG. 15C is a top view of the substrate, electrode in FIG. 15, and conductive pad in a half moon configuration, with the plasma-disc location shown in broken lines.
Figure 15:
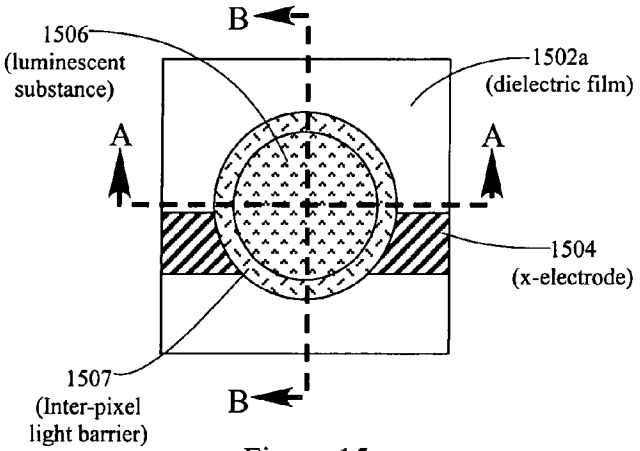
FIG. 15 is a top view of a plasma-disc located on a substrate with one x-electrode.

FIG. 15 shows dielectric film or layer 1502*a* on the surface of substrate 1502 (not shown) with bottom x-electrode 1504, luminescent substance 1506 and inter-pixel light barrier 1507. The x-electrode 1504 is crosshatched for identification purposes.

Figure 15A:
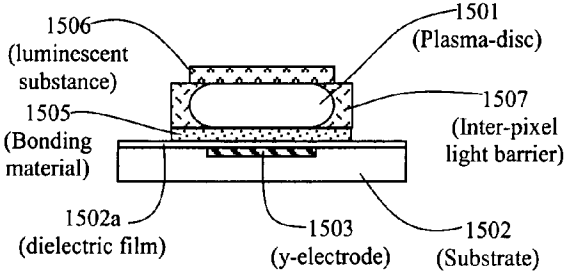
FIG. 15A is a Section View A-A of FIG. 15.

FIG. 15A is a Section View A-A of FIG. 15 and FIG. 15B is a Section View B-B of FIG. 15, each Section View showing the plasma-disc 1501 located on the surface of dielectric film 1502*a* with bottom y-electrode 1503 and bottom x-electrode 1504, inter-pixel light barrier 1507, and luminescent substance 1506. The plasma-disc 1501 is bonded to the dielectric film 1502*a* with bonding material 1505. The plasma-disc 1501 is capacitively coupled through dielectric film 1502*a* and bonding material 1505 to y-electrode 1503. Also shown is substrate 1502.

FIG. 15C shows the x-electrode 1504 with half moon shaped x-conductive pad 1504*a* on the substrate 1502 with the location of the plasma-disc 1501 (not shown) indicated with broken lines.

FIGS. 16, 16A, 16B, and 16C are several views of an alternate two-electrode configuration and embodiment.

Figure 16B:
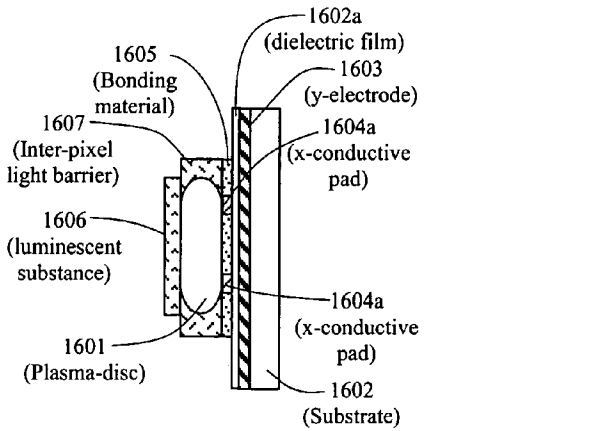
FIG. 16B is a Section View of B-B of FIG. 16.
Figure 16C:
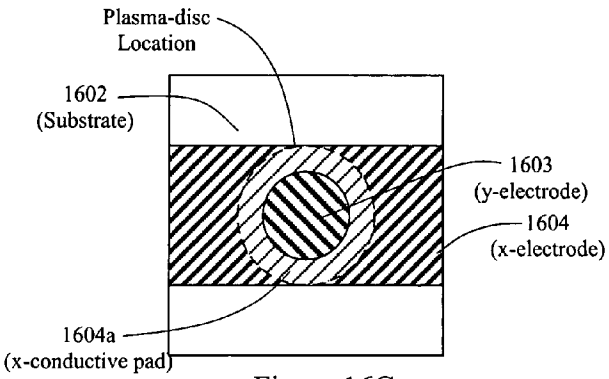
FIG. 16C is a top view of the substrate, electrodes in FIG. 16, and conductive pads in a bulls-eye configuration, with the plasma-disc location shown in broken lines.
Figure 16:
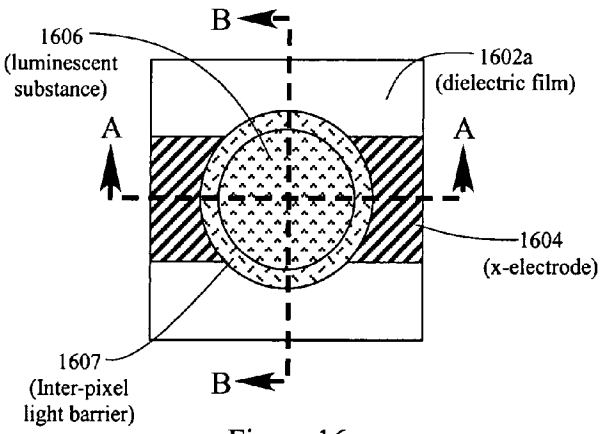
FIG. 16 is a top view of a plasma-disc located on a substrate with one x-electrode.

FIG. 16 shows dielectric film or layer 1602*a* on substrate 1602 (not shown) with bottom x-electrode 1604, luminescent substance 1606, and inter-pixel light barrier 1607. The x-electrode 1604 is crosshatched for identification purposes.

Figure 16A:
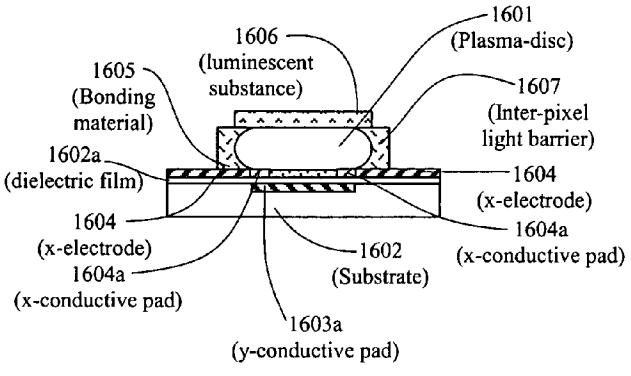
FIG. 16A is a Section View A-A of FIG. 16.

FIG. 16A is a Section View A-A of FIG. 16 and FIG. 16B is a Section View B-B of FIG. 16, each Section View showing the plasma-disc 1601 located on the surface of dielectric film 1602*a* with bottom y-electrode 1603 and bottom x-conductive pad 1604*a*, inter-pixel light barrier 1607, and luminescent substance 1606. The plasma-disc 1601 is bonded to the dielectric film 1602*a* with bonding material 1605.

FIG. 16C shows the x-electrode 1604 with x-conductive pad 1604*a* and y-electrode 1603 in a bulls-eye configuration on the substrate 1602 with the location of the plasma-disc 1601 (not shown) indicated with broken lines.

FIG. 16 differs from FIG. 15 in the shape of the x- and y-electrodes. This can be seen in FIG. 16C. The x-electrode 1604 is extended along the top surface of substrate 1602. A spherical hole is cut in x-electrode 1604 to allow capacitive coupling of y-electrode 1603 to the plasma-disc. The y-electrode 1603 is orthogonal to x-electrode 1604.

FIGS. 17, 17A, 17B, and 17C are several views of an alternate two-electrode configuration and embodiment.

Figure 17B:
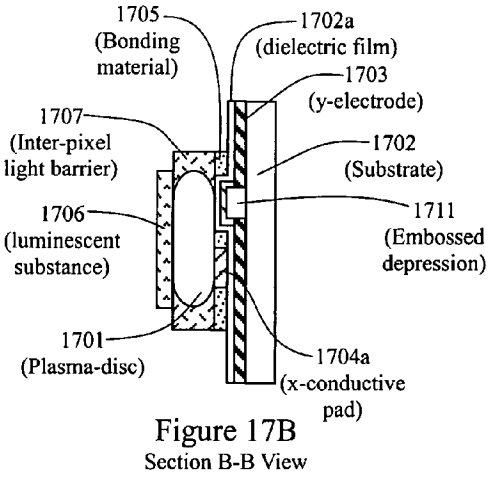
FIG. 17B is a Section View of B-B of FIG. 17.
Figure 17C:
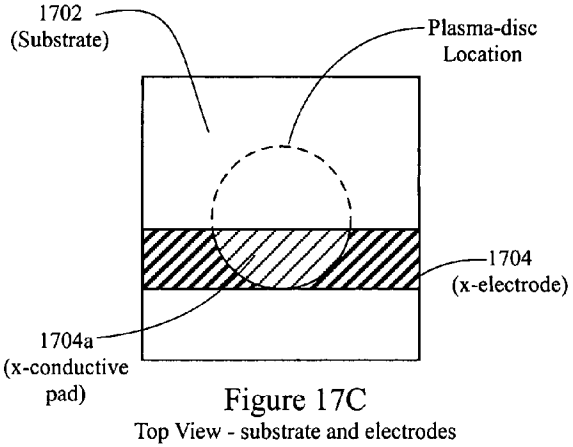
FIG. 17C is a top view of the substrate, electrode in FIG. 17, and conductive pad in a half moon configuration, with the plasma-disc location shown in broken lines.
Figure 17:
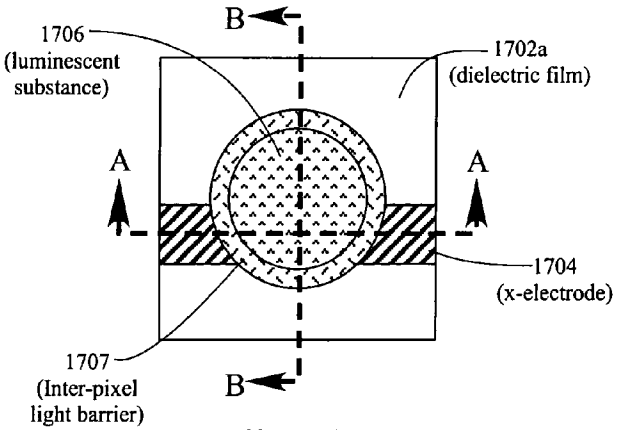
FIG. 17 is a top view of a plasma-disc located on a substrate with one x-electrode.

FIG. 17 shows dielectric film or layer 1702*a* on substrate 1702*a* on substrate 1702 (not shown) with bottom x-electrode 1704, luminescent substance 1706, and inter-pixel light barrier 1707. The x-electrode 1704 is crosshatched for identification purposes.

Figure 17A:
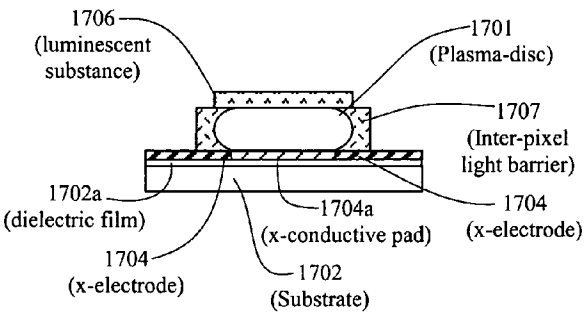
FIG. 17A is a Section View A-A of FIG. 17.

FIG. 17A is a Section View A-A of FIG. 17 and FIG. 17B is a Section View B-B of FIG. 17, each Section View showing the plasma-disc 1701 located on the surface of dielectric film or layer 1702*a* with bottom y-electrode 1703, bottom x-electrode 1704 and x-conductive pad 1704*a*, inter-pixel light barrier 1707, and luminescent substance 1706. The plasma-disc 1701 is bonded to the dielectric layer 1702*a* with bonding material 1705.

FIG. 17C shows the electrode 1704 with half moon shaped conductive pad 1704*a* on the substrate 1702 with the location of the plasma-disc 1701 (not shown) indicated with broken lines. FIG. 17 serves to illustrate that the y-electrode 1703 may be applied to the top of substrate 1702 as shown in FIG. 17B. Dielectric layer or film 1702*a* is applied over the substrate and the y-electrode. The x-electrode 1704 is applied over the dielectric layer to make direct contact with plasma-disc 1701. In this embodiment substrate 1702 contains embossed depression 1711 to bring y-electrode 1703 closer to the surface of the plasma-disc and in essentially the same plane as x-conductive pad 1704*a*.

Figure 18B:
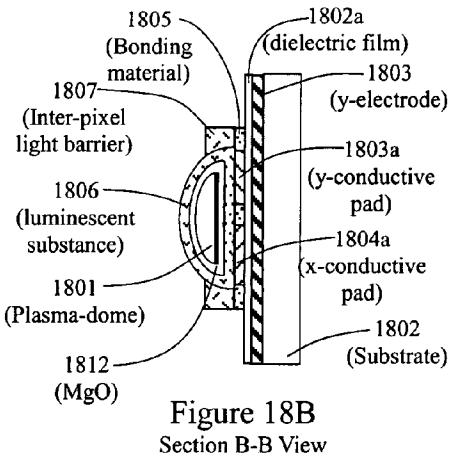
FIG. 18B is a Section View of B-B of FIG. 18.
Figure 18C:
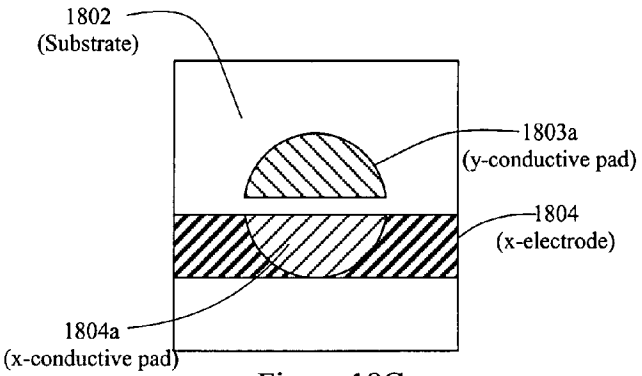
FIG. 18C is a top view of the substrate, electrode in FIG. 17, and conductive pads in a half moon configuration, with the without the plasma-dome.
Figure 18:
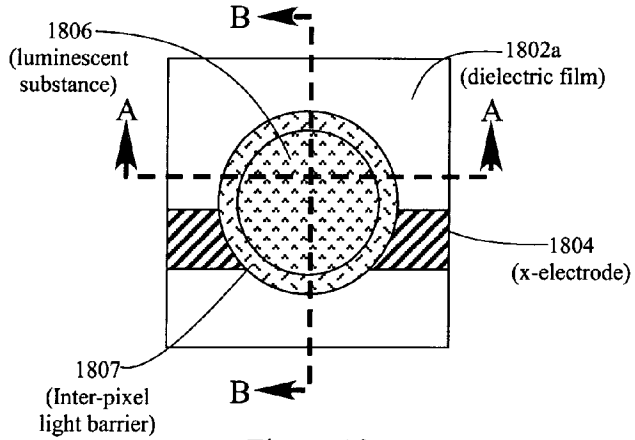
FIG. 18 is a top view of a plasma-dome located on a substrate with one x-electrode.

FIG. 18 shows dielectric film or layer 1802*a* substrate 1802 (not shown) with bottom x-electrode 1804, luminescent substance 1806, and inter-pixel light barrier 1807. The x-electrode 1804 is crosshatched for identification purposes.

Figure 18A:
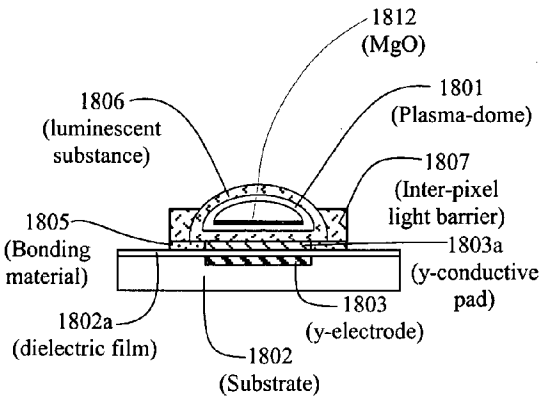
FIG. 18A is a Section View A-A of FIG. 18.

FIG. 18A is a Section View A-A of FIG. 18 and FIG. 18B is a Section View B-B of FIG. 18, each Section View showing a plasma-dome 1801 located on the surface of dielectric 1802*a* with connecting bottom y-electrode 1803, inter-pixel light barrier 1807, and luminescent substance 1806. The plasma-dome 1801 is bonded to the substrate 1802*a* with bonding material 1805. Also shown are substrate 1802, y-conductive pad 1803*a* and x-conductive pad 1804*a*. Magnesium oxide 1812 is shown on the inside of the plasma-dome 1801.

FIG. 18C shows the electrode 1804 with half moon shaped x-conductive pad 1804*a* and half moon shaped y-conductive pad 1803*a* on the substrate 1802 with the location of the plasma-dome 1801 (not shown) by semi-circular pads 1804*a* and 1803*a*.

Figure 19:
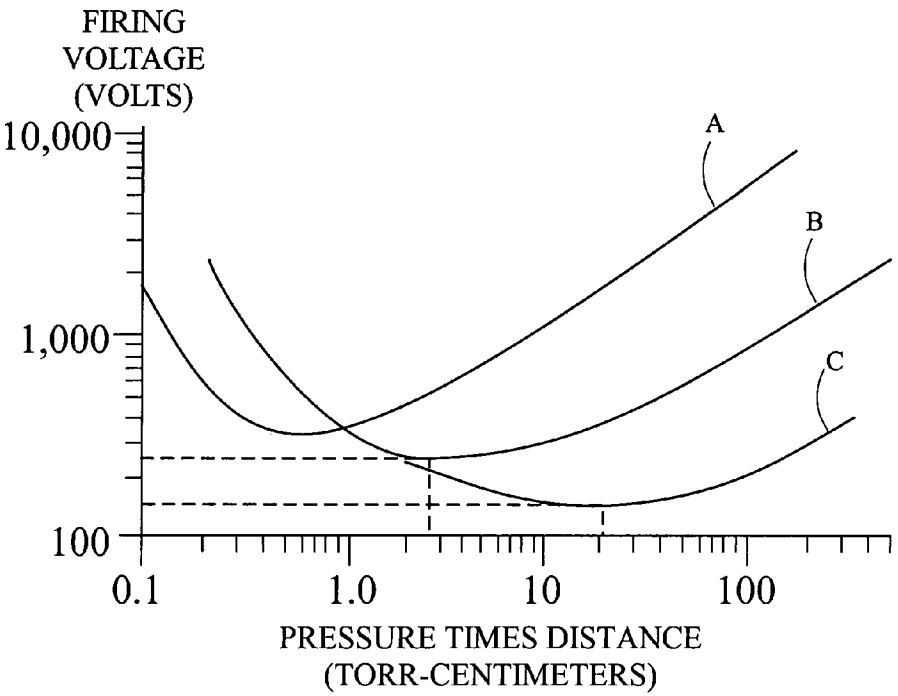
FIG. 19 shows hypothetical Paschen curves for three typical hypothetical gases.

FIG. 19 shows a Paschen curve. The plasma-disc is filled with an ionizable gas. Each gas composition or mixture has a unique curve associated with it, called the Paschen curve as illustrated in FIG. 19. The Paschen curve is a graph of the breakdown voltage versus the product of the pressure times the discharge distance. It is usually given in Torr-centimeters. As can be seen from the illustration in FIG. 19, the gases typically have a saddle region in which the voltage is at a minimum. It is desirable to choose pressure and gas discharge distance in the saddle region to minimize the voltage.

In one embodiment of this invention, the inside of the plasma-disc contains a secondary electron emitter. Secondary electron emitters lower the breakdown voltage of the gas and provide a more efficient discharge. Plasma displays traditionally use magnesium oxide for this purpose, although other materials may be used including other Group IIA oxides, rare earth oxides, lead oxides, aluminum oxides, and other materials. Also non-oxides may be used such as rare earth borides. Mixtures of secondary electron emitters may be used. It may also be beneficial to add luminescent substances such as phosphor to the inside or outside of the plasma-disc.

In one embodiment and mode hereof, the plasma-disc material is a metal or metalloid oxide with an ionizable gas of 99.99% atoms of neon and 0.01% atoms of argon or xenon for use in a monochrome PDP. Examples of shell materials include glass, silica, aluminum oxides, zirconium oxides, and magnesium oxides.

In another embodiment, the plasma-disc contains luminescent substances such as phosphors selected to provide different visible colors including red, blue, and green for use in a full color PDP. The metal or metalloid oxides are typically selected to be transmissive to photons produced by the gas discharge especially in the UV range.

In one embodiment, the ionizable gas is selected from any of several known combinations that produce UV light including pure helium, helium with up to 1% atoms neon, helium with up to 1% atoms of argon and up to 15% atoms nitrogen, and neon with up to 15% atoms of xenon or argon. For a color PDP, red, blue, and/or green light-emitting luminescent substance may be applied to the interior or exterior of the plasma-disc. The luminescent substance may be incorporated into the shell of the plasma-disc. The application of luminescent substance to the exterior of the plasma-disc may comprise a slurry or tumbling process with heat curing, typically at low temperatures. Infrared curing can also be used. The luminescent substance may be applied by other methods or processes such as spraying, brushing, ink jet, dipping, spin coating and so forth. Thick film methods such as screen-printing may be used. Thin film methods such as sputtering and vapor phase deposition may be used. The luminescent substance may be applied externally before or after the plasma-disc is attached to the PDP substrate. The internal or external surface of the plasma-disc may be partially or completely coated with luminescent substance. In one embodiment the external surface is completely coated with luminescent substance. As discussed hereinafter, the luminescent substance may be organic and/or inorganic.

The bottom or back of the plasma-disc may be coated with a suitable light reflective material in order to reflect more light toward the top or front viewing direction of the plasma-disc. The light reflective material may be applied by any suitable process such as spraying, brushing, ink jet, dipping, spin coating, and so forth. Thick film methods such as screen-printing may be used. Thin film methods such as sputtering and vapor phase deposition may be used. The light reflective material may be applied over the luminescent substance or the luminescent substance may be applied over the light reflective material. In one embodiment, the electrodes are made of or coated with a light reflective material such that the electrodes also may function as a light reflector.

Plasma-Dome

Figure 20B:
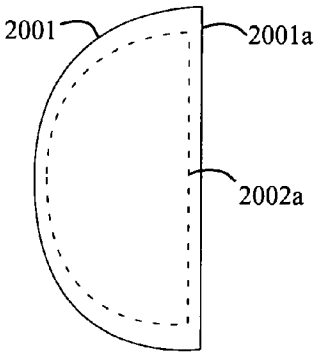
FIG. 20B is a sectional A-A view of FIG. 20.
Figure 20A:
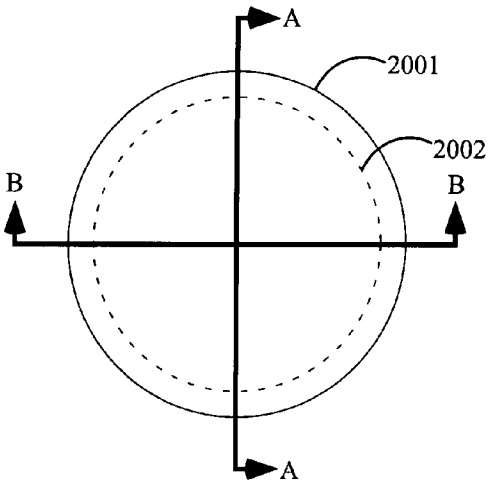
FIG. 20A is a top view of a plasma-dome with one flat side.
Figure 20C:
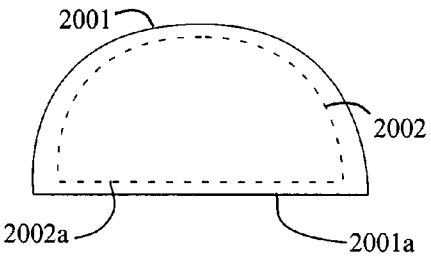
FIG. 20C is a sectional B-B view of FIG. 20.

A plasma-dome is shown in FIGS. 20A, 20B, and 20C. FIG. 20A is a top view of a plasma-dome showing an outer shell wall 2001 and an inner shell wall 2002. FIG. 20B is a section A-A view of FIG. 20A showing a flattened outer wall 2001*a* and flattened inner wall 2002*a*. FIG. 20C is a section B-B view of FIG. 20A.

Figure 21B:
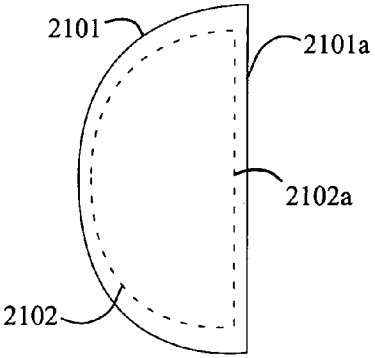
FIG. 21B is a sectional A-A view of FIG. 21
Figure 21A:
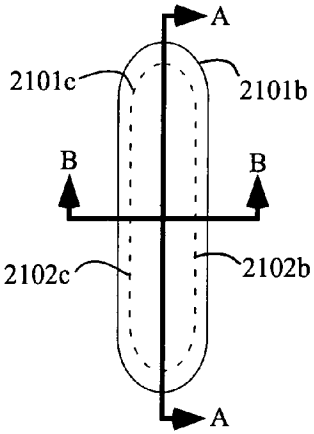
FIG. 21A is a top view of a plasma-dome with multiple flat sides.
Figure 21C:
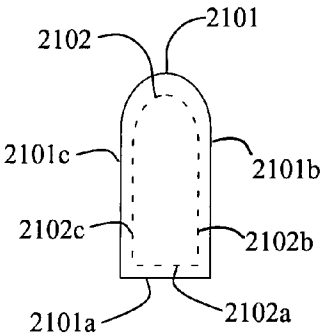
FIG. 21C is a sectional B-B view of FIG. 21.

FIG. 21A is a top view of a plasma-dome with flattened inner shell walls 2102*b* and 2102*c* and flattened outer shell wall 2101*b* and 2101*c*. FIG. 21B is a section A-A view of FIG. 21A showing flattened outer wall 2101*a* and flattened inner wall 2102*a* with a dome having outer wall 2101 and inner wall 2102. FIG. 21C is a section B-B view of FIG. 21A. In forming a PDP, the dome portion may be positioned within the substrate with the flat side up in the viewing direction or with the dome portion up in the viewing direction.

Plasma-Disc

A plasma-shell with two substantially flattened opposite sides, i.e., top and bottom is called a plasma-disc. As used herein, a flat side is a side having a flat external surface. A plasma-disc may be formed by flattening a plasma-sphere on one or more pairs of opposing sides such as top and bottom. The flattening of a plasma-sphere to form a plasma-disc may be done while the sphere shell is at an ambient temperature or at elevated softening temperature below the melting temperature. The flat viewing surface in a plasma-disc tends to increase the overall luminous efficiency of a PDP. The opposing flat base is positioned on the PDP substrate typically in contact with electrodes.

Figure 22A:
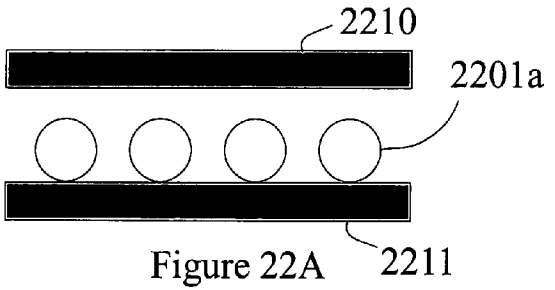
FIGS. 22A, 22B, and 22C show process steps for making plasma-discs.
Figure 22B:
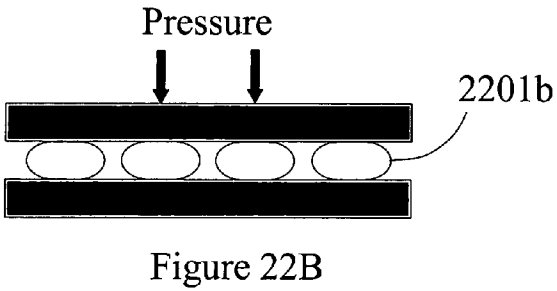
Figure 22C:
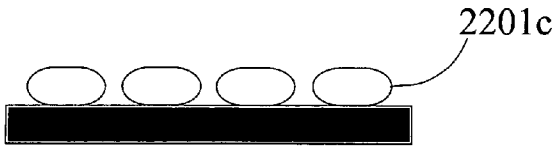

Plasma-discs may be produced while the plasma-sphere is at an elevated temperature below its melting point. While the plasma-sphere is at the elevated temperature, a sufficient pressure or force is applied with member 2210 to flatten the spheres between members 2210 and 2211 into disc shapes with flat top and bottom as illustrated in FIGS. 22A, 22B, and 22C. FIG. 22A shows a plasma-sphere. FIG. 22B shows uniform pressure applied to the plasma-sphere to form a flatten plasma-disc 2201*b*. Heat can be applied during the flattening process such as by heating members 2210 and 2211. FIG. 22C shows the resultant flat plasma-disc 2201C. One or more luminescent substances can be applied to the plasma-disc. Like a coin that can only land "heads" or "tails," a plasma-disc with a flat top and flat bottom may be applied to a substrate in one of two flat positions. However, in some embodiments, the plasma-disc may be positioned on edge on or within the substrate. The geometry of the plasma-disc may be circular, oval, elliptical, square, rectangular, pentagonal, hexagonal, trapezoidal, rhomboid, triangular or any other geometric shape. FIGS. 23 to 34 show plasma-discs of various geometric shapes with opposing flat sides. As noted above, a flat side is defined as a side having a flat external surface.

Figure 23B:
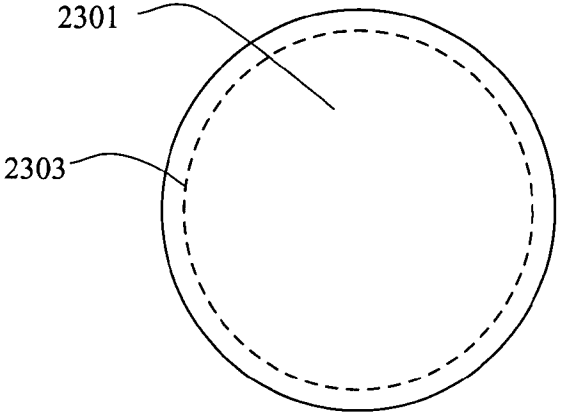
Figure 23A:
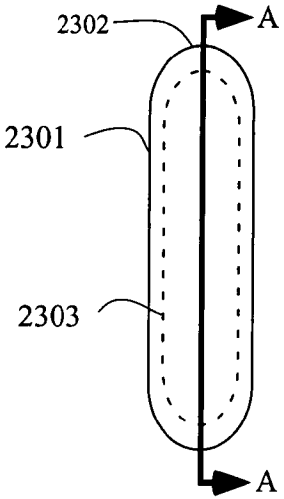

FIGS. 23A and 23B show a plasma-disc with opposing flat circular sides 2301. FIG. 23A is a left or right end view of FIG. 23B. FIG. 23B is a section A-A view of either flat circular side 2301 of FIG. 23A. As shown in FIG. 23A, the ends 2302 are rounded and do not have corners. The inside wall surface 2303 of the hollow plasma-disc is shown as a broken line in both FIGS. 23A and 23B.

Figure 24B:
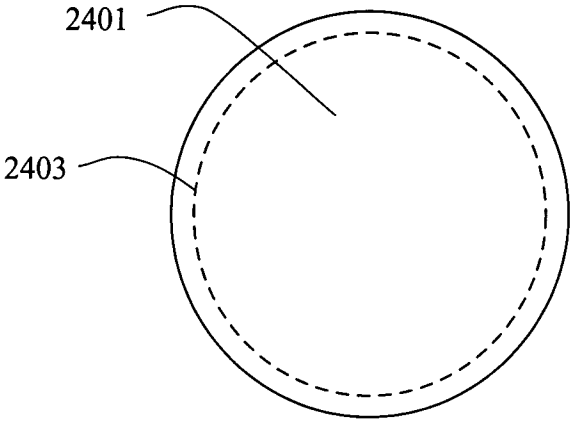
Figure 24A:
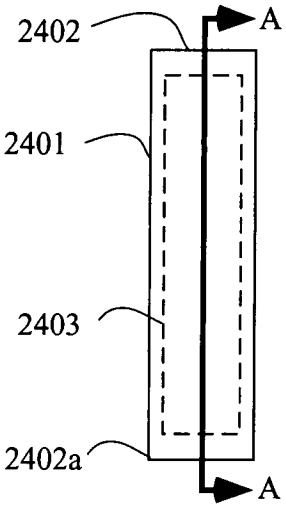

FIGS. 24A and 24B show a plasma-disc with opposing flat circular sides 2401. FIG. 24A is a left or right end view of FIG. 24B. FIG. 24B is a section A-A view of either flat circular side 2401 of FIG. 24A. As shown in FIG. 24A, the ends 2402 are flat with corners 2402*a*. The inside wall surface 2403 of the hollow plasma-disc is shown as a broken line in both FIGS. 24A and 24B.

Figure 25B:
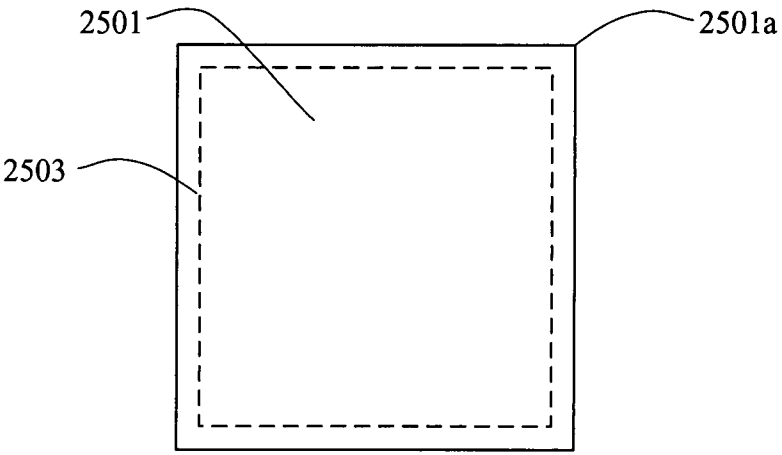
Figure 25A:
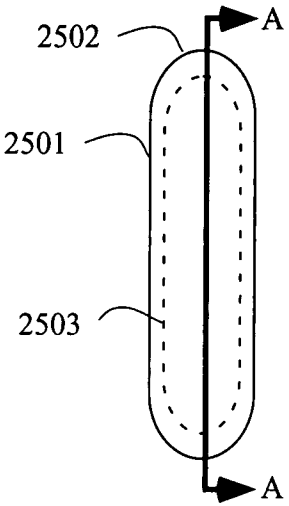

FIGS. 25A and 25B show a plasma-disc with opposing flat square sides 2501. FIG. 25A is a left or right end view of FIG. 25B. FIG. 25B is a section A-A view of either flat square side 2501 of FIG. 25A. As shown in FIG. 25A, the ends 2502 are rounded and do not have corners. The inside wall surface 2503 of the hollow plasma-disc is shown as a broken line in both FIGS. 25A and 25B. The sides 2501 may be a rectangular shape instead of a square shape.

Figure 26B:
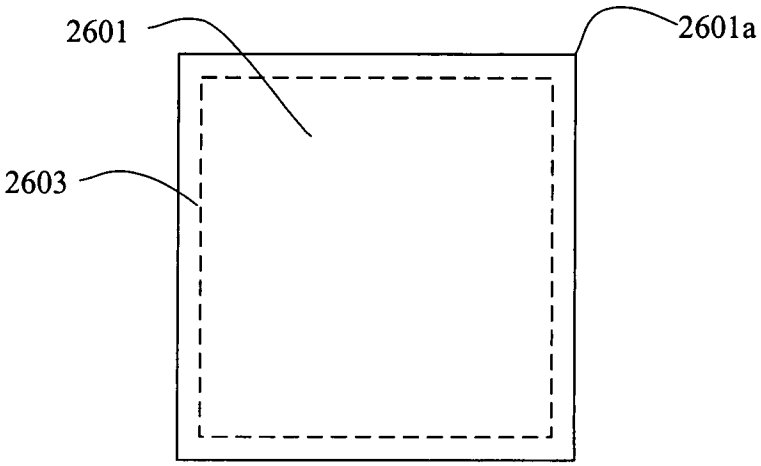
Figure 26A:
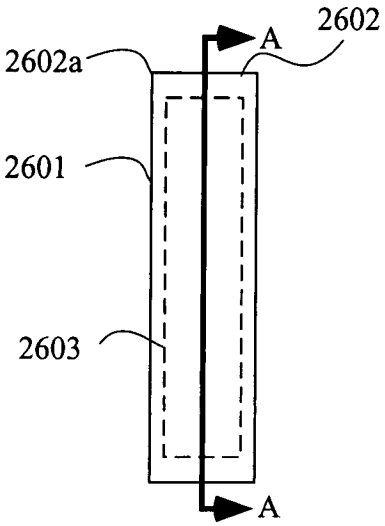

FIGS. 26A and 26B show a plasma-disc with opposing flat square sides 2601. FIG. 26A is a left or right view of FIG. 26B. FIG. 26B is a section A-A view of either flat square side 2601 of FIG. 26A. As shown in FIG. 26A, the ends 2602 are flat with corners 2602*a*. The inside wall surface 2603 of the hollow plasma-disc is shown as a broken line in both FIGS. 26A and 26B. The sides 2601 may be a rectangular shape instead of a square shape.

Figure 27B:
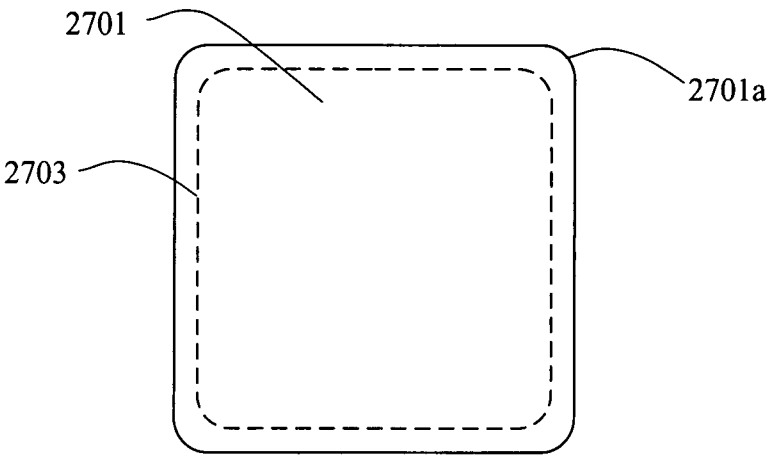
Figure 27A:
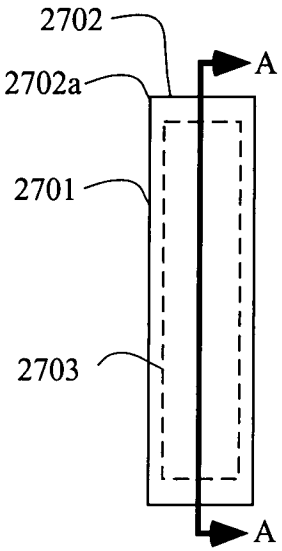

FIGS. 27A and 27B show a plasma-disc with opposing flat square sides 2701 with rounded corners 2701*a*. FIG. 27A is a left or right end view of FIG. 27B. FIG. 27B is a section A-A view of either flat square side 2701 of FIG. 27A. As shown in FIG. 27A, the ends 2702 are flat and there are corners 2702*a*. The inside wall surface 2703 of the hollow plasma-disc is shown as a broken line in both FIGS. 27A and 27B. The sides 2701 may be rectangular shape instead of a square shape.

Figure 28A:
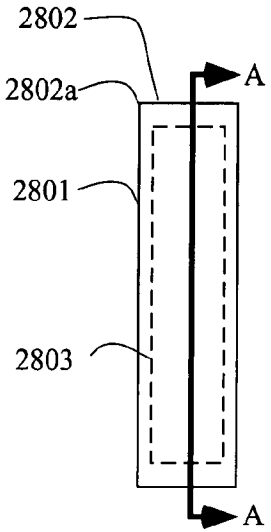
Figure 28B:
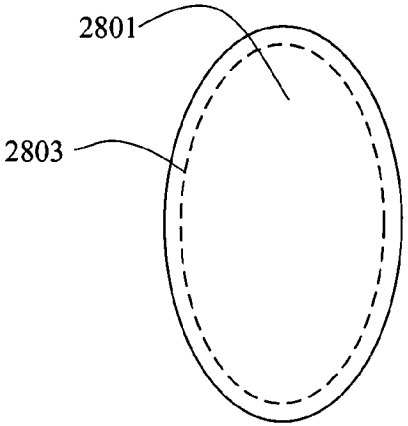

FIGS. 28A and 28B show a plasma-disc with opposing flat oval sides 2801. FIG. 28A is a left or right end view of FIG. 28B. FIG. 28B is a section A-A view of either flat oval side 2801 of FIG. 28A. As shown in FIG. 28A, the ends 2802 are flat with corners 2802*a*. The inside wall surface 2803 of the hollow plasma-disc is shown as a broken line in both FIGS. 28A and 28B. The sides 2801 may be elliptical instead of oval.

Figure 29B:
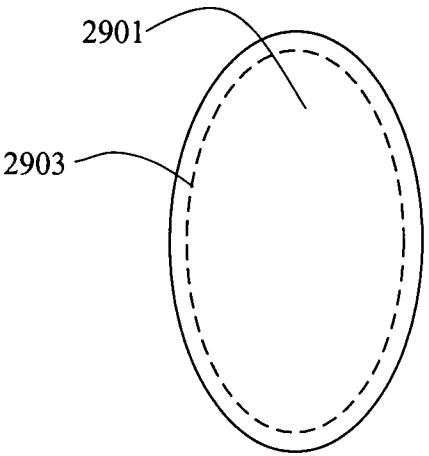
Figure 29A:
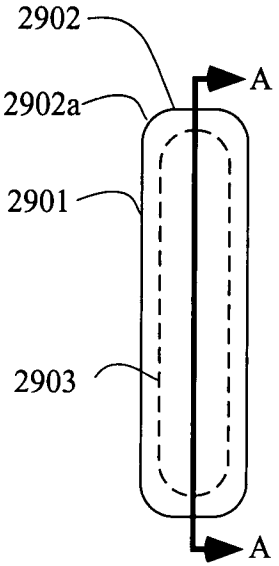

FIGS. 29A and 29B show a plasma-disc with opposing flat oval sides 2901. FIG. 29A is a left or right end view of FIG. 29B. FIG. 29B is a section A-A view of either flat oval side 2901 of FIG. 29A. As shown in FIG. 29A, the ends 2902 are flat and have rounded corners 2902*a*. The inside wall surface 2903 of the hollow plasma-disc is shown as a broken line in both FIGS. 29A and 29B. The sides 2901 may be elliptical instead of oval.

Figure 30B:
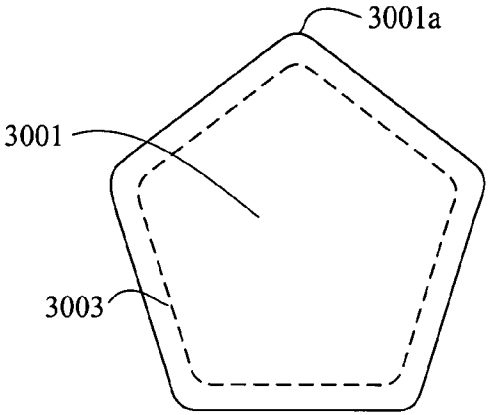
Figure 30A:
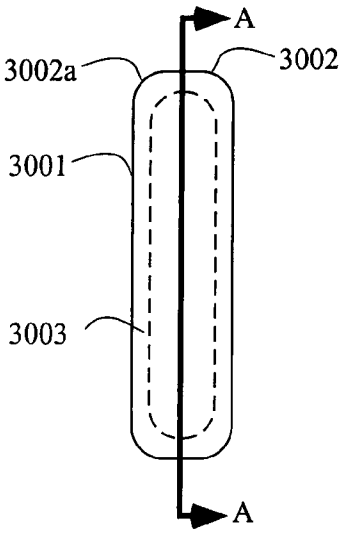

FIGS. 30A and 30B show a plasma-disc with opposing flat pentagonal sides 3001 and rounded corners 3001*a*. FIG. 30A is a left or right end view of FIG. 30B. FIG. 30B is a section A-A view of either flat pentagonal side 3001 of FIG. 30A. As shown in FIG. 30A, the ends 3002 are flat and have rounded corners 3002*a*. The inside wall surface 3003 of the hollow plasma-disc is shown as a broken line in both FIGS. 30A and 30B.

Figure 31B:
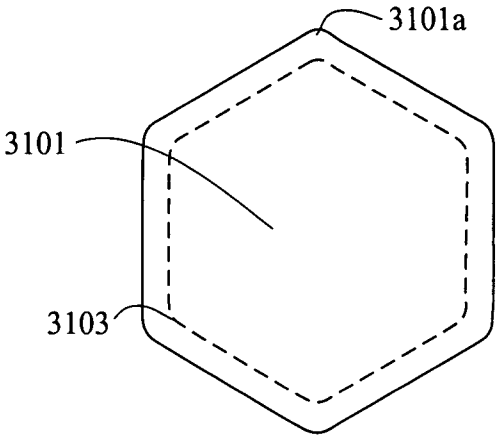
Figure 31A:
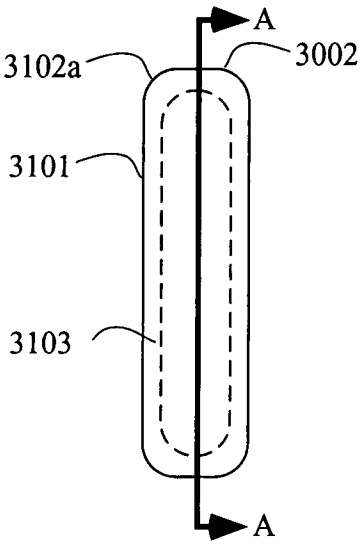

FIGS. 31A and 31B show a plasma-disc with opposing flat hexagonal sides 3101 and rounded corners 3101*a*. FIG. 31A is a left or right end view of FIG. 31B. FIG. 31B is a section A-A view of either flat hexagonal side 3101 of FIG. 31A. As shown in FIG. 31A, the ends 3102 are flat and have rounded corners 3102*a*. The inside wall surface 3103 of the hollow plasma-disc is shown as a broken line in both FIGS. 31A and 31B.

Figure 32B:
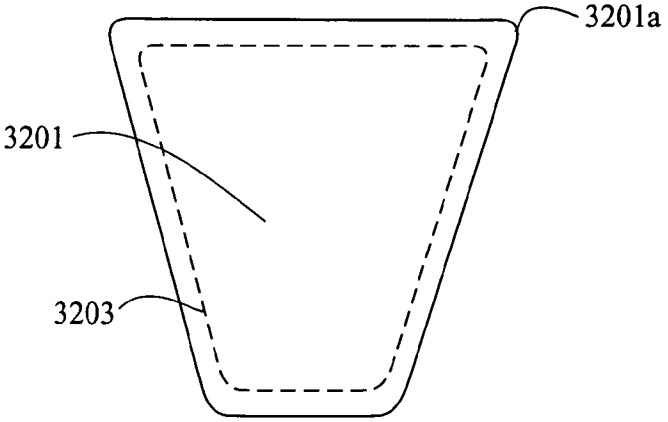
Figure 32A:
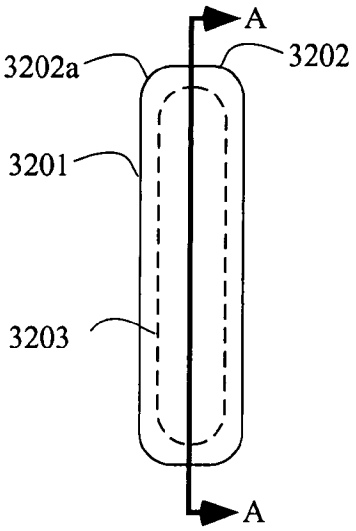

FIGS. 32A and 32B show a plasma-disc with opposing flat trapezoidal sides 3201 and rounded corners 3201*a*. FIG. 32A is a left or right end view of FIG. 32B. FIG. 32B is a section A-A view of either flat trapezoidal side 3201 of FIG. 32A. As shown in FIG. 32A, the ends 3202 are flat with rounded corners 3202*a*. The inside wall surface 3203 of the hollow plasma-disc is shown as a broken line in both FIGS. 32A and 32B.

Figure 33B:
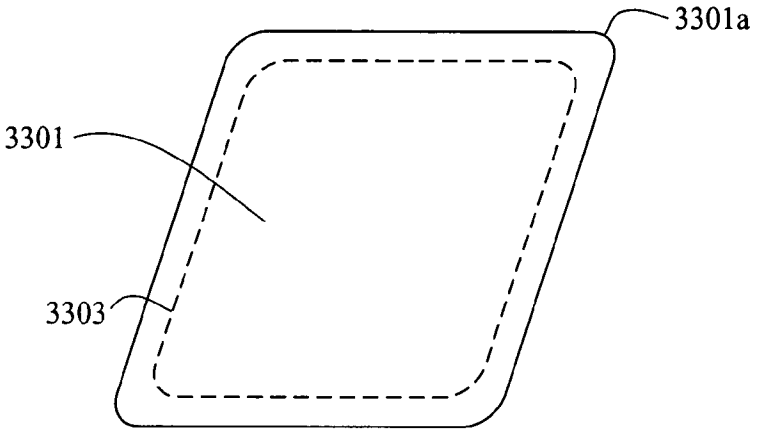
Figure 33A:
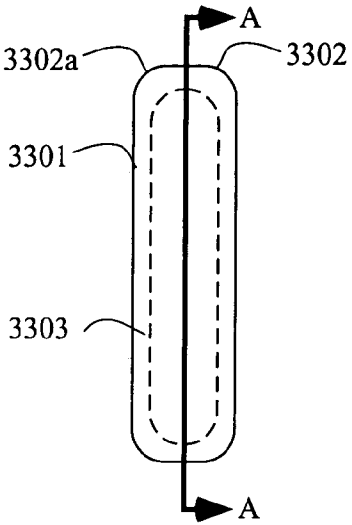

FIGS. 33A and 33B show a plasma-disc with opposing flat rhomboid sides 3301 and rounded corners 3301*a*. FIG. 33A is a left or right end view of FIG. 33B. FIG. 33B is a section A-A view of either flat rhomboid side 3301 of FIG. 33A. As shown in FIG. 33A, the ends 3302 are flat with rounded corners 3302*a*. The inside wall surface 3303 of the hollow plasma-disc is shown as a broken line in both FIGS. 33A and 33B.

Figure 34B:
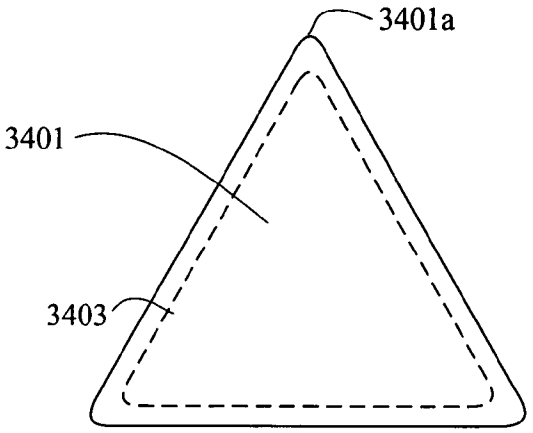
Figure 34A:
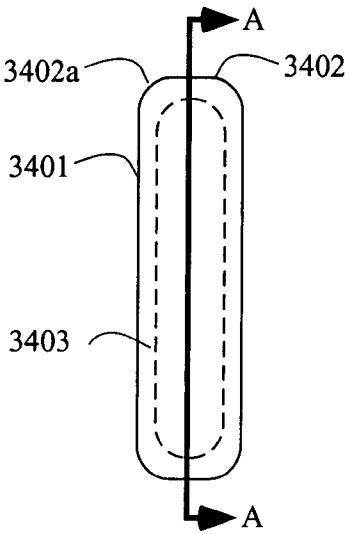

FIGS. 34A and 34B show a plasma-disc with opposing flat triangular sides 3401 and rounded corners 3401*a*. FIG. 34A is a left or right end view of FIG. 34B. FIG. 34B is a section A-A view of either flat triangular side 3401 of FIG. 34A. As shown in FIG. 34A, the ends 3402 are flat with rounded corners 3402*a*. The inside wall surface 3403 of the hollow plasma-disc is shown as a broken line in both FIGS. 34A and 34B. Although the sides 3401 are shown as an equilateral triangle, other triangular shapes may be used including a right triangle, an isosceles triangle, or an oblique or scalene triangle.

As illustrated herein, for example FIGS. 1 to 18, one flat side of the plasma-disc is positioned as the base on or in the PDP substrate and the opposing flat side is the viewing side. The gas discharge is between the two flat sides, each flat side having a flat external surface for contacting the PDP substrate and connecting to electrodes.

Figure 35:
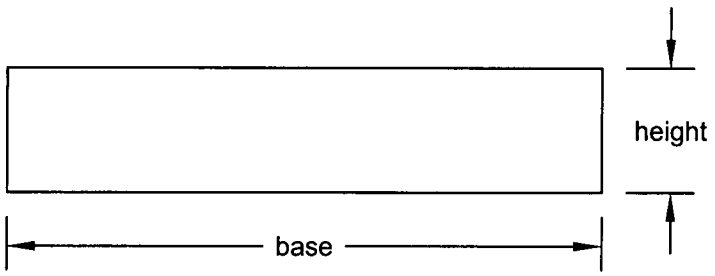
FIG. 35 shows a plasma-disc with a flat base portion in contact with a substrate.

FIG. 35 shows a plasma-disc with a flat base portion in contact with the PDP substrate. The height is the distance between the two flat sides, i.e., the distance between the flat base side and the flat viewing side.

In FIG. 35, the length of the flat base side may range from about 10 mils to about 500 mils (one mil equals 0.001 inch) or about 250 microns to about 12700 microns where 25.4 microns (micrometers) equals 1 mil or 0.001 inch.

The height in FIG. 35 is typically about 20 to 80 percent of the length of the flat base, about 2 mils to about 400 mils. In one preferred embodiment, the flat base is about 50 mils to about 400 mils with a height of about 10 mils to about 320 mils.

For larger displays, the length of the opposing flat sides can range up to about 1000 mils (25,400 microns) or greater. For smaller displays, the length can be less than 10 mils.

Electrodes

The flat surfaces of the plasma-disc are advantageous for electrically connecting electrodes to the plasma-disc. As illustrated in FIGS. 1 to 18 the electrodes are in contact with one or both flat side(s) of the flat base side and/or the opposite flat side of the plasma-disc. Thus one or both electrodes may contact the flat base side and/or one or both may contact the opposite flat side.

In one embodiment of a plasma-disc with a two-electrode system, one electrode is in contact with one flat side of the plasma-disc such as the flat base in FIG. 35 and one electrode is in contact with the opposite flat side. In another embodiment of two-electrode system, both electrodes are in contact with the same flat side, both electrodes being on the flat base side or on the opposing flat side of the plasma-disc. In either embodiment, the gas discharge is between the two electrodes.

In one embodiment of a plasma-disc with a three-electrode system, two electrodes are in contact with the same flat side and one electrode is in contact with the opposite flat side. Typically in this embodiment, two electrodes are in contact with the flat base side and one is in contact with the opposite flat side. Alternatively, the two electrodes may be in contact with the flat side and one electrode in contact with the opposite base side. In such embodiment, the PDP may be operated as a surface discharge device.

Other electrode configurations are contemplated including PDP electronic systems with 4, 5, 6, or more electrodes per plasma-disc. It is also contemplated there may be multiple discharges within the plasma-disc. Depending upon the electrode configuration, the plasma-disc may be configured to comprise up to six separate pixels.

FIGS. 36 to 46 herein illustrate different electrode configurations that may be used with the plasma-disc.

Figure 36B:
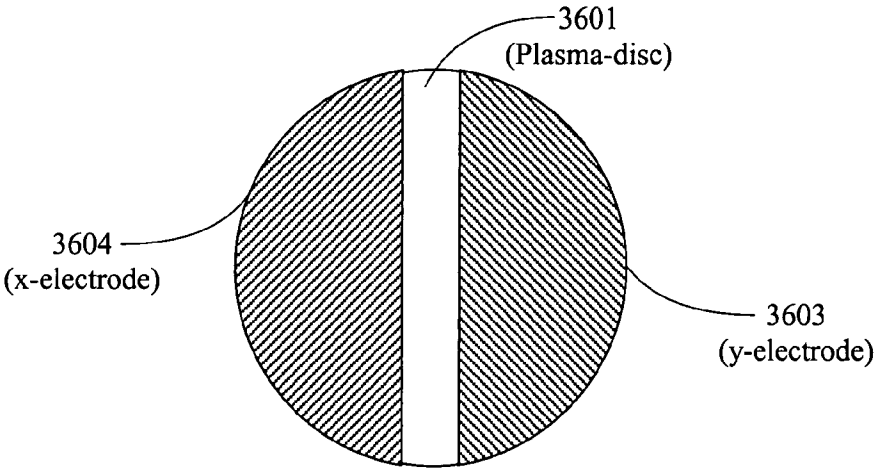
FIGS. 36 to 46 show different electrode configurations.
Figure 36A:
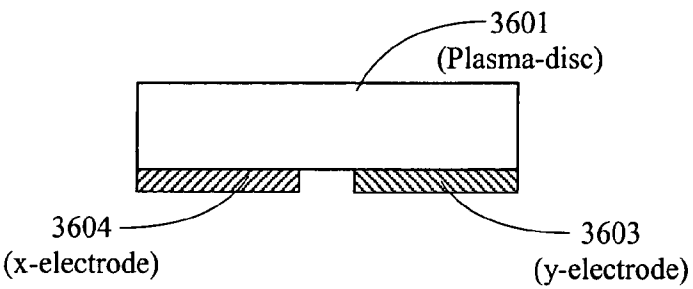

FIGS. 36A and 36B show a plasma-disc 3601 with opposing flat circular sides in a two electrode configuration. FIG. 36A is a side view of the plasma-disc 3601 with x-electrode 3604 and y-electrode 3603 on one flat side. FIG. 36B is a bottom view of the configuration in FIG. 36A showing the location of the x- and y-electrodes. These electrodes may extend to the edge of the plasma-disc 3601.

Figure 37B:
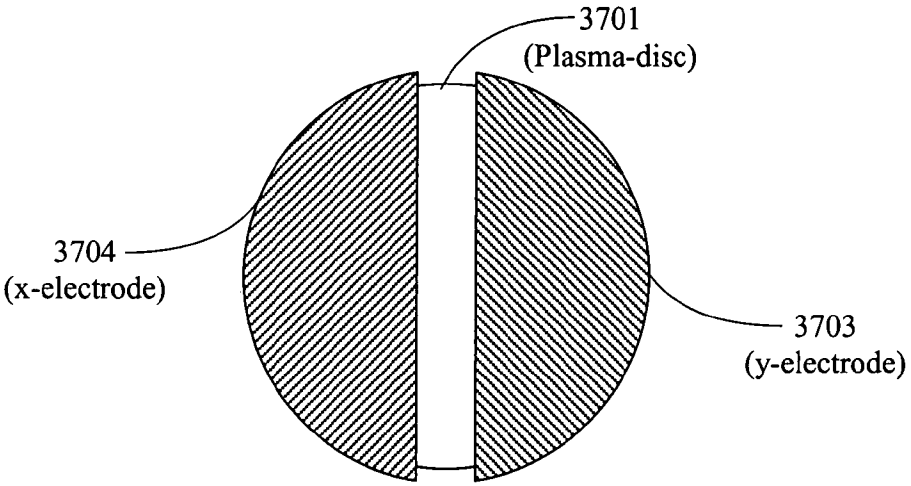
Figure 37A:
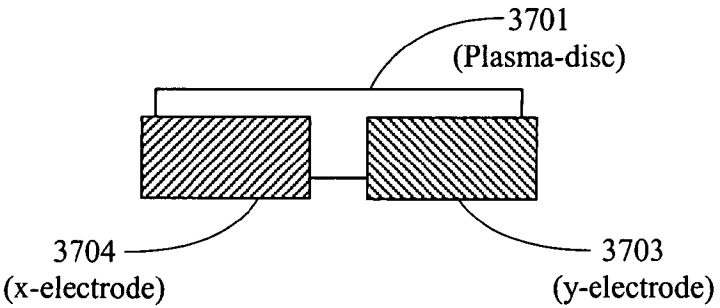

FIGS. 37A and 37B show a plasma-disc 3701 with opposing flat circular sides in a two electrode configuration. FIG. 37A is a side view of the plasma-disc 3701 with x-electrode 3704 and y-electrode 3703 wrapping around the sides of plasma-disc 3701. The x- and y-electrodes 3704 and 3703 may extend up the sides of plasma-disc 3701. FIG. 37B is a bottom view of the configuration in FIG. 37A. This view shows the x-electrode 3704 and y-electrode 3703 extending to and wrapping around the curved side of plasma-disc 3701.

Figure 38B:
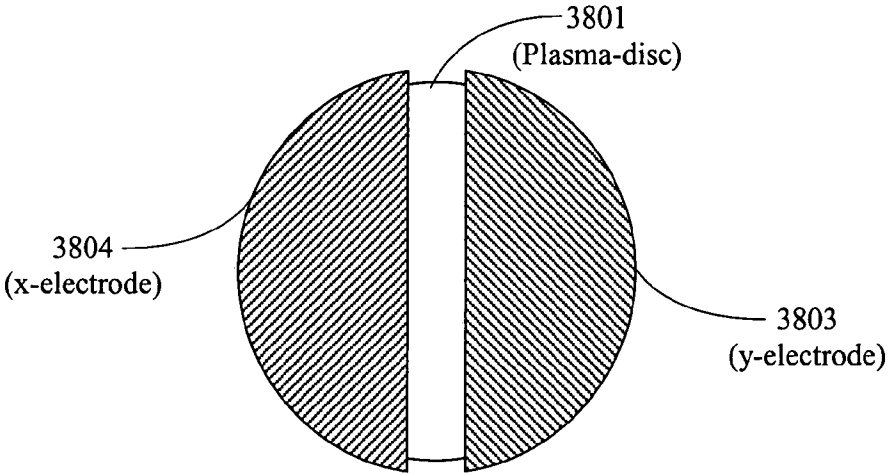
Figure 38A:
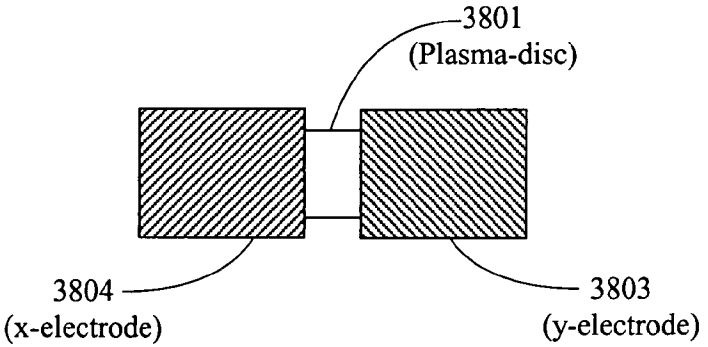

FIGS. 38A and 38B show a plasma-disc 3801 with opposing flat circular sides in a two electrode configuration. FIG. 38A is a side view of the plasma-disc 3801 with x-electrode 3804 and y-electrode 3803 wrapping around the edges of plasma-disc 3801. FIG. 38B is a bottom view of the configuration in FIG. 38A. This view shows the x-electrode 3804 and y-electrode 3803 extending to and wrapping around the curved side of plasma-disc 3801.

Figure 39B:
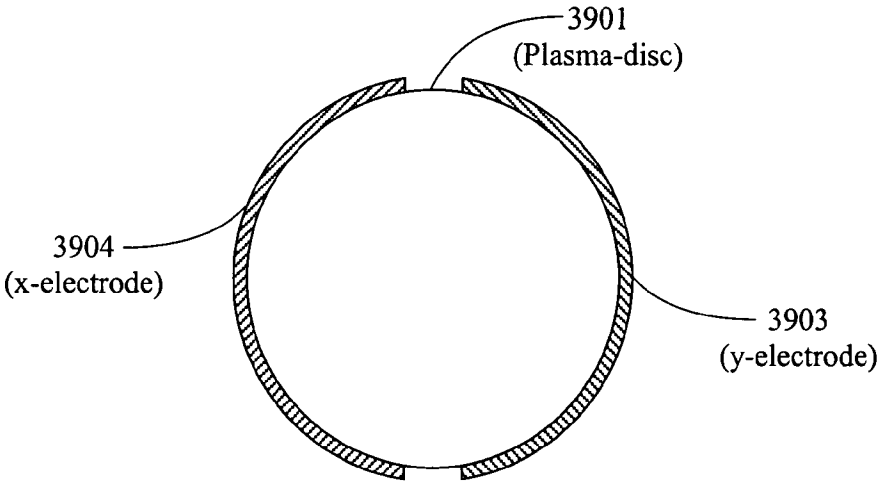
Figure 39A:
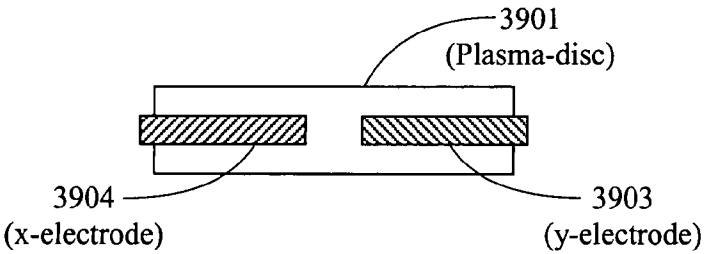

FIGS. 39A and 39B show a plasma-disc 3901 with opposing flat circular sides in a two electrode configuration. FIG. 39A is a side view of the plasma-disc 3901 with x-electrode 3904 and y-electrode 3903 on the curved side of plasma-disc 3901. The height of the electrodes may extend to the full height of plasma-disc 3901. FIG. 39B is a bottom view of the configuration in FIG. 39A. This view shows the curved x-electrode 3904 and curved y-electrode 3903 on plasma-disc 3901.

Figure 40B:
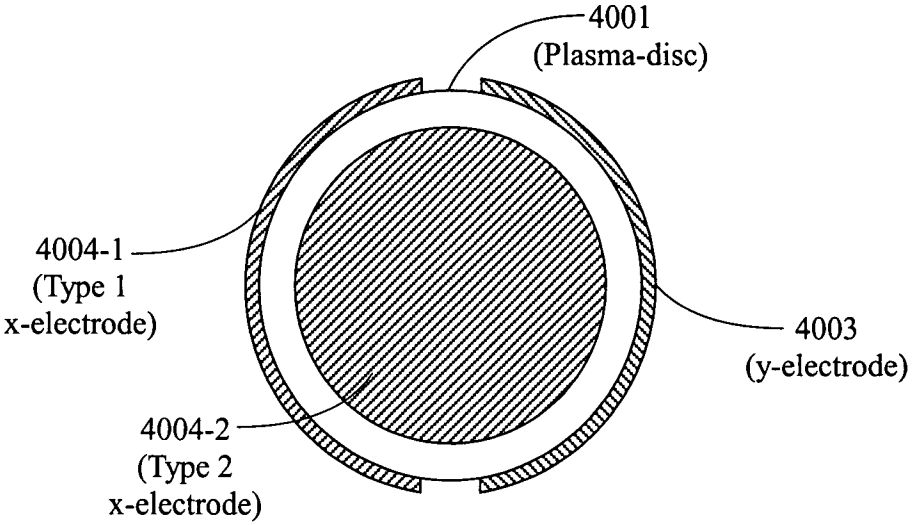
Figure 40A:
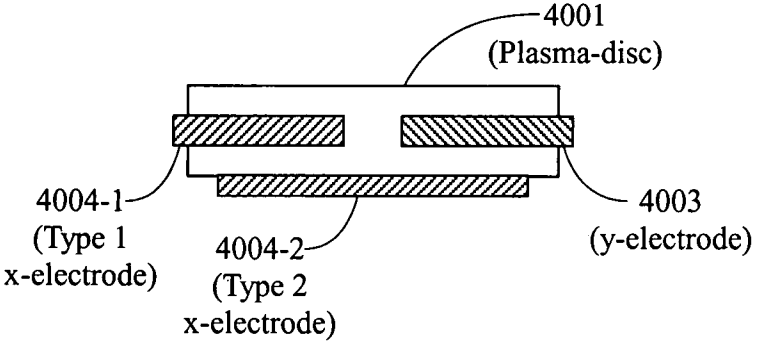

FIGS. 40A and 40B show a plasma-disc 4001 with opposing flat circular sides and a three-electrode configuration. FIG. 40A is a side view of the plasma-disc 4001 with type 1 x-electrode 4004-1 and y-electrode 4003 on the curved side of plasma-disc 4001. The height of the electrodes may extend the full height of plasma-disc 4001. Type 2 x-electrode 4004-2 is on one opposing flat circular side of plasma-disc 4001. FIG. 40B is a bottom view of the configuration in FIG. 40A. This view shows the curved type 1 x-electrode 4004 and curved y-electrode 4003 on plasma-disc 4001 and type 2 x-electrode 4004-2 on one opposing flat side of plasma-disc 4001. The type 2 x-electrode 4004-2 may extend to the edge of plasma-disc 4001, but may not make electrical contact with electrodes 4004-1 and/or 4003.

Figure 41B:
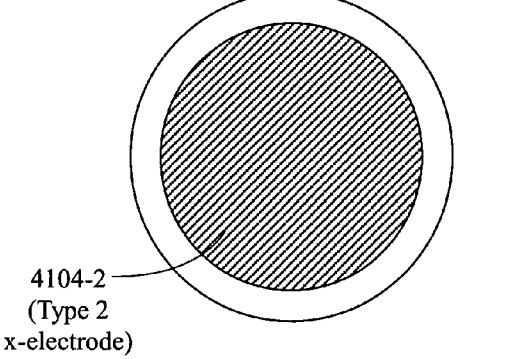
Figure 41A:
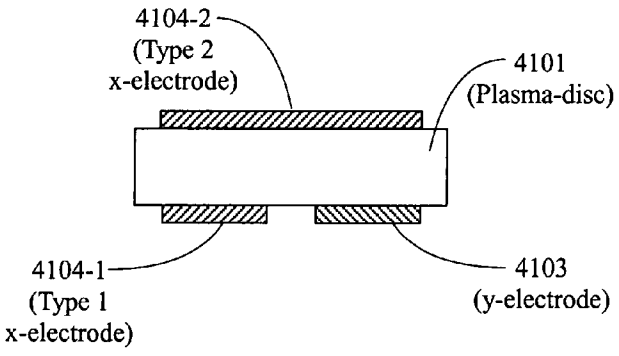
Figure 41C:
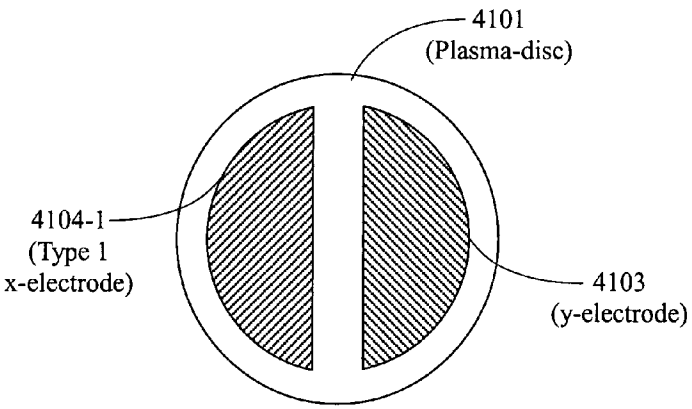

FIGS. 41A and 41B show a plasma-disc 4101 with opposing flat circular sides and a three-electrode configuration. FIG. 41A is a side view of the plasma-disc 4101 with type 1 x-electrode 4104-1 and y-electrode 4103 on one flat circular side of plasma-disc 4101. Type 2 x-electrode 4104-2 is on the opposing flat circular side of plasma-disc 4101. FIG. 41B is a top view of the configuration in FIG. 41A, showing the type 2 x-electrode 4104-2, which may extend to the edge of the plasma-disc 4101. FIG. 41C is a bottom view of FIG. 41A, showing type 1 x-electrode 4104-1 and y-electrode 4103. Type 1 x-electrode 4104-1 and y-electrode 4103 may extend to the edge of the plasma-disc 4101 and may also extend and wrap around the curved side of the plasma-disc 4101.

Figure 42A:
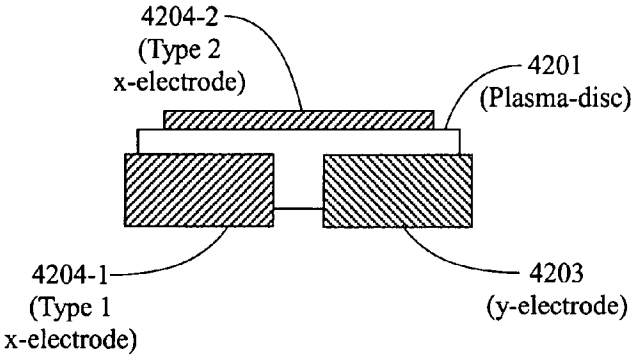
Figure 42B:
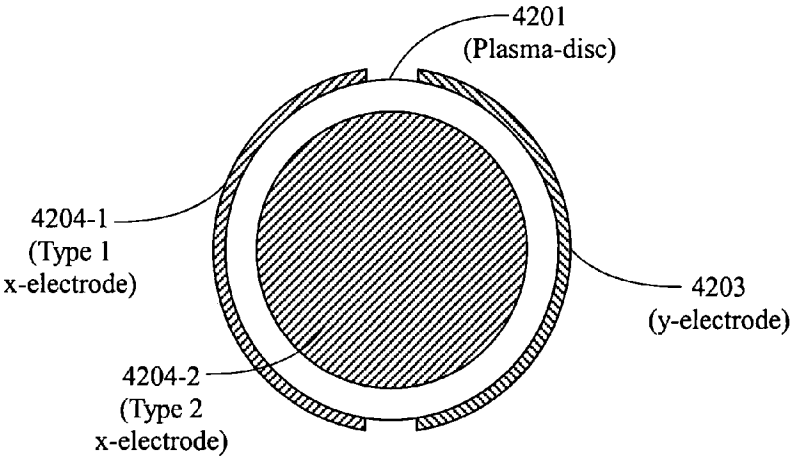
Figure 42C:
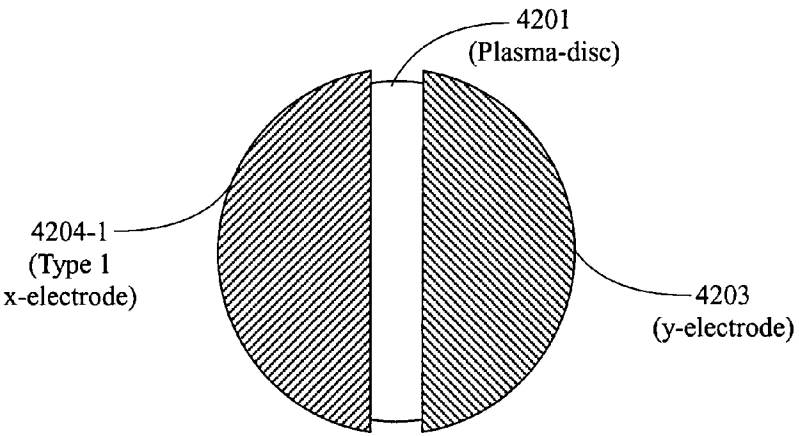

FIGS. 42A and 42B show a plasma-disc 4201 with opposing flat circular sides in a three-electrode configuration. FIG. 42A is a side view of the plasma-disc 4201 with type 1 x-electrode 4204-1 and y-electrode 4203 wrapping around the sides of plasma-disc 4201. The type 1 x- and y-electrodes 4204-1 and 4203 may extend up the sides of plasma-disc 4201. Type 2 x-electrode 4204-2 is on the opposing flat circular side of plasma-disc 4201. FIG. 42B is a top view of the configuration in FIG. 42A, showing the type 2 x-electrode 4204-2, which may extend to the edge of the plasma-disc 4201, but may not make electrical contact electrodes 4204-1 and/or 4203. FIG. 42C is a bottom view of the configuration seen in FIG. 42A, This view shows the type 1 x-electrode 4204-1 and y-electrode 4203 wrapping around to the curved side of plasma-disc 4201.

Figure 43B:
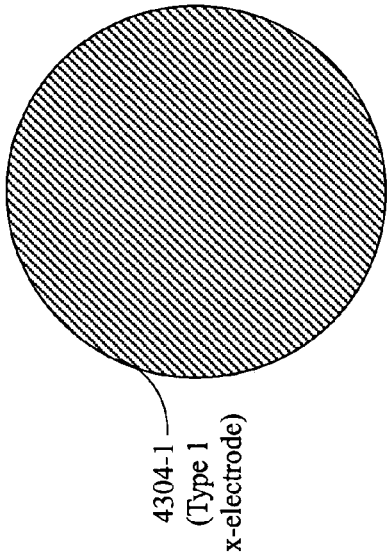
Figure 43A:
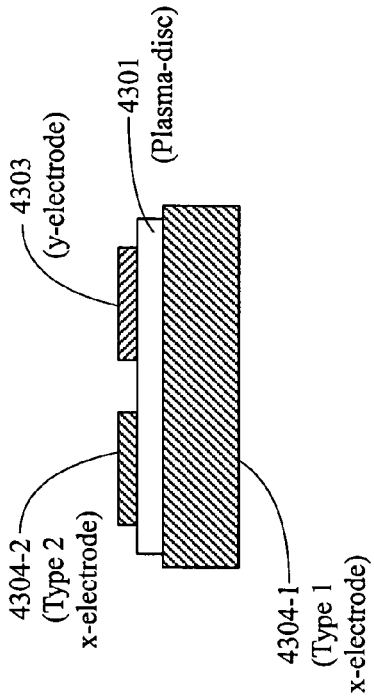
Figure 43C:
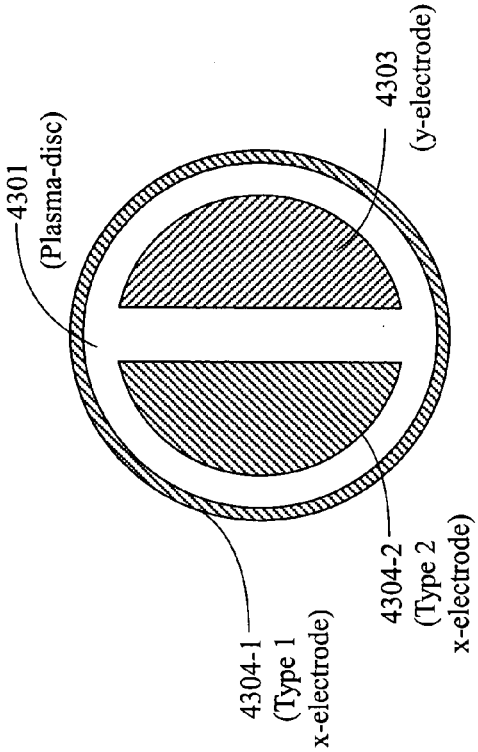

FIGS. 43A, 43B, and 43C show a plasma-disc 4301 with opposing flat circular sides in a three-electrode configuration. FIG. 43A is a side view of the plasma-disc 4301 with type 1 x-electrode 4304-1 wrapping around the sides of plasma-disc 4301. This electrode may extend up the sides of the plasma-disc 4301. Type 2 x-electrode 4304-2 and y-electrode 4303 are located on the opposing flat circular side of plasma-disc 4301. FIG. 43B is a bottom view of the configuration in FIG. 43A, showing type 1 x-electrode wrapping around the curved side of plasma-disc 4301. FIG. 43C is a top view of the configuration in FIG. 43A, showing type 2 x-electrode 4304-2 and y-electrode 4303 on the other opposing flat circular side and type 1 x-electrode 4304-1 wrapped around the curved side of plasma-disc 4301. Type 2 x-electrode 4304-2 and y-electrode 4303 may extend to the edge of the plasma-disc 4301, but may not make electrical contact to electrode 4304-1.

Figure 44B:
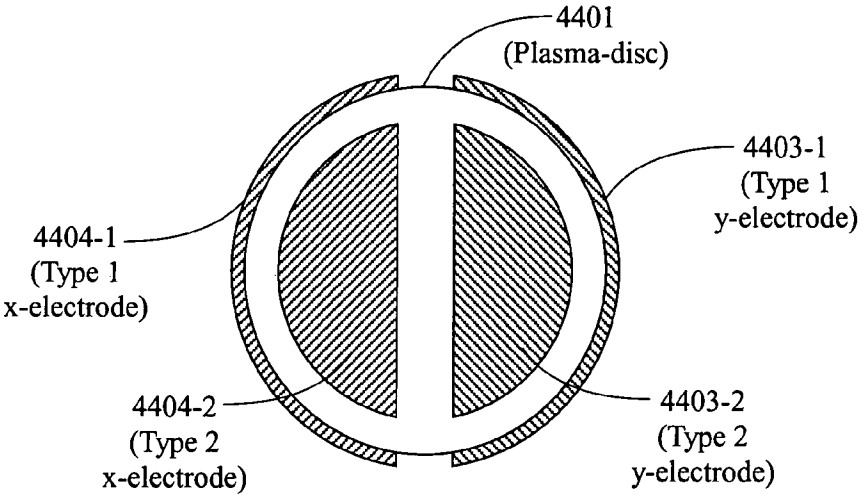
Figure 44A:
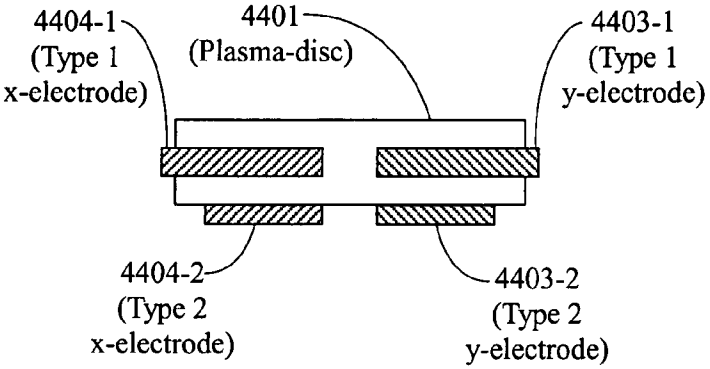

FIGS. 44A and 44B show a plasma-disc 4401 with opposing flat circular sides in a four-electrode configuration. FIG. 44A is a side view of the plasma-disc 4401 with type 1 x-electrode 4404-1 and type 1 y-electrode 4403-1 on the curved side of plasma-disc 4401. The height of the electrodes may extend to the full height of plasma-disc 4401, but may not make electrical contact to the type 2 electrodes 4404-2 and/or 4403-2. FIG. 44B is a bottom view of the configuration in FIG. 44A. This view shows the curved type 1 x-electrode 4404-1 and curved type 1 y-electrode 4403-1 on plasma-disc 4401. Type 2 x-electrode 4404-2 and type 2 y-electrode 4403-2 may extend to the edge of the plasma-disc 4301, but may not make electrical contact to electrodes 4404-1 and/or 4403-1.

Figure 45A:
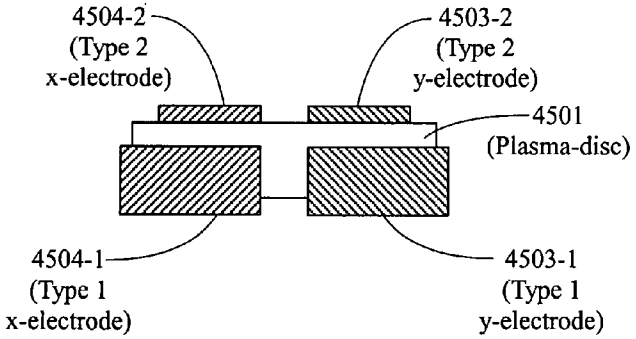
Figure 45B:
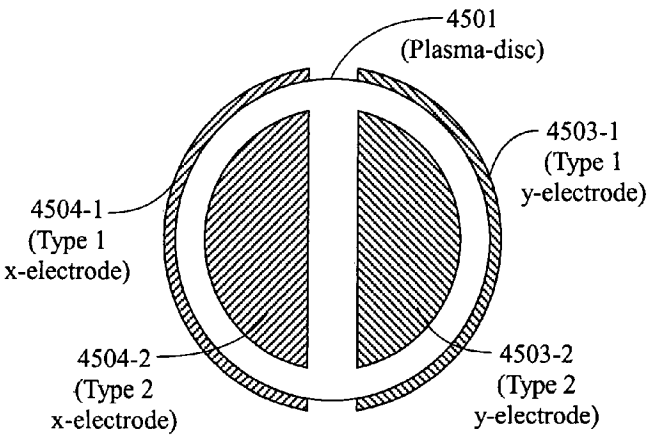
Figure 45C:
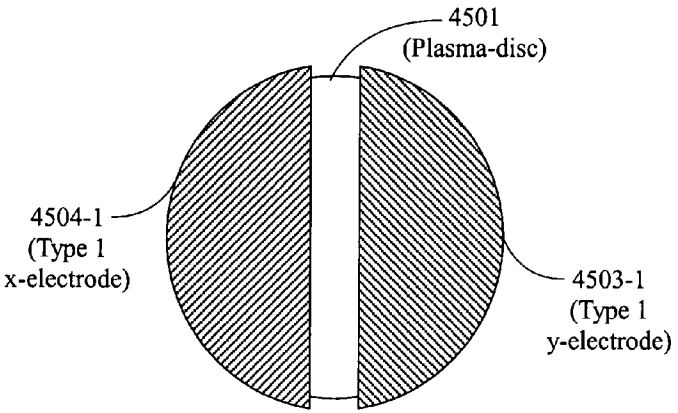
Figure 45D:
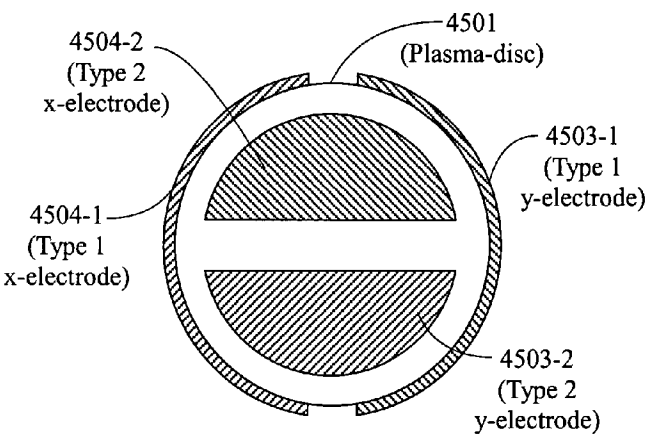

FIGS. 45A, 45B, 45C, and 45D show a plasma-disc 4501 with opposing flat circular sides in a four-electrode configuration. FIG. 45A is a side view of the plasma-disc 4501 with type 1 x-electrode 4504-1 and type 1 y-electrode 4503-1 wrapping around the curved side of plasma-disc 4501. The height of the electrodes may extend to the full height of plasma-disc 4501, but may not make electrical contact to the type 2 electrodes 4504-2 and/or 4503-2. FIG. 45B is a top view of the configuration in FIG. 45A, showing type 1 x-electrode 4504-1 and type 1 y-electrode 4503-1 wrapped around the curved side of plasma-disc 4501 and type 2 x-electrode 4504-2 and type 2 y-electrode 4503-2 on one opposing flat side. These type 2 electrodes 4504-2 and 4503-2 may extend to the edge of plasma-disc 4501, but may not make electrical contact with the type 1 electrodes 4504-1 and/or 4503-1. FIG. 45C is a bottom view of the configuration in FIG. 45A, showing the type 1 x-electrode 4504-1 and type 1 y-electrode 4503-1 wrapping around the curved side of plasma-disc 4501. FIG. 45D is an alternate top view of FIG. 45B. The type 2 electrodes 4504-2 and 4503-2 may be at any angle with respect to the type 1 electrodes 4504-1 and 4503-1.

Figure 46A:
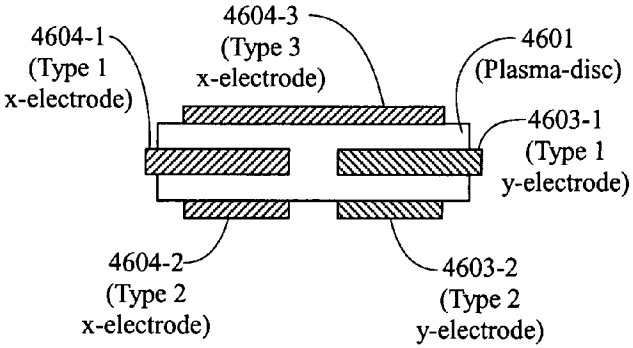
Figure 46B:
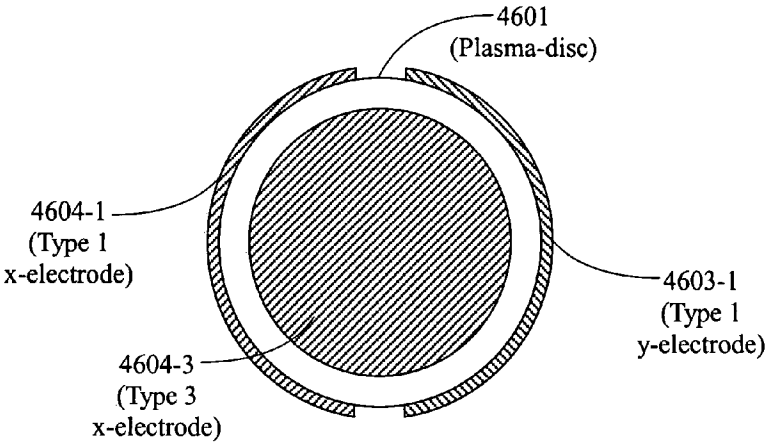
Figure 46C:
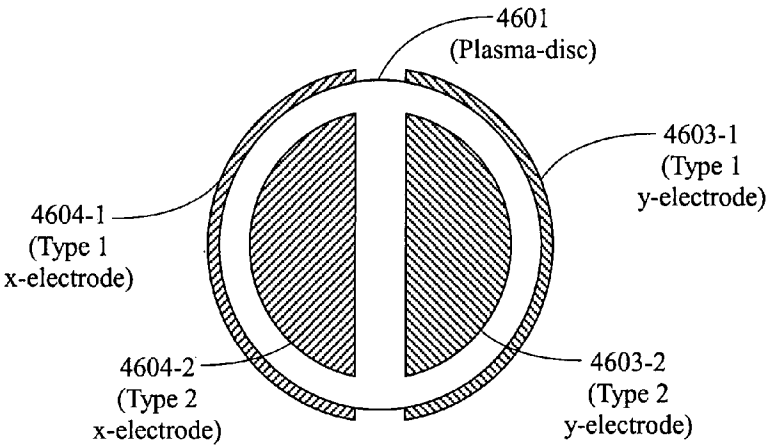

FIGS. 46A, 46B, and 46C, show a plasma-disc 4601 with opposing flat circular sides in a five-electrode configuration. FIG. 46A is a side view of the plasma-disc 4601 with type 3 x-electrode 4604-3 on the top flat side, type 1 electrodes 4604-1 and 4603-1 on the curved side of plasma-disc 4601, and type 2 electrodes 4604-2 and 4603-2 on the bottom flat side of plasma-disc 4601. The height of the type 1 electrodes 4604-1 and 4603-1 may extend to the full height of the plasma-disc 4601 but may not make electrical contact with type 2 electrodes 4604-2 and/or 4603-2 and/or 4604-3. FIG. 46B is a top view of the configuration in FIG. 46A, showing type 1 x-electrode 4604-1 and type 1 y-electrode 4603-1 on the curved side of plasma-disc 4601, and type 3 x-electrode 4604-3 on one flat circular side of plasma-disc 4601. The type 3 x-electrode 4604-3 may extend to the edge of plasma-disc 4601, but may not make electrical contact with type 1 electrodes 4604-1 and/or 4603-1. FIG. 46C is a bottom view of the configuration in FIG. 46A, showing type 1 electrodes 4604-1 and 4603-1 on the curved side of plasma-disc 4601, and type 2 x-electrode 4604-2 and type 2 y-electrode 4603-2 on one flat circular side. The type 2 electrodes 4604-2 and 4603-2 may extend to the edge of plasma-disc 4601 but may not make electrical contact to type 1 electrodes 4604-1 and/or 4603-1.

Plasma-Sphere

Figure 47:
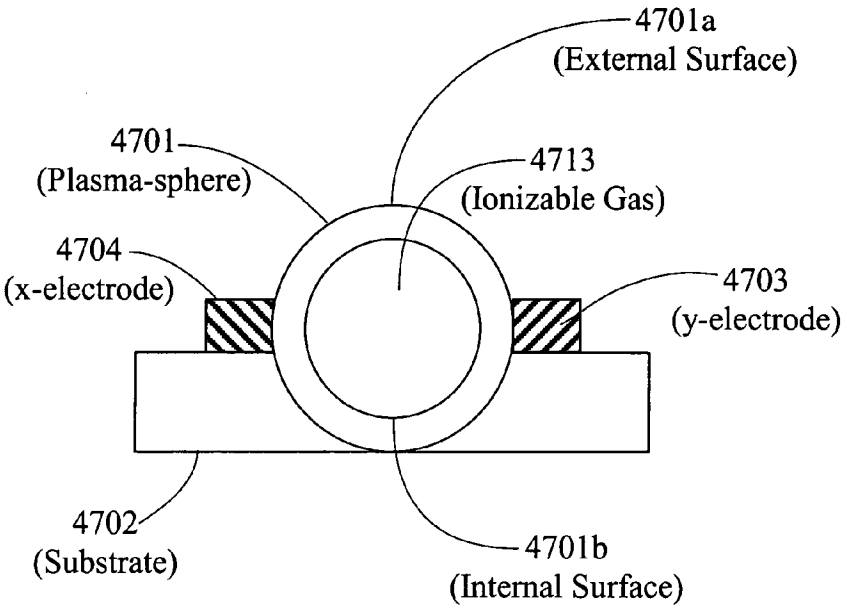
FIG. 47 shows a plasma-sphere located on a substrate with a x-electrode and y-electrode.

FIG. 47 shows a hollow plasma-sphere 4701 with external surface 4701*a* and internal surface 4701*b* located within a substrate 4702 with x-electrode 4704 and y-electrode 4703. The plasma-sphere 4701 contains ionizable gas 4713.

PDP Electronics

Figure 48:
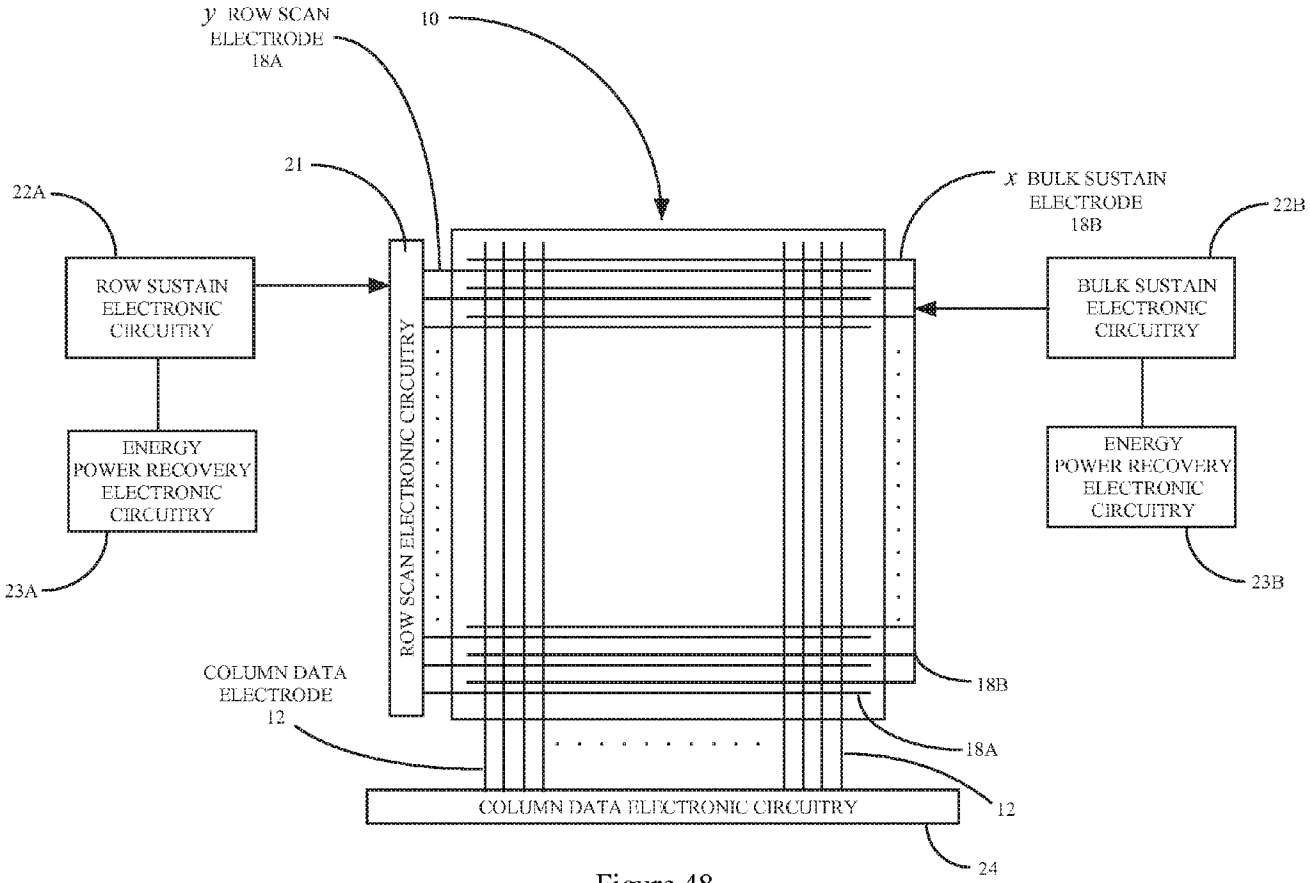
Figure 48 PRIOR ART
FIG. 48 shows a block diagram of electronics for driving an AC gas discharge plasma display with plasma-discs as pixels.

FIG. 48 is a block diagram of a plasma display panel (PDP) 10 with electronic circuitry 21 for y row scan electrodes 18A, bulk sustain electronic circuitry 22B for x bulk sustain electrode 18B and column data electronic circuitry 24 for the column data electrodes 12. The pixels or sub-pixels of the PDP comprise plasma-discs not shown in FIG. 48.

There is also shown row sustain electronic circuitry 22A with an energy power recovery electronic circuit 23A. There is also shown energy power recovery electronic circuitry 23B for the bulk sustain electronic circuitry 22B.

The electronics architecture used in FIG. 48 is Address Display Separately (ADS) as described in the Shinoda and other patents cited herein including U.S. Pat. No. 5,661,500. In addition, other architectures as described herein and known in the prior art may be utilized. These architectures including Shinoda ADS may be used to address plasma-discs in a PDP.

ADS

A basic electronics architecture for addressing and sustaining a surface discharge AC plasma display is called Address Display Separately (ADS). The ADS architecture may be used for a monochrome or multicolor display. The ADS architecture is disclosed in a number of Fujitsu patents including U.S. Pat. No. 5,541,618 (Shinoda) and U.S. Pat. No. 5,724,054 (Shinoda), incorporated herein by reference. Also see U.S. Pat. No. 5,446,344 (Kanazawa) and U.S. Pat. No. 5,661,500 (Shinoda et al.), incorporated herein by reference. ADS has become a basic electronic architecture widely used in the AC plasma display industry for the manufacture of PDP monitors and television.

Fujitsu ADS architecture is commercially used by Fujitsu and is also widely used by competing manufacturers including Matsushita and others. ADS is disclosed in U.S. Pat. No. 5,745,086 (Weber), incorporated herein by reference. See FIGS. 2, 3, 11 of Weber ('086). The ADS method of addressing and sustaining a surface discharge display as disclosed in U.S. Pat. No. 5,541,618 (Shinoda) and U.S. Pat. No. 5,724,054 (Shinoda), incorporated herein by reference, sustains the entire panel (all rows) after the addressing of the entire panel. The addressing and sustaining are done separately and are not done simultaneously. ADS may be used to address plasma-discs in a PDP.

ALIS

This invention may also use the shared electrode or electronic ALIS drive system disclosed by Fujitsu in U.S. Pat. No. 6,489,939 (Asso et al.), U.S. Pat. No. 6,498,593 (Fujimoto et al.), U.S. Pat. No. 6,531,819 (Nakahara et al.), U.S. Pat. No. 6,559,814 (Kanazawa et al.), U.S. Pat. No. 6,577,062 (Itokawa et al.), U.S. Pat. No. 6,603,446 (Kanazawa et al.), U.S. Pat. No. 6,630,790 (Kanazawa et al.), U.S. Pat. No. 6,636,188 (Kanazawa et al.), U.S. Pat. No. 6,667,579 (Kanazawa et al.), U.S. Pat. No. 6,667,728 (Kanazawa et al.), U.S. Pat. No. 6,703,792 (Kawada et al.), and U.S. Patent Application Publication, 2004/0046509 (Sakita), all of which are incorporated herein by reference. In accordance with this invention, ALIS may be used to address plasma-discs in a PDP.

AWD

Another electronic architecture is called Address While Display (AWD). The AWD electronics architecture was first used during the 1970s and 1980s for addressing and sustaining monochrome PDP. In AWD architecture, the addressing (write and/or erase pulses) are interspersed with the sustain waveform and may include the incorporation of address pulses onto the sustain waveform. Such address pulses may be on top of the sustain and/or on a sustain notch or pedestal. See for example U.S. Pat. No. 3,801,861 (Petty et al.) and U.S. Pat. No. 3,803,449 (Schmersal), both incorporated herein by reference. FIGS. 1 and 3 of the Shinoda ('054) ADS patent disclose AWD architecture as prior art.

The AWD electronics architecture for addressing and sustaining monochrome PDP has also been adopted for addressing and sustaining multi-color PDP. For example, Samsung Display Devices Co., Ltd., has disclosed AWD and the superimpose of address pulses with the sustain pulse. Samsung specifically labels this as address while display (AWD). See Ryeom, J. et al. "High-Luminance and High-Contrast HDTV PDP with Overlapping Driving Scheme." *Proceedings of the Sixth International Display Workshops, IDW* 99, Sendai, Japan (Dec. 1-3, 1999): 743-746. and AWD as disclosed in U.S. Pat. No. 6,208,081 issued to Yoon-Phil Eo and Jeong-duk Ryeom of Samsung, incorporated herein by reference.

LG Electronics Inc. has disclosed a variation of AWD with a Multiple Addressing in a Single Sustain (MASS) in U.S. Pat. No. 6,198,476 issued to Jin-Won Hong et al. of LG Electronics, incorporated herein by reference. Also see U.S. Pat. No. 5,914,563 issued to Eun-Cheol Lee et al. of LG Electronics, incorporated herein by reference. AWD may be used to address plasma-discs.

An AC voltage refresh technique or architecture is disclosed by U.S. Pat. No. 3,958,151 issued to Yano et al. of Nippon Electric, incorporated herein by reference. In one embodiment of this invention the plasma-discs are filled with pure neon and operated with the architecture of Yano (151).

Energy Recovery

Energy recovery is used for the efficient operation of a PDP. Examples of energy recovery architecture and circuits are well known in the prior art. These include U.S. Pat. No. 4,772,884 (Weber et al.), U.S. Pat. No. 4,866,349 (Weber et al.), U.S. Pat. No. 5,081,400 (Weber et al.), U.S. Pat. No. 5,438,290 (Tanaka), U.S. Pat. No. 5,642,018 (Marcotte), U.S. Pat. No. 5,670,974 (Ohba et al.), U.S. Pat. No. 5,808,420 (Rilly et al.) and U.S. Pat. No. 5,828,353 (Kishi et al.), all incorporated herein by reference.

Slow Ramp Reset

Slow rise slopes or ramps may be used in the practice of this invention. The prior art discloses slow rise slopes or ramps for the addressing of AC plasma displays. The early patents include U.S. Pat. No. 4,063,131 (Miller) and U.S. Pat. No. 4,087,805 (Miller); U.S. Pat. No. 4,087,807 (Miavecz); and U.S. Pat. No. 4,611,203 (Criscimagna et al.) and U.S. Pat. No. 4,683,470 (Criscimagna et al.), incorporated herein by reference.

An architecture for a slow ramp reset voltage is disclosed in U.S. Pat. No. 5,745,086 issued to Larry F. Weber of Plasmaco and Matsushita, incorporated herein by reference. Weber ('086) discloses positive or negative ramp voltages that exhibit a slope that is set to assure that current flow through each display pixel site remains in a positive resistance region of the gas discharge. The slow ramp architecture may be used in combination with ADS as disclosed in FIG. 11 of Weber 086. PCT Patent Application WO 00/30065 and U.S. Pat. No. 6,738,033, both filed by Junichi Hibino et al. of Matsushita also disclose architecture for a slow ramp reset voltage and are incorporated herein by reference.

Artifact Reduction

Artifact reduction techniques may be used in the practice of this invention. The PDP industry has used various techniques to reduce motion and visual artifacts in a PDP display. Pioneer of Tokyo, Japan has disclosed a technique called CLEAR for the reduction of false contour and related problems. See Tokunaga et al. "Development of New Driving Method for AC-PDPs." *Proceedings of the Sixth International Display Workshops, IDW* 99, Sendai, Japan (Dec. 1-3, 1999): 787-790. Also see European Patent Applications EP 1020838 A1 by Tokunaga et al. of Pioneer. CLEAR techniques disclosed in the above Pioneer IDW publication and Pioneer EP 1020838 A1, are incorporated herein by reference.

In the practice of this invention, it is contemplated that the ADS architecture may be combined with a CLEAR or like technique as required for the reduction of motion and visual artifacts. CLEAR and ADS may also be used with the slope ramp address.

SAS

In one embodiment of this invention it is contemplated using SAS electronic architecture to address a PDP panel constructed of plasma-discs. SAS architecture comprises addressing one display section of a surface discharge PDP while another section of the PDP is being simultaneously sustained. This architecture is called Simultaneous Address and Sustain (SAS). See U.S. Pat. No. 6,985,125 (Carol A. Wedding et al.), incorporated herein by reference.

SAS offers a unique electronic architecture which is different from prior art columnar discharge and surface discharge electronics architectures including ADS, AWD, and MASS. It offers important advantages as discussed herein.

In accordance with the practice of SAS with a surface discharge PDP, addressing voltage waveforms are applied to a surface discharge PDP having an array of data electrodes on a bottom or rear substrate and an array of at least two electrodes on a top or front viewing substrate, one top electrode being a bulk sustain electrode x and the other top electrode being a row scan electrode y. The row scan electrode y may also be called a row sustain electrode because it performs the dual functions of both addressing and sustaining.

An important feature and advantage of SAS is that it allows selectively addressing of one section of a surface discharge PDP with selective write and/or selective erase voltages while another section of the panel is being simultaneously sustained. A section is defined as a predetermined number of bulk sustain electrodes x and row scan electrodes y. In a surface discharge PDP, a single row is comprised of one pair of parallel top electrodes x and y.

In one embodiment of SAS, there is provided the simultaneous addressing and sustaining of at least two sections $S_1$ and $S_2$ of a surface discharge PDP having a row scan, bulk sustain, and data electrodes, which comprises addressing one section $S_1$ of the PDP while a sustaining voltage is being simultaneously applied to at least one other section $S_2$ of the PDP.

In another embodiment, the simultaneous addressing and sustaining is interlaced whereby one pair of electrodes y and x is addressed without being sustained and an adjacent pair of electrodes y and x is simultaneously sustained without being addressed. This interlacing can be repeated throughout the display. In this embodiment, a section S is defined as one or more pairs of interlaced y and x electrodes.

In the practice of SAS, the row scan and bulk sustain electrodes of one section that is being sustained may have a reference voltage which is offset from the voltages applied to the data electrodes for the addressing of another section such that the addressing does not electrically interact with the row scan and bulk sustain electrodes of the section which is being sustained.

In a plasma display in which gray scale is realized through time multiplexing, a frame or a field of picture data is divided into subfields. Each subfield is typically composed of a reset period, an addressing period, and a number of sustains. The number of sustains in a subfield corresponds to a specific gray scale weight. Pixels that are selected to be "on" in a given subfield will be illuminated proportionally to the number of sustains in the subfield. In the course of one frame, pixels may be selected to be "on" or "off" for the various subfields. A gray scale image is realized by integrating in time the various "on" and "off" pixels of each of the subfields.

Addressing is the selective application of data to individual pixels. It includes the writing or erasing of individual pixels.

Reset is a voltage pulse, which forms wall charges to enhance the addressing of a pixel. It can be of various waveform shapes and voltage amplitudes including fast or slow rise time voltage ramps and exponential voltage pulses. A reset is typically used at the start of a frame before the addressing of a section. A reset may also be used before the addressing period of a subsequent subfield.

In accordance with another embodiment of the SAS architecture, there is applied a slow rise time or slow ramp reset voltage as disclosed in U.S. Pat. No. 5,745,086 (Weber) cited above and incorporated herein by reference. As used herein slow rise time or slow ramp voltage is a bulk address commonly called a reset pulse with a positive or negative slope so as to provide a uniform wall charge at all pixels in the PDP. The slower the rise time of the reset ramp, the less visible the light or background glow from those off-pixels (not in the on-state) during the slow ramp bulk address.

Less background glow is particularly desirable for increasing the contrast ratio, which is inversely proportional to the light-output from the off pixels during the reset pulse. Those off-pixels which are not in the on-state will give a background glow during the reset. The slower the ramp, the less light output with a resulting higher contrast ratio. Typically the slow ramp reset voltages disclosed in the prior art have a slope of about 3.5 volts per microsecond with a range of about 2 to about 9 volts per microsecond. In the SAS architecture, it is possible to use slow ramp reset voltages below 2 volts per microsecond, for example about 1 to 1.5 volts per microsecond without decreasing the number of PDP rows, without decreasing the number of sustain pulses or without decreasing the number of subfields.

Positive Column Gas Discharge

In one embodiment of this invention, it is contemplated that the PDP with plasma-discs may be operated with positive column discharge. The use of plasma-discs allows the PDP to be operated with positive column gas discharge, for example as disclosed by Weber, Rutherford, and other prior art cited hereinafter and incorporated herein by reference. The discharge length inside the plasma-disc must be sufficient to accommodate the length of the positive column gas discharge. U.S. Pat. No. 6,184,848 (Weber) discloses the generation of a positive column plasma discharge wherein the plasma discharge evidences a balance of positively charged ions and electrons. The PDP discharge operates using the same fundamental principal as a fluorescent lamp, i.e., a PDP employs ultraviolet light generated by a gas discharge to excite visible light emitting phosphors. Weber discloses an inactive isolation bar.

Rutherford, James. "PDP With Improved Drive Performance at Reduced Cost." *Proceedings of the Ninth International Display Workshops*, Hiroshima, Japan (Dec. 4-6, 2002): 837-840 discloses an electrode structure and electronics for a positive column plasma display. Rutherford discloses the use of the isolation bar as an active electrode.

Additional positive column gas discharge prior art incorporated herein by reference include:

Weber, Larry F. "Positive Column AC Plasma Display." 23rd *International Display Research Conference Proceedings,* Phoenix Ariz. IDRC 03, (Sep. 16-18, 2003): 119-124

Nagorny et al. "Dielectric Properties and Efficiency of Positive Column AC PDP." 23rd *International Display Research Conference,* IDRC 03, Phoenix, Ariz. (Sep. 16-18, 2003) P-45: 300-303

Drallos et al. "Simulations of AC PDP Positive Column and Cathode Fall Efficiencies." 23rd *International Display Research Conference Proceedings,* IDRC 03, Phoenix, Ariz. (Sep. 16-18, 2003) P-48: 304-306

U.S. Pat. No. 6,376,995 (Kato et al.)

U.S. Pat. No. 6,528,952 (Kato et al.)

U.S. Pat. No. 6,693,389 (Marcotte et al.)

U.S. Pat. No. 6,768,478 (Wani et al.)

U.S. Patent Application Publication 2003/0102812 (Marcotte et al.)

Plasma-Shell Materials

The plasma-shell including plasma-sphere, plasma-disc, and plasma-dome may be constructed of any suitable material such as glass or plastic as disclosed in the prior art. In the practice of this invention, it is contemplated that the plasma-shell may be made of any suitable inorganic compounds of metals and/or metalloids, including mixtures or combinations thereof. Contemplated inorganic compounds include the oxides, carbides, nitrides, nitrates, silicates, silicides, aluminates, phosphates, sulphates, sulfides, borates and borides.

The metals and/or metalloids are selected from magnesium, calcium, strontium, barium, yttrium, lanthanum, cerium, neodymium, gadolinium, terbium, erbium, thorium, titanium, zirconium, hafnium, vanadium, niobium, tantalum, chromium, molybdenum, tungsten, manganese, rhenium, iron, ruthenium, osmium, cobalt, rhodium, iridium, nickel, copper, silver, zinc, cadmium, boron, aluminum, gallium, indium, thallium, carbon, silicon, germanium, tin, lead, phosphorus, and bismuth.

Inorganic shell materials suitable for use are magnesium oxide(s), aluminum oxide(s), zirconium oxide(s), and silicon carbide(s) such as MgO, $Al_2O_3$, $ZrO_2$, $SiO_2$, and/or SiC.

In one embodiment of this invention, the plasma-shell is made of fused particles of glass, ceramic, glass ceramic, refractory, fused silica, quartz, or like amorphous and/or crystalline materials including mixtures of such. In one preferred embodiment, a ceramic material is selected based on its transmissivity to light after firing. This may include selecting ceramics material with various optical cutoff frequencies to produce various colors. One preferred material contemplated for this application is aluminum oxide. Aluminum oxide is transmissive from the UV range to the IR range. Because it is transmissive in the UV range, phosphors excited by UV may be applied to the exterior of the plasma-shell to produce various colors. The application of the phosphor to the exterior of the plasma-shell may be done by any suitable means before or after the plasma-shell is located or positioned in the PDP, i.e., on a flexible or rigid substrate. There may be applied several layers or coatings of phosphors, each of a different composition.

In one specific embodiment of this invention, the plasma-shell is made of an aluminate silicate or contains a layer of aluminate silicate. When the ionizable gas mixture contains helium, the aluminate silicate is especially beneficial in preventing the escaping of helium. It is also contemplated that the plasma-shell may be made of lead silicates, lead phosphates, lead oxides, borosilicates, alkali silicates, aluminum oxides, and pure vitreous silica.

For secondary electron emission, the plasma-shell may be made in whole or in part from one or more materials such as magnesium oxide having a sufficient Townsend coefficient. These include inorganic compounds of magnesium, calcium, strontium, barium, gallium, lead, aluminum, boron, and the rare earths especially lanthanum, cerium, actinium, and thorium. The contemplated inorganic compounds include oxides, carbides, nitrides, nitrates, silicates, aluminates, phosphates, borates and other inorganic compounds of the above and other elements. Hexaborides of rare earths are contemplated including lanthanum hexaboride, cerium hexaboride, and gadolinium hexaboride.

The plasma-shell may also contain or be partially or wholly constructed of luminescent substances such as inorganic phosphor(s). The phosphor may be a continuous or discontinuous layer or coating on the interior or exterior of the shell. Phosphor particles may also be introduced inside the plasma-shell or embedded within the shell. Luminescent quantum dots may also be incorporated into the shell.

Secondary Electron Emission

The use of secondary electron emission (Townsend coefficient) materials in a plasma display is well known in the prior art and is disclosed in U.S. Pat. No. 3,716,742 (Nakayama et al.)

The use of Group IIA compounds including magnesium oxide is disclosed in U.S. Pat. Nos. 3,836,393 and 3,846,171, incorporated herein by reference. The use of rare earth compounds in an AC plasma display is disclosed in U.S. Pat. Nos. 4,126,807, 4,126,809, and 4,494,038, all issued to Donald K. Wedding et al., and incorporated herein by reference. Rare earth hexaborides are especially contemplated. Lead oxide may also be used as a secondary electron material. Mixtures of secondary electron emission materials may be used.

In one embodiment and mode contemplated for the practice of this invention, the secondary electron emission material is magnesium oxide on part or all of the internal surface of a plasma-shell. The secondary electron emission material may also be on the external surface. The thickness of the magnesium oxide may range from about 250 Angstrom Units (Å) to about 20,000 Angstrom Units (Å) or more. The plasma-shell may be made of a secondary electronic material such as magnesium oxide. A secondary electron material may also be dispersed or suspended as particles within the ionizable gas such as with a fluidized bed. Phosphor particles may also be dispersed or suspended in the gas such as with a fluidized bed, and may also be added to the inner or external surface of the plasma-shell.

Magnesium oxide increases the ionization level through secondary electron emission that in turn leads to reduced gas discharge voltages. In one embodiment, the magnesium oxide is on the inner surface of the plasma-shell and the phosphor is located on external surface of the plasma-shell. Magnesium oxide is susceptible to contamination. To avoid contamination, gas discharge (plasma) displays are assembled in clean rooms that are expensive to construct and maintain. In traditional plasma panel production, magnesium oxide is applied to an entire open substrate surface and is vulnerable to contamination. The adding of the magnesium oxide layer to the inside of a plasma-shell minimizes exposure of the magnesium oxide to contamination. The magnesium oxide may be applied to the inside of the plasma-shell by incorporating magnesium vapor as part of the ionizable gases introduced into the plasma-shell while the microsphere is at an elevated temperature. The magnesium may be oxidized while at an elevated temperature.

In some embodiments, the magnesium oxide may be added as particles to the gas. Other secondary electron materials may be used in place of or in combination with magnesium oxide. In one embodiment hereof, the secondary electron material such as magnesium oxide or any other selected material such as magnesium to be oxidized in situ is introduced into the gas by means of a fluidized bed. Other materials such as phosphor particles or vapor may also be introduced into the gas with a fluid bed or other means.

Ionizable Gas

The hollow plasma-shells as used in the practice of this invention contain(s) one or more ionizable gas components. In the practice of this invention, the gas is selected to emit photons in the visible, IR, and/or UV spectrum.

The UV spectrum is divided into regions. The near UV region is a spectrum ranging from about 340 nm to 450 nm (nanometers). The mid or deep UV region is a spectrum ranging from about 225 nm to 340 nm. The vacuum UV region is a spectrum ranging from about 100 nm to 225 nm. The PDP prior art has used vacuum UV to excite photoluminescent phosphors. In the practice of this invention, it is contemplated using a gas, which provides UV over the entire spectrum ranging from about 100 nm to about 450 nm. The PDP operates with greater efficiency at the higher range of the UV spectrum, such as in the mid UV and/or near UV spectrum. In one preferred embodiment, there is selected a gas which emits gas discharge photons in the near UV range. In another embodiment, there is selected a gas which emits gas discharge photons in the mid UV range. In one embodiment, the selected gas emits photons from the upper part of the mid UV range through the near UV range, about 275 nm to 450 nm.

As used herein, ionizable gas or gas means one or more gas components. In the practice of this invention, the gas is typically selected from a mixture of the noble or rare gases of neon, argon, xenon, krypton, helium, and/or radon. The rare gas may be a Penning gas mixture. Other contemplated gases include nitrogen, $CO_2$, CO, mercury, halogens, excimers, oxygen, hydrogen, and mixtures thereof. Isotopes of the above and other gases are contemplated. These include isotopes of helium such as helium-3, isotopes of hydrogen such as deuterium (heavy hydrogen), tritium ($T^3$) and DT, isotopes of the rare gases such as xenon-129, isotopes of oxygen such as oxygen-18. Other isotopes include deuterated gases such as deuterated ammonia ($ND_3$) and deuterated silane ($SiD_4$).

In one embodiment, a two-component gas mixture (or composition) is used such as a mixture of neon and argon, neon and xenon, neon and helium, neon and krypton, neon and radon, argon and xenon, argon and krypton, argon and helium, argon and radon, xenon and krypton, xenon and helium, xenon and radon, krypton and helium, krypton and radon, and helium and radon. Specific two-component gas mixtures (compositions) include about 1% to 90% atoms of argon with the balance xenon. Another two-component gas mixture is a mother gas of neon containing 0.01% to 25% atoms of xenon, argon, or krypton. This can also be a three-component gas, four-component gas, or five-component gas by using quantities of an additional gas or gases selected from xenon, argon, krypton, and/or helium. In another embodiment, a three-component ionizable gas mixture is used such as a mixture of argon, xenon, and neon wherein the mixture contains at least 5% to 80% atoms of argon, up to 15% xenon, and the balance neon. The xenon is present in a minimum amount sufficient to maintain the Penning effect. Such a mixture is disclosed in U.S. Pat. No. 4,926,095 (Shinoda et al.), incorporated herein by reference. Other three-component gas mixtures include argon-helium-xenon; krypton-neon-xenon; and krypton-helium-xenon, for example, as disclosed in U.S. Pat. No. 5,510,678 (Sakai et al.) and U.S. Pat. No. 5,559,403 (Sakai et al.), incorporated herein by reference.

U.S. Pat. No. 4,081,712 (Bode et al.), incorporated herein by reference, discloses the addition of helium to a gaseous medium of 90% to 99.99% atoms of neon and 10% to 0.01% atoms of argon, xenon, and/or krypton. In one embodiment, there is used a high concentration of helium with the balance selected from one or more gases of neon, argon, xenon, and nitrogen as disclosed in U.S. Pat. No. 6,285,129 (Park) and incorporated herein by reference. Mercury may be added to the rare gas as disclosed in U.S. Pat. No. 4,041,345 (Sahni), incorporated herein by reference.

A high concentration of xenon may also be used with one or more other gases as disclosed in U.S. Pat. No. 5,770,921 (Aoki et al.), incorporated herein by reference. Pure neon may be used and the plasma-shells operated without memory margin using the architecture disclosed by U.S. Pat. No. 3,958,151 (Yano) discussed above and incorporated herein by reference.

Excimers

Excimer gases may also be used as disclosed in U.S. Pat. No. 4,549,109 (Nighan et al.) and U.S. Pat. No. 4,703,229 (Nighan et al.), both incorporated herein by reference. Nighan et al. ('109) and ('229) disclose the use of excimer gases formed by the combination of halides with inert gases. The halides include fluorine, chlorine, bromine, and iodine. The inert gases include helium, xenon, argon, neon, krypton, and radon. Excimer gases may emit red, blue, green, or other color light in the visible range or light in the invisible range. The excimer gases may be used alone or in combination with phosphors. U.S. Pat. No. 6,628,088 (Kim et al.), incorporated herein by reference, also discloses excimer gases for a PDP.

Other Gases

Depending upon the application, a wide variety of gases are contemplated for the practice of this invention. Such other applications include gas-sensing devices for detecting radiation and radar transmissions. Such other gases include $C_2H_2$—$CF_4$—Ar mixtures as disclosed in U.S. Pat. No. 4,201,692 (Christophorou et al.) and U.S. Pat. No. 4,309,307 (Christophorou et al.), both incorporated herein by reference. Also contemplated are gases disclosed in U.S. Pat. No. 4,553,062 (Ballon et al.), incorporated herein by reference. Other gases include sulfur hexafluoride, HF, $H_2S$, $SO_2$, SO, $H_2O_2$, and so forth.

Gas Pressure

This invention allows the construction and operation of a gas discharge (plasma) display with gas pressures at or above one atmosphere. In the prior art, gas discharge (plasma) displays are operated with the ionizable gas at a pressure below atmospheric. Gas pressures above atmospheric are not used in the prior art because of structural problems. Higher gas pressures above atmospheric may cause the display substrates to separate, especially at elevations of 4000 feet or more above sea level.

In the practice of this invention, the gas pressure inside of each hollow plasma-shell may be equal to or less than atmospheric pressure or may be equal to or greater than atmospheric pressure. The typical sub-atmospheric pressure is about 150 to 760 Torr. However, pressures above atmospheric may be used depending upon the structural integrity of the plasma-shell. In one embodiment of this invention, the gas pressure inside of the plasma-shell is equal to or less than atmospheric, about 150 to 760 Ton, typically about 350 to about 650 Torr. In another embodiment of this invention, the gas pressure inside of the plasma-shell is equal to or greater than atmospheric. Depending upon the structural strength of the plasma-shell, the pressure above atmospheric may be about 1 to 250 atmospheres (760 to 190,000 Torr) or greater. Higher gas pressures increase the luminous efficiency of the plasma display.

Gas Processing

This invention avoids the costly prior art gas filling techniques used in the manufacture of gas discharge (plasma) display devices. The prior art introduces gas through one or more apertures into the device requiring a gas injection hole and tube. The prior art manufacture steps typically include heating and baking out the assembled device (before gas fill) at a high-elevated temperature under vacuum for 2 to 12 hours. The vacuum is obtained via external suction through a tube inserted in an aperture. The bake out is followed by back fill of the entire panel with an ionizable gas introduced through the tube and aperture. The tube is then sealed-off.

This bake out and gas fill process is a major production bottleneck and yield loss in the manufacture of gas discharge (plasma) display devices, requiring substantial capital equipment and a large amount of process time. For color AC plasma display panels of 40 to 50 inches in diameter, the bake out and vacuum cycle may be 10 to 30 hours per panel or 10 to 30 million hours per year for a manufacture facility producing over one million plasma display panels per year.

The gas filled plasma-shells used in this invention can be mass-produced and added to the gas discharge (plasma) display device without the necessity of costly bake out and gas process capital equipment. The savings in capital equipment cost and operations costs are substantial. Also the entire PDP does not have to be gas processed with potential yield loss at the end of the PDP manufacture.

PDP Structure

In one embodiment, the plasma-shells are located on or in a single substrate or monolithic PDP structure. Single substrate PDP structures are disclosed in U.S. Pat. No. 3,646,384 (Lay), U.S. Pat. No. 3,652,891 (Janning), U.S. Pat. No. 3,666,981 (Lay), U.S. Pat. No. 3,811,061 (Nakayama et al.), U.S. Pat. No. 3,860,846 (Mayer), U.S. Pat. No. 3,885,195 (Amano), U.S. Pat. No. 3,935,494 (Dick et al.), U.S. Pat. No. 3,964,050 (Mayer), U.S. Pat. No. 4,106,009 (Dick), U.S. Pat. No. 4,164,678 (Biazzo et al.), and U.S. Pat. No. 4,638,218 (Shinoda), all cited above and incorporated herein by reference. The plasma-shells may be positioned on the surface of the substrate and/or positioned in the substrate such as in channels, trenches, grooves, wells, cavities, hollows, and so forth. These channels, trenches, grooves, wells, cavities, hollows, etc., may extend through the substrate so that the plasma-shells positioned therein may be viewed from either side of the substrate. The plasma-shells may also be positioned on or within a substrate of a dual substrate plasma display structure. Each plasma-shell is placed inside of a gas discharge (plasma) display device, for example, on the substrate along the channels, trenches or grooves between the barrier walls of a plasma display barrier structure such as disclosed in U.S. Pat. No. 5,661,500 (Shinoda et al.), U.S. Pat. No. 5,674,553 (Shinoda et al.) and U.S. Pat. No. 5,793,158 (Wedding), cited above and incorporated herein by reference. The plasma-shells may also be positioned within a cavity, well, hollow, concavity, or saddle of a plasma display substrate, for example as disclosed by U.S. Pat. No. 4,827,186 (Knauer et al.), incorporated herein by reference.

In a device as disclosed by Wedding ('158) or Shinoda et al. ('500), the plasma-shells may be conveniently added to the substrate cavities and the space between opposing electrodes before the device is sealed. An aperture and tube can be used for bake out if needed of the space between the two opposing substrates, but the costly gas fill operation is eliminated.

AC plasma displays of 40 inches or larger are fragile with risk of breakage during in shipment and handling. The presence of the plasma-shells inside of the display device adds structural support and integrity to the device.

The plasma-shells may be sprayed, stamped, pressed, poured, screen-printed, or otherwise applied to the substrate. The substrate surface may contain an adhesive or sticky surface to bind the plasma-shell to the substrate. Typically the substrate has flat surfaces. However the practice of this invention is not limited to a flat surface display. The plasma-shell may be positioned or located on a conformal surface so as to conform to a predetermined shape such as a curved or irregular surface.

In one embodiment of this invention, each plasma-shell is positioned within a cavity on a single-substrate or monolithic gas discharge structure that has a flexible or bendable substrate. In another embodiment, the substrate is rigid. The substrate may also be partially or semi flexible.

Substrate

In accordance with various embodiments of this invention, the PDP may be comprised of a single substrate or dual substrate device with flexible, semi-flexible or rigid substrates. The substrate surface may be flat, curved or irregular. The substrate may be opaque, transparent, translucent, or non-light transmitting. In some embodiments, there may be used multiple substrates of three or more. Substrates may be flexible or bendable films, such as a polymeric film substrate. The flexible substrate may also be made of metallic materials alone or incorporated into a polymeric substrate. Alternatively or in addition, one or both substrates may be made of an optically transparent thermoplastic polymeric material. Examples of suitable such materials are polycarbonate, polyvinyl chloride, polystyrene, polymethyl methacrylate, polyurethane polyimide, polyester, and cyclic polyolefin polymers. More broadly, the substrates may include a flexible plastic such as a material selected from the group consisting of polyether sulfone (PES), polyester terephihalate, polyethylene terephihalate (PET), polyethylene naphtholate, polycarbonate, polybutylene terephihalate, polyphenylene sulfide (PPS), polypropylene, polyester, aramid, polyamide-imide (PAI), polyimide, aromatic polyimides, polyetherimide, acrylonitrile butadiene styrene, and polyvinyl chloride, as disclosed in U.S. Patent Application Publication 2004/0179145 (Jacobsen et al.), incorporated herein by reference.

Alternatively, one or both of the substrates may be made of a rigid material. For example, one or both of the substrates may be glass with a flat, curved, or irregular surface. The glass may be a conventionally available glass, for example having a thickness of approximately 0.2 mm-1 mm. Alternatively, other suitable transparent materials may be used, such as a rigid plastic or a plastic film. The plastic film may have a high glass transition temperature, for example above 65° C., and may have a transparency greater than 85% at 530 nm.

Further details regarding substrates and substrate materials may be found in International Publications Nos. WO 00/46854, WO 00/49421, WO 00/49658, WO 00/55915, and WO 00/55916, the entire disclosures of which are herein incorporated herein by reference. Apparatus, methods, and compositions for producing flexible substrates are disclosed in U.S. Pat. No. 5,469,020 (Herrick), U.S. Pat. No. 6,274,508 (Jacobsen et al.), U.S. Pat. No. 6,281,038 (Jacobsen et al.), U.S. Pat. No. 6,316,278 (Jacobsen et al.), U.S. Pat. No. 6,468,638 (Jacobsen et al.), U.S. Pat. No. 6,555,408 (Jacobsen et al.), U.S. Pat. No. 6,590,346 (Hadley et al.), U.S. Pat. No. 6,606,247 (Credelle et al.), U.S. Pat. No. 6,665,044 (Jacobsen et al.), and U.S. Pat. No. 6,683,663 (Hadley et al.), all of which are incorporated herein by reference.

Positioning of Plasma-Shell on Substrate

The plasma-shell may be positioned or located in contact with the substrate by any appropriate means. In one embodiment of this invention, the plasma-shell is bonded to the substrate surface of a monolithic or dual-substrate display such as a PDP. The plasma-shell is bonded to the substrate surface with a non-conductive, adhesive material that also serves as an insulating barrier to prevent electrically shorting of the conductors or electrodes connected to the plasma-shell.

The plasma-shell may be mounted or positioned within a substrate well, cavity, hollow, hole, or like depression. The well, cavity, hollow, hole, or depression is of suitable dimensions with a mean or average diameter and depth for receiving and retaining the plasma-shell. As used herein well includes cavity, hollow, hole, depression, hole, or any similar configuration. In U.S. Pat. No. 4,827,186 (Knauer et al.), there is shown a cavity referred to as a concavity or saddle. The depression, well or cavity may extend partly through the substrate, embedded within or extend entirely through the substrate. The cavity may comprise an elongated channel, trench, or groove extending partially or completely across the substrate.

The conductors or electrodes must be in electrical contact with each plasma-shell. An air gap between an electrode and the plasma-shell will cause high operating voltages. A material such as a conductive adhesive, and/or a conductive filler may be used to bridge or connect the electrode to the plasma-shell. Such conductive material must be carefully applied so as to not electrically short the electrode to other nearby electrodes. A dielectric material may also be applied to fill any air gap. This also may be an adhesive.

Insulating Barrier

An insulating barrier may be used to electrically separate the plasma-shells. It may also be used to bond each plasma-shell to the substrate. The insulating barrier may comprise any suitable non-conductive material, which bonds the plasma-shell to the substrate. In one embodiment, there is used an epoxy resin that is the reaction product of epichlorohydrin and bisphenol-A. One such epoxy resin is a liquid epoxy resin, D.E.R. 383, produced by the Dow Plastics group of the Dow Chemical Company.

Light Barriers

Light barriers of opaque, translucent, or non-transparent material may be located between plasma-shells to prevent optical cross-talk between plasma-shells, particularly between adjacent plasma-shells. A black light absorbing material such as carbon filler may be used. The light barrier may comprise a light reflective material.

Electrically Conductive Bonding Substance

In the practice of this invention, the conductors or electrodes are electrically connected to each plasma-shell with an electrically conductive bonding substance. This may be applied to an exterior surface of the plasma-shell, to an electrode, and/or to the substrate surface. In one embodiment, it is applied to both the plasma-shell and the electrode.

The electrically conductive bonding substance can be any suitable inorganic or organic material including compounds, mixtures, dispersions, pastes, liquids, cements, and adhesives. In one embodiment, the electrically conductive bonding substance is an organic substance with conductive filler material. Contemplated organic substances include adhesive monomers, dimers, trimers, polymers and copolymers of materials such as polyurethanes, polysulfides, silicones, and epoxies. A wide range of other organic or polymeric materials may be used. Contemplated conductive filler materials include conductive metals or metalloids such as silver, gold, platinum, copper, chromium, nickel, aluminum and carbon. The conductive filler may be of any suitable size and form such as particles, powder, agglomerates, or flakes of any suitable size and shape. It is contemplated that the particles, powder, agglomerates, or flakes may comprise a non-metal, metal or metalloid core with an outer layer, coating, or film of conductive metal.

Some specific embodiments of conductive filler materials include silver-plated copper beads, silver-plated glass beads, silver particles, silver flakes, gold-plated copper beads, gold-plated glass beads, gold particles, gold flakes, and so forth. In one particular embodiment of this invention there is used an epoxy filled with 60% to 80% by weight silver.

Examples of electrically conductive bonding substances are well known in the art. The disclosures including the compositions of the following references are incorporated herein by reference. U.S. Pat. No. 3,412,043 (Gilliland) discloses an electrically conductive composition of silver flakes and resinous binder. U.S. Pat. No. 3,983,075 (Marshall et al.) discloses a copper filled electrically conductive epoxy. U.S. Pat. No. 4,247,594 (Shea et al.) discloses an electrically conductive resinous composition of copper flakes in a resinous binder. U.S. Pat. No. 4,552,607 (Frey) and U.S. Pat. No. 4,670,339 (Frey) disclose a method of forming an electrically conductive bond using copper microspheres in an epoxy. U.S. Pat. No. 4,880,570 (Sanborn et al.) discloses an electrically conductive epoxy-based adhesive selected from the amine curing modified epoxy family with a filler of silver flakes. U.S. Pat. No. 5,183,593 (Durand et al.) discloses an electrically conductive cement comprising a polymeric carrier such as a mixture of two epoxy resins and filler particles selected from silver agglomerates, particles, flakes, and powders. The filler may be silver-plated particles such as inorganic spheroids plated with silver. Other noble metals and non-noble metals such as nickel are disclosed. U.S. Pat. No. 5,298,194 (Carter et al.) discloses an electrically conductive adhesive composition comprising a polymer or copolymer of polyolefins or polyesters filled with silver particles. U.S. Pat. No. 5,575,956 (Hermansen et al.) discloses electrically-conductive, flexible epoxy adhesives comprising a polymeric mixture of a polyepoxide resin and an epoxy resin filled with conductive metal powder, flakes, or non-metal particles having a metal outer coating. The conductive metal is a noble metal such as gold, silver, or platinum. Silver-plated copper beads and silver-plated glass beads are also disclosed. U.S. Pat. No. 5,891,367 (Basheer et al.) discloses a conductive epoxy adhesive comprising an epoxy resin cured or reacted with selected primary amines and filled with silver flakes. The primary amines provide improved impact resistance. U.S. Pat. No. 5,918,364 (Kulesza et al.) discloses substrate bumps or pads formed of electrically conductive polymers filled with gold or silver. U.S. Pat. No. 6,184,280 (Shibuta) discloses an organic polymer containing hollow carbon microfibers and an electrically conductive metal oxide powder. In another embodiment, the electrically conductive bonding substance is an organic substance without a conductive filler material. Examples of electrically conductive bonding substances are well known in the art. The disclosures including the compositions of the following references are incorporated herein by reference. Electrically conductive polymer compositions are also disclosed in U.S. Pat. No. 5,917,693 (Kono et al.), U.S. Pat. No. 6,096,825 (Garnier), and U.S. Pat. No. 6,358,438 (Isozaki et al.). The electrically conductive polymers disclosed above may also be used with conductive fillers. In some embodiments, organic ionic materials such as calcium stearate may be added to increase electrical conductivity. See U.S. Pat. No. 6,599,446 (Todt et al.), incorporated herein by reference. In one embodiment hereof, the electrically conductive bonding substance is luminescent, for example as disclosed in U.S. Pat. No. 6,558,576 (Brielmann et al.), incorporated herein by reference.

U.S. Pat. No. 5,645,764 (Angelopoulos et al.) discloses electrically conductive pressure sensitive polymers without conductive fillers. Examples of such polymers include electrically conductive substituted and unsubstituted polyanilines, substituted and unsubstituted polyparaphenylenes, substituted and unsubstituted polyparaphenylene vinylenes, substituted and unsubstituted polythiophenes, substituted and unsubstituted polyazines, substituted and unsubstituted polyfuranes, substituted and unsubstituted polypyrroles, substituted and unsubstituted polyselenophenes, substituted and unsubstituted polyphenylene sulfides and substituted and unsubstituted polyacetylenes formed from soluble precursors. Blends of these polymers are suitable for use as are copolymers made from the monomers, dimers, or trimers, used to form these polymers.

EMI/RFI Shielding

In some embodiments, electroconductive bonding substances may be used for EMI (electromagnetic interference) and/or RFI (radio-frequency interference) shielding. Examples of such EMI/RFI shielding are disclosed in U.S. Pat. No. 5,087,314 (Sandborn et al.) and U.S. Pat. No. 5,700,398 (Angelopoulos et al.), both incorporated herein by reference.

Electrodes

One or more hollow plasma-shells containing the ionizable gas are located within the display panel structure, each plasma-shell being in contact with at least two electrodes. In accordance with one embodiment of this invention, the contact is augmented with a supplemental electrically conductive bonding substance applied to each plasma-shell, to each electrode, and/or to the PDP substrates so as to form an electrically conductive pad connection to the electrodes. A dielectric substance may also be used in lieu of or in addition to the conductive substance. Each conductive pad may partially cover an outside shell surface of the plasma-shell. The electrodes and pads may be of any geometric shape or configuration. In one embodiment the electrodes are opposing arrays of electrodes, one array of electrodes being transverse or orthogonal to an opposing array of electrodes. The electrode arrays can be parallel, zig zag, serpentine, or like pattern as typically used in dot-matrix gas discharge (plasma) displays. The use of split or divided electrodes is contemplated as disclosed in U.S. Pat. No. 3,603,836 (Grier) and U.S. Pat. No. 3,701,184 (Grier), incorporated herein by reference. Apertured electrodes may be used as disclosed in U.S. Pat. No. 6,118,214 (Marcotte), U.S. Pat. No. 5,411,035 (Marcotte) and U.S. Patent Application Publication 2004/0001034 (Marcotte), all incorporated herein by reference. The electrodes are of any suitable conductive metal or alloy including gold, silver, aluminum, or chrome-copper-chrome. If a transparent electrode is used on the viewing surface, this is typically indium tin oxide (ITO) or tin oxide with a conductive side or edge bus bar of silver. Other conductive bus bar materials may be used such as gold, aluminum, or chrome-copper-chrome. The electrodes may partially cover the external surface of the plasma-shell.

The electrode array may be divided into two portions and driven from both sides with a so-called dual scan architecture as disclosed by Dr. Thomas J. Pavliscak in U.S. Pat. Nos. 4,233,623 and 4,320,418, both incorporated herein by reference.

A flat plasma-shell surface is particularly suitable for connecting electrodes to the plasma-shell. If one or more electrodes connect to the bottom of plasma-shell, a flat bottom surface is desirable. Likewise, if one or more electrodes connect to the top or sides of the plasma-shell, it is desirable for the connecting surface of such top or sides to be flat.

The electrodes may be applied to the substrate and/or to the plasma-shells by thin film methods such as vapor phase deposition, e-beam evaporation, sputtering, conductive doping, electrode plating, etc. or by thick film methods such as screen printing, ink jet printing, etc.

In a matrix display, the electrodes in each opposing transverse array are transverse to the electrodes in the opposing array so that each electrode in each array forms a crossover with an electrode in the opposing array, thereby forming a multiplicity of crossovers. Each crossover of two opposing electrodes forms a discharge point or cell. At least one hollow plasma-shell containing ionizable gas is positioned in the gas discharge (plasma) display device at the intersection of at least two opposing electrodes. When an appropriate voltage potential is applied to an opposing pair of electrodes, the ionizable gas inside of the plasma-shell at the crossover is energized and a gas discharge occurs. Photons of light in the visible and/or invisible range are emitted by the gas discharge.

Shell Geometry

As discussed herein the plasma-shells may be of any suitable volumetric shape or geometric configuration to encapsulate the ionizable gas independently of the PDP or PDP substrate. The thickness of the wall of each hollow plasma-shell must be sufficient to retain the gas inside, but thin enough to allow passage of photons emitted by the gas discharge. The wall thickness of the plasma-shell should be kept as thin as practical to minimize photon absorption, but thick enough to retain sufficient strength so that the plasma-shells can be easily handled and pressurized.

The dimensions of the plasma-discs may be varied for different luminescent substances such as phosphor to achieve color balance. Such dimensions include diameter, length, width, and so forth. Thus for a gas discharge display embodiment having phosphors which emit red, green, and blue light in the visible range, the plasma-discs for the red phosphor may have flat side length and/or width dimensions less than the flat side length and/or width dimensions of the plasma-discs for the green or blue phosphor. Typically the flat side length of the red phosphor plasma-disc is about 80% to 95% of the flat side length of the green phosphor plasma-disc.

The flat side length and/or width dimensions of the blue phosphor plasma-discs may be greater than the flat side length and/or width dimensions of the red or green phosphor plasma-discs. Typically the plasma-disc flat side length for the blue phosphor is about 105% to 125% of the plasma-disc flat side length for the green phosphor and about 110% to 155% of the flat side length of the red phosphor.

In another embodiment using a high brightness green phosphor, the red and green plasma-disc may be reversed such that the flat side length of the green phosphor plasma-disc is about 80% to 95% of the flat side length of the red phosphor plasma-disc. In this embodiment, the flat side length of the blue plasma-disc is 105% to 125% of the flat side length for the red phosphor and about 110% to 155% of the flat side length of the green phosphor.

The red, green, and blue plasma-discs may also have different dimensions so as to enlarge voltage margin and improve luminance uniformity as disclosed in U.S. Patent Application Publication 2002/0041157 (Heo), incorporated herein by reference. The widths of the corresponding electrodes for each RGB plasma-disc may be of different dimensions such that an electrode is wider or narrower for a selected phosphor as disclosed in U.S. Pat. No. 6,034,657 (Tokunaga et al.), incorporated herein by reference. There also may be used combinations of different geometric shapes for different colors. Thus there may be used a square cross section plasma-disc for one color, a circular cross-section for another color, and another geometric cross section for a third color. A combination of different plasma-shells, i.e., plasma-spheres, plasma-discs, and plasma-domes, for different color pixels in a PDP may be used.

Organic Luminescent Substances

Organic luminescent substances or materials such as organic phosphors may be used alone or in combination with inorganic luminescent substances. Contemplated combinations include mixtures and/or selective layers of organic and inorganic substances. In accordance with one embodiment of this invention, an organic luminescent substance is located in close proximity to the enclosed gas discharge within a plasma-shell, so as to be excited by photons from the enclosed gas discharge.

In accordance with one preferred embodiment of this invention, an organic photoluminescent substance is positioned on at least a portion of the external surface of a plasma-shell, so as to be excited by photons from the gas discharge within the plasma-shell, such that the excited photoluminescent substance emits visible and/or invisible light.

As used herein organic luminescent substance comprises one or more organic compounds, monomers, dimers, trimers, polymers, copolymers, or like organic materials, which emit visible and/or invisible light when excited by photons from the gas discharge inside of the plasma-shell. Such organic luminescent substance may include one or more organic photoluminescent phosphors selected from organic photoluminescent compounds, organic photoluminescent monomers, dimers, trimers, polymers, copolymers, organic photoluminescent dyes, organic photoluminescent dopants and/or any other organic photoluminescent substance. All are collectively referred to herein as organic photoluminescent phosphor.

Organic photoluminescent phosphor substances contemplated herein include those organic light emitting diodes or devices (OLED) and organic electroluminescent (EL) materials, which emit light when excited by photons from the gas discharge of a gas plasma discharge. OLED and organic EL substances include the small molecule organic EL and the large molecule or polymeric OLED.

Small molecule organic EL substances are disclosed in U.S. Pat. No. 4,720,432 (VanSlyke et al.), U.S. Pat. No. 4,769,292 (Tang et al.), U.S. Pat. No. 5,151,629 (VanSlyke), U.S. Pat. No. 5,409,783 (Tang et al.), U.S. Pat. No. 5,645,948 (Shi et al.), U.S. Pat. No. 5,683,823 (Shi et al.), U.S. Pat. No. 5,755,999 (Shi et al.), U.S. Pat. No. 5,908,581 (Chen et al.), U.S. Pat. No. 5,935,720 (Chen et al.), U.S. Pat. No. 6,020,078 (Chen et al.), and U.S. Pat. No. 6,069,442 (Hung et al.), U.S. Pat. No. 6,348,359 (VanSlyke), and U.S. Pat. No. 6,720,090 (Young et al.), all incorporated herein by reference. The small molecule organic light emitting devices may be called SMOLED.

Large molecule or polymeric OLED substances are disclosed in U.S. Pat. No. 5,247,190 (Friend et al.), U.S. Pat. No. 5,399,502 (Friend et al.), U.S. Pat. No. 5,540,999 (Yamamoto et al.), U.S. Pat. No. 5,900,327 (Pei et al.), U.S. Pat. No. 5,804,836 (Heegar et al.), U.S. Pat. No. 5,807,627 (Friend et al.), U.S. Pat. No. 6,361,885 (Chou), and U.S. Pat. No. 6,670,645 (Grushin et al.), all incorporated herein by reference. The polymer light emitting devices may be called PLED. Organic luminescent substances also include OLEDs doped with phosphorescent compounds as disclosed in U.S. Pat. No. 6,303,238 (Thompson et al.), incorporated herein by reference. Organic photoluminescent substances are also disclosed in U.S. Patent Application Publication Nos. 2002/0101151 (Choi et al.), 2002/0063525 (Choi et al.), 2003/0003225 (Choi et al.), and 2003/0052596 (Yi et al.); U.S. Pat. No. 6,610,554 (Yi et al.) and U.S. Pat. No. 6,692,326 (Choi et al.); and International Publications WO 02/104077 and WO 03/046649, all incorporated herein by reference.

In one embodiment of this invention, the organic luminescent phosphorous substance is a color-conversion-media (CCM) that converts light (photons) emitted by the gas discharge to visible or invisible light. Examples of CCM substances include the fluorescent organic dye compounds.

In another embodiment, the organic luminescent substance is selected from a condensed or fused ring system such as a perylene compound, a perylene based compound, a perylene derivative, a perylene based monomer, dimer or trimer, a perylene based polymer, and/or a substance doped with a perylene.

Photoluminescent perylene phosphor substances are widely known in the prior art. U.S. Pat. No. 4,968,571 (Gruenbaum et al.), incorporated herein by reference, discloses photoconductive perylene materials, which may be used as photoluminescent phosphorous substances. U.S. Pat. No. 5,693,808 (Langhals), incorporated herein by reference, discloses the preparation of luminescent perylene dyes. U.S. Patent Application Publication 2004/0009367 (Hatwar), incorporated herein by reference, discloses the preparation of luminescent substances doped with fluorescent perylene dyes. U.S. Pat. No. 6,528,188 (Suzuki et al.), incorporated herein by reference, discloses the preparation and use of luminescent perylene compounds.

These condensed or fused ring compounds are conjugated with multiple double bonds and include monomers, dimers, trimers, polymers, and copolymers. In addition, conjugated aromatic and aliphatic organic compounds are contemplated including monomers, dimers, trimers, polymers, and copolymers. Conjugation as used herein also includes extended conjugation. A material with conjugation or extended conjugation absorbs light and then transmits the light to the various conjugated bonds. Typically the number of conjugate-double bonds ranges from about 4 to about 15. Further examples of conjugate-bonded or condensed/fused benzene rings are disclosed in U.S. Pat. No. 6,614,175 (Aziz et al.) and U.S. Pat. No. 6,479,172 (Hu et al.), both incorporated herein by reference. U.S. Patent Application Publication 2004/0023010 (Bulovic et al.) discloses luminescent nanocrystals with organic polymers including conjugated organic polymers. Cumulene is conjugated only with carbon and hydrogen atoms. Cumulene becomes more deeply colored as the conjugation is extended. Other condensed or fused ring luminescent compounds may also be used including naphthalimides, substituted naphthalimides, naphthalimide monomers, dimers, trimers, polymers, copolymers and derivatives thereof including naphthalimide diester dyes such as disclosed in U.S. Pat. No. 6,348,890 (Likavec et al.), incorporated herein by reference.

The organic luminescent substance may be an organic lumophore, for example as disclosed in U.S. Pat. No. 5,354,825 (Klainer et al.), U.S. Pat. No. 5,480,723 (Klainer et al.), U.S. Pat. No. 5,700,897 (Klainer et al.), and U.S. Pat. No. 6,538,263 (Park et al.), all incorporated herein by reference. Also lumophores are disclosed in Shaheen, S. E. et al. *Journal of Applied Physics* Vol. 84, Number 4 (Aug. 15, 1998): 2324-2327; Anderson, J. D. et al. *Journal American Chemical Society* Vol. 120 (1998): 9646-9655; and Lee, Gyu Hyun et al. *Bulletin of Korean Chemical Society* Vol. 23, No. 3 (2002): 528-530, all incorporated herein by reference. The organic luminescent substance may be applied by any suitable method to the external surface of the plasma-shell, to the substrate or to any location in close proximity to the gas discharge contained within the plasma-shell.

Such methods include thin film deposition methods such as vapor phase deposition, sputtering and E-beam evaporation. Also thick film or application methods may be used such as screen-printing, ink jet printing, and/or slurry techniques. Small size molecule OLED materials are typically deposited upon the external surface of the plasma-shell by thin film deposition methods such as vapor phase deposition or sputtering. Large size molecule or polymeric OLED materials are deposited by so called thick film or application methods such as screen-printing, ink jet, and/or slurry techniques. If the organic luminescent substance such as a photoluminescent phosphor is applied to the external surface of the plasma-shell, it may be applied as a continuous or discontinuous layer or coating such that the plasma-shell is completely or partially covered with the luminescent substance.

Selected Specific Organic Luminescent Substance Embodiments and Applications

The following are some specific embodiments using an organic luminescent substance or materials such as a luminescent phosphor.

Color Plasma Displays Using UV 300 nm to 380 nm Excitation with Organic Phosphors The organic luminescent substance such as an organic phosphor may be excited by UV ranging from about 300 nm to about 380 nm to produce red, blue, or green emission in the visible range. The encapsulated gas is chosen to excite in this range.

To improve life, the organic phosphor should be separated from the plasma discharge. This may be done by applying the organic phosphor to the exterior of the shell. In this case, it is important that the shell material be selected such that it is transmissive to UV in the range of about 300 nm to about 380 nm. Suitable materials include aluminum oxides, silicon oxides, and other such materials. In the case where helium is used in the gas mixture, aluminum oxide is a desirable shell material as it does not allow the helium to permeate.

Color Plasma Displays Using UV Excitation Below 300 nm with Organic Phosphors

Organic phosphors may be excited by UV below 300 nm. In this case, a xenon neon mixture of gases may produce excitation at 147 nm and 172 nm. The plasma-shell material must be transmissive below 300 nm. Shell materials that are transmissive to frequencies below 300 nm include silicon oxide. The thickness of the shell material must be minimized in order to maximize transmissivity.

Color Plasma Displays Using Visible Blue Above 380 nm with Organic Phosphors

Organic phosphors may be excited by excitation above 380 nm. The plasma-shell material is composed completely or partially of an inorganic blue phosphor such as BAM. The shell material fluoresces blue and may be up-converted to red or green with organic phosphors on the outside of the shell.

Infrared Plasma Displays

In some applications it may be desirable to have PDP displays with plasma-shells that produce emission in the infrared range. This may be done with up-conversion or down-conversion phosphors.

Application of Organic Phosphors

Organic phosphors may be added to a UV curable medium and applied to the plasma-shell with a variety of methods including jetting, spraying, brushing, sheet transfer methods, spin coating, dip coating, or screen printing. Thin film deposition processes are contemplated including vapor phase deposition and thin film sputtering at temperatures that do not degrade the organic material. This may be done before or after the plasma-shell is added to a substrate or back plate.

Application of Phosphor Before Plasma-Shells are Added to Substrate

If organic phosphors are applied to the plasma-shells before such are applied to the substrate, additional steps may be necessary to place each plasma-shell in the correct position on the back substrate.

Application of Phosphor after Plasma-Shells are Added to Substrate

If the organic phosphor is applied to the plasma-shells after such are placed on a substrate, care must be take to align the appropriate phosphor color with the appropriate plasma-shell.

Application of Phosphor after Plasma-Shells are Added to Substrate Self-Aligning In one embodiment, the plasma-shells may be used to cure the phosphor. A single color organic phosphor is completely applied to the entire substrate containing the plasma-shells. Next the plasma-shells are selectively activated to produce UV to cure the organic phosphor. The phosphor will cure on the plasma-shells that are activated and may be rinsed away from the plasma-shells that were not activated. Additional applications of phosphor of different colors may be applied using this method to coat the remaining shells. In this way the process is completely self-aligning.

Inorganic Luminescent Substances

Inorganic luminescent substances or materials such as phosphors may be used alone or in combination with organic luminescent substances. Contemplated combinations including mixtures and/or selective layers of organic and/or inorganic substances. The shell may be made of organic and/or inorganic luminescent substance. In one embodiment the inorganic luminescent substance is incorporated into the particles forming the shell structure. Typical inorganic luminescent substances are listed below.

Green Phosphor

A green light-emitting phosphor may be used alone or in combination with other light-emitting phosphors such as blue or red. Phosphor materials which emit green light include $Zn_2SiO_4$:Mn, ZnS:Cu, ZnS:Au, ZnS:Al, ZnO:Zn, CdS:Cu, CdS:$Al_2$, $Cd_2O_2S$:Tb, and $Y_2O_2S$:Tb. In one mode and embodiment of this invention using a green light-emitting phosphor, there is used a green light-emitting phosphor selected from the zinc orthosilicate phosphors such as $ZnSiO_4:Mn^{2+}$. Green light emitting zinc orthosilicates including the method of preparation are disclosed in U.S. Pat. No. 5,985,176 (Rao), which is incorporated herein by reference. These phosphors have a broad emission in the green region when excited by 147 nm and 173 nm (nanometers) radiation from the discharge of a xenon gas mixture. In another mode and embodiment of this invention there is used a green light-emitting phosphor which is a terbium activated yttrium gadolinium borate phosphor such as (Gd, Y) $BO_3$: $Tb^{3+}$. Green light-emitting borate phosphors including the method of preparation are disclosed in U.S. Pat. No. 6,004,481 (Rao), which is incorporated herein by reference. In another mode and embodiment there is used a manganese activated alkaline earth aluminate green phosphor as disclosed in U.S. Pat. No. 6,423,248 (Rao), peaking at 516 nm when excited by 147 and 173 nm radiation from xenon. The particle size ranges from 0.05 to 5 microns. Rao ('248) is incorporated herein by reference. Terbium doped phosphors may emit in the blue region especially in lower concentrations of terbium. For some display applications such as television, it is desirable to have a single peak in the green region at 543 nm. By incorporating a blue absorption dye in a filter, any blue peak can be eliminated. Green light-emitting terbium-activated lanthanum cerium orthophosphate phosphors are disclosed in U.S. Pat. No. 4,423,349 (Nakajima et al.), which is incorporated herein by reference. Green light-emitting lanthanum cerium terbium phosphate phosphors are disclosed in U.S. Pat. No. 5,651,920, which is incorporated herein by reference. Green light-emitting phosphors may also be selected from the trivalent rare earth ion-containing aluminate phosphors as disclosed in U.S. Pat. No. 6,290,875 (Oshio et al.).

Blue Phosphor

A blue light-emitting phosphor may be used alone or in combination with other light-emitting phosphors such as green or red. Phosphor materials which emit blue light include ZnS:Ag, ZnS:Cl, and CsI:Na. In a preferred mode and embodiment of this invention, there is used a blue light-emitting aluminate phosphor. An aluminate phosphor which emits blue visible light is divalent europium ($Eu^{2+}$) activated Barium Magnesium Aluminate (BAM) represented by $BaMgAl_{10}O_{17}:Eu^{2+}$. BAM is widely used as a blue phosphor in the PDP industry.

BAM and other aluminate phosphors which emit blue visible light are disclosed in U.S. Pat. No. 5,611,959 (Kijima et al.) and U.S. Pat. No. 5,998,047 (Bechtel et al.), both incorporated herein by reference. The aluminate phosphors may also be selectively coated as disclosed by Bechtel et al. ('047). Blue light-emitting phosphors may be selected from a number of divalent europium-activated aluminates such as disclosed in U.S. Pat. No. 6,096,243 (Oshio et al.) incorporated herein by reference. The preparation of BAM phosphors for a PDP is also disclosed in U.S. Pat. No. 6,045,721 (Zachau et al.), incorporated herein by reference.

In another mode and embodiment of this invention, the blue light-emitting phosphor is thulium activated lanthanum phosphate with trace amounts of $Sr^{2+}$ and/or $Li^{+}$. This exhibits a narrow band emission in the blue region peaking at 453 nm when excited by 147 nm and 173 nm radiation from the discharge of a xenon gas mixture. Blue light-emitting phosphate phosphors including the method of preparation are disclosed in U.S. Pat. No. 5,989,454 (Rao), which is incorporated herein by reference.

In a best mode and embodiment of this invention using a blue-emitting phosphor, a mixture or blend of blue emitting phosphors is used such as a blend or complex of about 85% to 70% by weight of a lanthanum phosphate phosphor activated by trivalent thulium ($Tm^{3+}$), $Li^{+}$, and an optional amount of an alkaline earth element ($AE^{2+}$) as a coactivator and about 15% to 30% by weight of divalent europium-activated BAM phosphor or divalent europium-activated Barium Magnesium, Lanthanum Aluminated (BLAMA) phosphor. Such a mixture is disclosed in U.S. Pat. No. 6,187,225 (Rao), incorporated herein by reference. A blue BAM phosphor with partially substituted $Eu^{2+}$ is disclosed in U.S. Pat. No. 6,833,672 (Aoki et al.) and is also incorporated herein by reference.

Blue light-emitting phosphors also include $ZnO.Ga_2O_3$ doped with Na or Bi. The preparation of these phosphors is disclosed in U.S. Pat. No. 6,217,795 (Yu et al.) and U.S. Pat. No. 6,322,725 (Yu et al.), both incorporated herein by reference. Other blue light-emitting phosphors include europium activated strontium chloroapatite and europium-activated strontium calcium chloroapatite.

Red Phosphor

A red light-emitting phosphor may be used alone or in combination with other light-emitting phosphors such as green or blue. Phosphor materials which emit red light include $Y_2O_2S$:Eu and $Y_2O_3S$:Eu. In a best mode and embodiment of this invention using a red-emitting phosphor, there is used a red light-emitting phosphor which is an europium activated yttrium gadolinium borate phosphor such as $(Y,Gd)BO_3:Eu^{3+}$. The composition and preparation of these red-emitting borate phosphors is disclosed in U.S. Pat. No. 6,042,747 (Rao) and U.S. Pat. No. 6,284,155 (Rao), both incorporated herein by reference. These europium activated yttrium, gadolinium borate phosphors emit an orange line at 593 nm and red emission lines at 611 nm and 627 nm when excited by 147 nm and 173 nm UV radiation from the discharge of a xenon gas mixture. For television (TV) applications, it is preferred to have only the red emission lines (611 nm and 627 nm). The orange line (593 nm) may be minimized or eliminated with an external optical filter. A wide range of red-emitting phosphors are used in the PDP industry and are contemplated in the practice of this invention including europium-activated yttrium oxide.

Other Phosphors

There also may be used phosphors other than red, blue, green such as a white light-emitting phosphor, pink light-emitting phosphor or yellow light-emitting phosphor. These may be used with an optical filter. Phosphor materials which emit white light include calcium compounds such as $3Ca_3(PO_4)_2$.CaF:sb, $3Ca_3(PO_4)_2$.CaF:Mn, $3Ca_3(PO_4)_2$.CaCl:Sb, and $3Ca_3(PO_4)_2$.CaCl:Mn. White-emitting phosphors are disclosed in U.S. Pat. No. 6,200,496 (Park et al.) incorporated herein by reference. Pink-emitting phosphors are disclosed in U.S. Pat. No. 6,200,497 (Park et al.) incorporated herein by reference. Phosphor material which emits yellow light include ZnS:Au.

Organic and Inorganic Luminescent Substances

Inorganic and organic luminescent substances may be used in selected combinations. In one embodiment, multiple layers of luminescent substances are applied to the plasma-shell with at least one layer being organic and at least one layer being inorganic. An inorganic layer may serve as a protective overcoat for an organic layer.

In another embodiment, the shell of the plasma-shell comprises or contains inorganic luminescent substance. In another embodiment, organic and inorganic luminescent substances are mixed together and applied as a layer inside or outside the shell. The shell may also be made of or contain a mixture of organic and inorganic luminescent substances. In one preferred embodiment, a mixture of organic and inorganic substance is applied outside the shell.

Photon Exciting of Luminescent Substance

In one embodiment contemplated in the practice of this invention, a layer, coating, or particles of inorganic and/or organic luminescent substances such as phosphor is located on part or all of the exterior wall surfaces of the plasma-shell. The photons of light pass through the shell or wall(s) of the plasma-shell and excite the organic or inorganic photoluminescent phosphor located outside of the plasma-shell. Typically this is red, blue, or green light. However, phosphors may be used which emit other light such as white, pink, or yellow light. In some embodiments, the emitted light may not be visible to the human eye. Up-conversion or down-conversion phosphors may be used.

The phosphor may be located on the side wall(s) of a channel, trench, barrier, groove, cavity, well, hollow or like structure of the discharge space. The gas discharge within the channel, trench, barrier, groove, cavity, well or hollow produces photons that excite the inorganic and/or organic phosphor such that the phosphor emits light in a range visible to the human eye.

In prior art AC plasma display structures as disclosed in U.S. Pat. No. 5,793,158 (Wedding) and U.S. Pat. No. 5,661,500 (Shinoda), inorganic and/or organic phosphor is located on the wall(s) or side(s) of the barriers that form the channel, trench, groove, cavity, well, or hollow, phosphor may also be located on the bottom of the channel, trench or groove as disclosed by Shinoda et al. ('500) or the bottom cavity, well, or hollow as disclosed by U.S. Pat. No. 4,827,186 (Knauer et al.). The plasma-shells are positioned within or along the walls of a channel, barrier, trench, groove, cavity, well or hollow so as to be in close proximity to the phosphor such that photons from the gas discharge within the plasma-shell cause the phosphor along the wall(s), side(s) or at the bottom of the channel, barrier, trenches groove, cavity, well, or hollow, to emit light.

In one embodiment of this invention, phosphor is located on the outside surface of each plasma-shell. In this embodiment, the outside surface is at least partially covered with phosphor that emits light in the visible or invisible range when excited by photons from the gas discharge within the plasma-shell. The phosphor may emit light in the visible, UV, and/or IR range.

In one embodiment, phosphor is dispersed and/or suspended within the ionizable gas inside each plasma-shell. In such an embodiment, the phosphor particles are sufficiently small such that most of the phosphor particles remain suspended within the gas and do not precipitate or otherwise substantially collect on the inside wall of the plasma-shell. The average diameter of the dispersed and/or suspended phosphor particles is less than about 1 micron, typically less than 0.1 microns. Larger particles can be used depending on the size of the plasma-shell. The phosphor particles may be introduced by means of a fluidized bed.

The luminescent substance such as an inorganic and/or organic luminescent phosphor may be located on all or part of the external surface of the plasma-shells on all or part of the internal surface of the plasma-shells. The phosphor may comprise particles dispersed or floating within the gas. In another embodiment, the luminescent substance is incorporated into the shell of the plasma-shell.

The inorganic and/or organic luminescent substance is located on the external surface and is excited by photons from the gas discharge inside the plasma-shell. The phosphor emits light in the visible range such as red, blue, or green light. Phosphors may be selected to emit light of other colors such as white, pink, or yellow. The phosphor may also be selected to emit light in non-visible ranges of the spectrum. Optical filters may be selected and matched with different phosphors.

The phosphor thickness is sufficient to absorb the UV, but thin enough to emit light with minimum attenuation. Typically the phosphor thickness is about 2 to 40 microns, preferably about 5 to 15 microns. In one embodiment, dispersed or floating particles within the gas are typically spherical or needle shaped having an average size of about 0.01 to 5 microns.

A UV photoluminescent phosphor is excited by UV in the range of 50 to 400 nanometers. The phosphor may have a protective layer or coating which is transmissive to the excitation UV and the emitted visible light. Such include organic films such as perylene or inorganic films such as aluminum oxide or silica. Protective overcoats are disclosed and discussed below. Because the ionizable gas is contained within a multiplicity of plasma-shells, it is possible to provide a custom gas mixture or composition at a custom pressure in each plasma-shell for each phosphor. In the prior art, it is necessary to select an ionizable gas mixture and a gas pressure that is optimum for all phosphors used in the device such as red, blue, and green phosphors. However, this requires trade-offs because a particular gas mixture may be optimum for a particular green phosphor, but less desirable for red or blue phosphors. In addition, trade-offs are required for the gas pressure. In the practice of this invention, an optimum gas mixture and an optimum gas pressure may be provided for each of the selected phosphors. Thus the gas mixture and gas pressure inside each plasma-shells may be optimized with a custom gas mixture and a custom gas pressure, each or both optimized for each phosphor emitting red, blue, green, white, pink, or yellow light in the visible range or light in the invisible range. The diameter and the wall thickness of the plasma-shell can also be adjusted and optimized for each phosphor. Depending upon the Paschen Curve (pd v. voltage) for the particular ionizable gas mixture, the operating voltage may be decreased by optimized changes in the gas mixture, gas pressure, and the dimensions of the plasma-shell including the distance between electrodes.

Up-Conversion

In another embodiment of this invention it is contemplated using an inorganic and/or organic luminescent substance such as a Stokes phosphor for up-conversion, for example to convert infrared radiation to visible light. Up-conversion or Stokes materials include phosphors as disclosed in U.S. Pat. No. 3,623,907 (Watts), U.S. Pat. No. 3,634,614 (Geusic), U.S. Pat. No. 5,541,012 (Ohwaki et al.), U.S. Pat. No. 6,265,825 (Asano), and U.S. Pat. No. 6,624,414 (Glesener), all incorporated herein by reference. Up-conversion may also be obtained with shell compositions such as thulium doped silicate glass containing oxides of Si, Al, and La, as disclosed in U.S. Patent Application Publication 2004/0037538 (Schardt et al.), incorporated herein by reference. The glasses of Schardt et al. emit visible or UV light when excited by IR. Glasses for up-conversion are also disclosed in Japanese Patent Nos. 9054562 and 9086958 (Akira et al.), both incorporated herein by reference.

U.S. Pat. No. 5,166,948 (Gavrilovic) discloses an up-conversion crystalline structure. U.S. Pat. No. 6,726,992 (Yadav et al.) discloses nano-engineered luminescent substances including both Stokes and Anti-Stokes down-conversion phosphors. It is contemplated that the plasma-shell may be constructed wholly or in part from an up-conversion material, down-conversion material or a combination of both.

Down-Conversion

The luminescent substance may also include down-conversion (Anti-Stokes) materials such as phosphors as disclosed in U.S. Pat. No. 3,838,307 (Masi), incorporated herein by reference. Down-conversion luminescent substances are also disclosed in U.S. Pat. No. 6,013,538 (Burrows et al.), U.S. Pat. No. 6,091,195 (Forrest et al.), U.S. Pat. No. 6,208,791 (Bischel et al.), U.S. Pat. No. 6,566,156 (Sturm et al.) and U.S. Pat. No. 6,650,045 (Forrest et al.). Down-conversion luminescent substances are also disclosed in U.S. Patent Application Publications 2004/0159903 and 2004/0196538 (Burgener, I I et al.), 2005/0093001 (Liu et al.) and 2005/0094109 (Sun et al.). Anti-Stokes phosphors are also disclosed in European Patent 0143034 (Maestro et al.), which is also incorporated herein by reference. As noted above, the plasma-shell may be constructed wholly or in part from a down-conversion substance, up-conversion substance or a combination of both.

Quantum Dots

In one embodiment of this invention, the luminescent substance is a quantum dot material. Examples of luminescent quantum dots are disclosed in International Publication Numbers WO 03/038011, WO 00/029617, WO 03/038011, WO 03/100833, and WO 03/037788, all incorporated herein by reference. Luminescent quantum dots are also disclosed in U.S. Pat. No. 6,468,808 (Nie et al.), U.S. Pat. No. 6,501,091 (Bawendi et al.), U.S. Pat. No. 6,698,313 (Park et al.), and U.S. Patent Application Publication 2003/0042850 (Bertram et al.), all incorporated herein by reference. The quantum dots may be added or incorporated into the plasma-shell during shell formation or after the shell is formed.

Protective Overcoat

In a preferred embodiment, the luminescent substance is located on an external surface of the plasma-shell. Organic luminescent phosphors are particularly suitable for placing on the exterior shell surface, but may require a protective overcoat. The protective overcoat may be inorganic, organic, or a combination of inorganic and organic. This protective overcoat may be an inorganic and/or organic luminescent substance.

The luminescent substance may have a protective overcoat such as a clear or transparent acrylic compound including acrylic solvents, monomers, dimers, trimers, polymers, copolymers, and derivatives thereof to protect the luminescent substance from direct or indirect contact or exposure with environmental conditions such as air, moisture, sunlight, handling, or abuse. The selected acrylic compound is of a viscosity such that it can be conveniently applied by spraying, screen print, ink jet, or other convenient methods so as to form a clear film or coating of the acrylic compound over the luminescent substance.

Other organic compounds may also be suitable as protective overcoats including silanes such as glass resins. Also the polyesters such as Mylar® may be applied as a spray or a sheet fused under vacuum to make it wrinkle free. Polycarbonates may be used but may be subject to UV absorption and detachment.

In one embodiment hereof the luminescent substance is coated with a film or layer of a perylene compound including monomers, dimers, trimers, polymers, copolymers, and derivatives thereof. The perylene compounds are widely used as protective films. Specific compounds including polymonochloro-para-xylyene (Parylene C) and poly-para-xylylene (Parylene N). Parylene polymer films are also disclosed in U.S. Pat. No. 5,879,808 (Wary et al.) and U.S. Pat. No. 6,586,048 (Welch et al.), both incorporated herein by reference. The perylene compounds may be applied by ink jet printing, screen printing, spraying, and so forth as disclosed in U.S. Patent Application Publication 2004/0032466 (Deguchi et al.), incorporated herein by reference. Parylene conformal coatings are covered by Mil-I-46058C and ISO 9002. Parylene films may also be induced into fluorescence by an active plasma as disclosed in U.S. Pat. No. 5,139,813 (Yira et al.), incorporated herein by reference.

Phosphor overcoats are also disclosed in U.S. Pat. No. 4,048,533 (Hinson et al.), U.S. Pat. No. 4,315,192 (Skwirut et al.), U.S. Pat. No. 5,592,052 (Maya et al.), U.S. Pat. No. 5,604,396 (Watanabe et al.), U.S. Pat. No. 5,793,158 (Wedding), and U.S. Pat. No. 6,099,753 (Yoshimura et al.), all incorporated herein by reference. In some embodiments, the luminescent substance is selected from materials that do not degrade when exposed to oxygen, moisture, sunlight, etc. and that may not require a protective overcoat. Such include various organic luminescent substances such as the perylene compounds disclosed above. For example, perylene compounds may be used as protective overcoats and thus do not require a protective overcoat.

Tinted Plasma-shells

In the practice of this invention, the plasma-shell may be color tinted or constructed of materials that are color tinted with red, blue, green, yellow, or like pigments. This is disclosed in U.S. Pat. No. 4,035,690 (Roeber) cited above and incorporated herein by reference. The gas discharge may also emit color light of different wavelengths as disclosed in Roeber ('690). The use of tinted materials and/or gas discharges emitting light of different wavelengths may be used in combination with the above described phosphors and the light emitted from such phosphors. Optical filters may also be used.

Filters

This invention may be practiced in combination with an optical and/or electromagnetic (EMI) filter, screen and/or shield. It is contemplated that the filter, screen, and/or shield may be positioned on a PDP constructed of plasma-shells, for example on the front or top-viewing surface. The plasma-shells may also be tinted. Examples of optical filters, screens, and/or shields are disclosed in U.S. Pat. No. 3,960,754 (Woodcock), U.S. Pat. No. 4,106,857 (Snitzer), U.S. Pat. No. 4,303,298, (Yamashita), U.S. Pat. No. 5,036,025 (Lin), U.S. Pat. No. 5,804,102 (Oi), and U.S. Pat. No. 6,333,592 (Sasa et al.), all incorporated herein by reference. Examples of EM filters, screens, and/or shields are disclosed in U.S. Pat. No. 6,188,174 (Marutsuka), and U.S. Pat. No. 6,316,110 (Anzaki et al.), incorporated herein by reference. Color filters may also be used. Examples are disclosed in U.S. Pat. No. 3,923,527 (Matsuura et al.), U.S. Pat. No. 4,105,577 (Yamashita), U.S. Pat. No. 4,110,245 (Yamashita), and U.S. Pat. No. 4,615,989 (Ritze), all incorporated herein by reference.

IR Filters

The plasma-shell PDP may contain an infrared (IR) filter. An IR filter may be selectively used with one or more plasma-shells to absorb or reflect IR emissions from the display. Such IR emissions may come from the gas discharge inside a plasma-shell and/or from a luminescent substance inside and/or outside of a plasma-shell. An IR filter is necessary if the display is used in a night vision application such as with night vision goggles. With night vision goggles, it is typically necessary to filter near IR from about 650 nm (nanometers) or higher, generally about 650 nm to about 900 nm. In some embodiments the plasma-shell may comprise an IR filter material. The plasma-shell may be made from an IR filter material.

Examples of IR filter materials include cyanine compounds such as phthalocyanine and naphthalocyanine compounds as disclosed in U.S. Pat. No. 5,804,102 (Oi et al.), U.S. Pat. No. 5,811,923 (Zieba et al.), and U.S. Pat. No. 6,297,582 (Hirota et al.), all incorporated herein by reference. The IR compound may also be an organic dye compound such as anthraquinone as disclosed in Hirota et al. ('582) and tetrahedrally coordinated transition metal ions of cobalt and nickel as disclosed in U.S. Pat. No. 7,081,991 (Jones et al.), incorporated herein by reference.

Optical Interference Filter

The filter may comprise an optical interference filter comprising a layer of low refractive index material and a layer of high refractive index material, as disclosed in U.S. Pat. No. 4,647,812 (Vriens et al.) and U.S. Pat. No. 4,940,636 (Brock et al.), both incorporated herein by reference. In one embodiment, each plasma-shell is composed of a low refraction index material and a high refraction index material. Examples of low refractive index materials include magnesium fluoride and silicon dioxide such as amorphous $SiO_2$. Examples of high refractive index materials include tantalum oxide and titanium oxide. In one embodiment, the high refractive index material is titanium oxide and at least one metal oxide selected from zirconium oxide, hafnium oxide, tantalum oxide, magnesium oxide, and calcium oxide.

Mixtures of Luminescent Substances

It is contemplated that mixtures of luminescent substances may be used including inorganic and inorganic, organic and organic, and inorganic and organic. The brightness of the luminescent substance may be increased by dispersing inorganic materials into organic luminescent substances or vice versa. Stokes or Anti-Stokes materials may be used.

Layers of Luminescent Substances

Two or more layers of the same or different luminescent substances may be selectively applied to the plasma-shells. Such layers may comprise combinations of organic and organic, inorganic and inorganic, and/or inorganic and organic.

Combination of Plasma-shells

In the practice of this invention, there may be used combinations of plasma-shells. Thus plasma-shells may be used with selected organic and/or inorganic luminescent substances to provide one color with other plasma-shells such as plasma-spheres or plasma-domes used with selected organic and/or or inorganic luminescent substances to provide other colors.

Stacking of Plasma-shells

In a multicolor display such as RGB PDP, plasma-shells with flat sides such as plasma-discs and/or plasma-domes may be stacked on top of each other or arranged in parallel side-by-side positions on the substrate. This configuration requires less area of the display surface compared to conventional RGB displays that require red, green and blue pixels adjacent to each other on the substrate. This stacking embodiment may be practiced with plasma-discs and/or plasma-domes that use various color emitting gases such as the excimer gases. Phosphor containing plasma-shells in combination with excimers may also be used. Each plasma-shell may also be of a different color material such as tinted glass.

Plasma-Shells Combined with Plasma-Tubes

The PDP structure may comprise a combination of plasma-shells and plasma-tubes. Plasma-tubes comprise elongated tubes for example as disclosed in U.S. Pat. No. 3,602,754 (Pfaender et al.), U.S. Pat. No. 3,654,680 (Bode et al.), U.S. Pat. No. 3,927,342 (Bode et al.), U.S. Pat. No. 4,038,577 (Bode et al.), U.S. Pat. No. 3,969,718 (Stom), U.S. Pat. No. 3,990,068 (Mayer et al.), U.S. Pat. No. 4,027,188 (Bergman), U.S. Pat. No. 5,984,747 (Bhagavatula et al.), U.S. Pat. No. 6,255,777 (Kim et al.), U.S. Pat. No. 6,633,117 (Shinoda et al.), U.S. Pat. No. 6,650,055 (Ishimoto et al.), and U.S. Pat. No. 6,677,704 (Ishimoto et al.), all incorporated herein by reference. Both AC and DC gas discharge tubes are contemplated.

As used herein, the elongated plasma-tube is intended to include capillary, filament, filamentary, illuminator, hollow rod, or other such terms. It includes an elongated enclosed gas filled structure having a length dimension that is greater than its cross-sectional width dimension. The width of the plasma-tube is the viewing width from the top or bottom (front or rear) of the display. A plasma-tube has multiple gas discharge pixels of 100 or more, typically 500 to 1000 or more, whereas a plasma-shell typically has only one gas discharge pixel. In some embodiments, the plasma-shell may comprise more than one pixel, i.e., 2, 3, or 4 pixels up to about 10 pixels.

The length of each plasma-tube may vary depending upon the PDP structure. In one embodiment hereof, an elongated tube is selectively divided into a multiplicity of lengths. In another embodiment, there is used a continuous tube that winds or weaves back and forth from one end to the other end of the PDP.

The plasma-tubes may be arranged in any configuration. In one embodiment, there are alternative rows of plasma-shells and plasma-tubes. The plasma-tubes may be used for any desired function or purpose including the priming or conditioning of the plasma-shells. In one embodiment, the plasma-tubes are arranged around the perimeter of the display to provide priming or conditioning of the plasma-shells. The plasma-tubes may be of any geometric cross-section including circular, elliptical, square, rectangular, triangular, polygonal, trapezoidal, pentagonal or hexagonal. The plasma-tube may contain secondary electron emission materials, luminescent substances, and reflective materials as discussed herein for plasma-shells. The plasma-tubes may also utilize positive column discharge as discussed herein for plasma-shells. Plasma-tubes with positive column discharge are disclosed in U.S. Pat. No. 7,122,961 (Wedding) and U.S. Pat. No. 7,157,854 (Wedding), both incorporated herein by reference.

SUMMARY

Aspects of this invention may be practiced with a coplanar or opposing substrate PDP as disclosed in the U.S. Pat. No. 5,793,158 (Wedding) and U.S. Pat. No. 5,661,500 (Shinoda et al.). There also may be used a single-substrate or monolithic PDP as disclosed in the U.S. Pat. No. 3,646,384 (Lay), U.S. Pat. No. 3,860,846 (Mayer), U.S. Pat. No. 3,935,484 (Dick et al.) and other single substrate patents, discussed above and incorporated herein by reference.

In the practice of this invention, the plasma-shells may be positioned and spaced in an AC gas discharge plasma display structure so as to utilize and take advantage of the positive column of the gas discharge. The positive column is described in U.S. Pat. No. 6,184,848 (Weber) and is incorporated herein by reference.

Although this invention has been disclosed and described above with reference to dot matrix gas discharge displays, it may also be used in an alphanumeric gas discharge display using segmented electrodes. This invention may also be practiced in AC or DC gas discharge displays including hybrid structures of both AC and DC gas discharge.

The plasma-shells may contain a gaseous mixture for a gas discharge display or may contain other substances such as an electroluminescent (EL) or liquid crystal materials for use with other display technologies including electroluminescent displays (ELD), liquid crystal displays (LCD), field emission displays (FED), electrophoretic displays, and Organic EL or Organic LED (OLED).

The use of plasma-shells on a single flexible or bendable substrate allows the encapsulated pixel display device to be utilized in a number of applications. In one application, the device is used as a plasma shield to absorb electromagnetic radiation and to make the shielded object invisible to enemy radar. In this embodiment, a flexible sheet of plasma-shells may be provided as a blanket over the shielded object.

In another embodiment, the PDP device is used to detect radiation such as nuclear radiation from a nuclear device, mechanism, apparatus or container. This is particularly suitable for detecting hidden nuclear devices at airports, loading docks, bridges, and other such locations.

The foregoing description of various preferred embodiments of the invention has been presented for purposes of illustration and description. It is not intended to be exhaustive or to limit the invention to the precise forms disclosed. Obvious modifications or variations are possible in light of the above teachings. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims to be interpreted in accordance with the breadth to which they are fairly, legally, and equitably entitled.

The invention claimed is:

1. In a gas discharge plasma display device having a multiplicity of gas discharge pixels, each pixel being in contact with at least two electrodes, the improvement wherein each pixel is within a plasma-disc, said plasma-disc containing a single pixel and having two opposing flat sides with at least one electrode being connected to a side of said plasma-disc that is not flat, said electrodes being connected to electrical circuitry for selectively addressing each pixel with gas discharge voltages.

2. The invention of claim 1 wherein each plasma-disc is addressed with AC voltages.

3. The invention of claim 1 wherein each plasma-disc is addressed with DC voltages.

4. The invention of claim 1 wherein each plasma-disc is operated with positive column gas discharges.

5. In a gas discharge plasma-display device having a multiplicity of gas discharge display pixels, each pixel being defined by a gas filled plasma-disc electrically connected to two or more electrodes, said plasma-disc containing a single pixel and having two opposing flat sides, the improvement which comprises selectively addressing each plasma-disc with at least one electrode electrically connected to a non-flat side of said plasma-disc.

6. A method for producing a gas discharge plasma display panel having a multiplicity of gas discharge pixels, each pixel being within a gas filled plasma-disc, each plasma-disc disc containing a single pixel and having two opposing flat sides, which method comprises:

locating a multiplicity of plasma-discs on a substrate, and electrically contacting at least two electrodes to each of said plasma-discs, at least one of said electrodes being electrically contacted to a side of each said plasma-disc that is not flat.

7. The invention of claim 6 wherein each said electrode is connected to electronic circuitry for selectively addressing each plasma-disc with AC and/or DC gas discharge voltages.

8. The invention of claim 6 wherein each said plasma-disc is operated with positive column discharge.

9. The invention of claim 6 wherein each said plasma-disc contains a luminescent substance.

10. The invention of claim 9 wherein said luminescent substance is on the exterior of each said plasma-disc.

11. The invention of claim 9 wherein said luminescent substance is in the interior of each said plasma-disc.

12. The invention of claim 9 wherein said luminescent substance comprises an organic luminescent material, an inorganic luminescent material, or both an organic and an inorganic luminescent material.

13. The invention of claim 9 wherein said luminescent substance includes an up-conversion material or a down-conversion material.

14. The invention of claim 6 wherein each said plasma-disc is partially or wholly made of a luminescent substance.

15. The invention of claim 6 wherein said substrate is rigid, flexible or semi-flexible.

16. The invention of claim 6 wherein each said plasma-disc contains a conductive pad for electrical connection to an electrode.

17. The invention of claim 16 wherein one electrode is connected to said conductive pad by a conductive via in said substrate.

18. The invention of claim 6 wherein at least two of said electrodes electrically connected to each said plasma-disc are orthogonal to each other.

19. The invention of claim 6 wherein at least two of said electrodes electrically connected to each said plasma-disc are parallel to each other.

20. The invention of claim 6 wherein at least two of said electrodes electrically connected to each said plasma-disc are parallel to each other and at least one other of said electrodes electrically connected to each said plasma-disc is orthogonal to said parallel electrodes.

* * * * *